US011647873B2

(12) United States Patent
Kim et al.

(10) Patent No.: US 11,647,873 B2
(45) **Date of Patent: *May 16, 2023**

(54) TOWEL MAINTENANCE DEVICE

(71) Applicant: LG ELECTRONICS INC., Seoul (KR)

(72) Inventors: Jong Seok Kim, Seoul (KR); Inhyung Yang, Seoul (KR); Jin Hyeon Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 329 days.

This patent is subject to a terminal disclaimer.

(21) Appl. No.: 17/277,470

(22) PCT Filed: Sep. 27, 2018

(86) PCT No.: PCT/KR2018/011459

§ 371 (c)(1),
(2) Date: Mar. 18, 2021

(87) PCT Pub. No.: WO2019/066509

PCT Pub. Date: Apr. 4, 2019

(65) Prior Publication Data

US 2021/0345839 A1 Nov. 11, 2021

(30) Foreign Application Priority Data

Sep. 29, 2017 (KR) ..... 10-2017-0128277
Oct. 31, 2017 (KR) ..... 10-2017-0144282
(Continued)

(51) Int. Cl.
*A47K 10/06* (2006.01)
*A47K 10/10* (2006.01)
(Continued)

(52) U.S. Cl.
CPC ..... *A47K 10/06* (2013.01); *A47K 10/10* (2013.01); *F26B 3/06* (2013.01); *F26B 3/20* (2013.01); *F26B 21/10* (2013.01)

(58) Field of Classification Search
CPC ..... A47K 10/06; A47K 10/10; F26B 3/06; F26B 3/20; F26B 21/10
(Continued)

(56) References Cited

U.S. PATENT DOCUMENTS 3,839,622 A 10/1974 Mastin
5,755,040 A * 5/1998 Ou ..... D06F 58/10 34/225
(Continued)

FOREIGN PATENT DOCUMENTS

EP 3333306 A1 * 6/2018 ..... D06F 58/10
EP 3705007 10/2021
(Continued)

OTHER PUBLICATIONS

International Search Report dated Jan. 16, 2019 issued in Application No. PCT/KR2018/011459.
(Continued)

*Primary Examiner* — Stephen M Gravini
(74) *Attorney, Agent, or Firm* — Ked & Associates, LLP

(57) ABSTRACT

The present disclosure relates to a towel maintenance device for storing and keeping a towel and for heating and drying the towel stored and kept therein. The towel maintenance device —provides a structure in which heated air flows in a first staying space formed in a heat transfer plate and heats the heat transfer plate, thereby allowing a textile product such as a towel and the like in contact with the heat transfer plate to be heated based on thermal conduction, and the heated air discharged through a communicating hole of the heat transfer plate is discharged while passing through the
(Continued)

textile product such as a towel and the like or flows around the textile product such as a towel and the like, thereby allowing the product to be dried to be heated based on convection. The towel maintenance device according to the present disclosure enables entire objects to be dried to be rapidly heated and dried.

13 Claims, 40 Drawing Sheets

(30) Foreign Application Priority Data

| | | |
|---|---|---|
| Nov. 1, 2017 | (KR) | 10-2017-0144967 |
| Nov. 16, 2017 | (KR) | 10-2017-0153363 |
| Sep. 14, 2018 | (KR) | 10-2018-0110541 |

(51) Int. Cl.
*F26B 3/06* (2006.01)
*F26B 3/20* (2006.01)
*F26B 21/10* (2006.01)

(58) Field of Classification Search
USPC ..... 34/87
See application file for complete search history.

(56) References Cited

U.S. PATENT DOCUMENTS

| | | | | |
|---|---|---|---|---|
| 5,806,203 | A | 9/1998 | Robinson | |
| 5,829,161 | A * | 11/1998 | Hung | A47K 10/06 34/239 |
| 6,046,436 | A | 4/2000 | Hunts | |
| 6,153,862 | A | 11/2000 | Job | |
| 7,039,304 | B2 * | 5/2006 | Gerhardinger | A47K 10/06 219/544 |
| 7,171,761 | B1 | 2/2007 | Hunts | |
| 8,058,588 | B2 | 11/2011 | Gagas | |
| 8,327,558 | B2 * | 12/2012 | Hu | D06F 58/14 68/5 R |
| 11,471,008 | B2 | 10/2022 | Yang | |
| 2012/0060388 | A1 * | 3/2012 | Rocheleau | F26B 13/103 34/659 |
| 2013/0153560 | A1 | 6/2013 | Lev | |
| 2021/0345839 | A1 * | 11/2021 | Kim | A47K 10/10 |
| 2022/0002933 | A1 * | 1/2022 | Kim | D06F 58/206 |
| 2022/0031127 | A1 * | 2/2022 | Kim | A47K 1/02 |
| 2022/0095855 | A1 * | 3/2022 | Yang | A47K 10/06 |
| 2022/0096672 | A1 * | 3/2022 | Yang | A47K 10/06 |

FOREIGN PATENT DOCUMENTS

| | | | | |
|---|---|---|---|---|
| JP | 3489823 | | 1/2004 | |
| KR | 20-0269788 | | 3/2002 | |
| KR | 20-0298030 | | 12/2002 | |
| KR | 10-2003-0094161 | | 12/2003 | |
| KR | 20-0340758 | | 2/2004 | |
| KR | 20-2007-0000496 | | 4/2007 | |
| KR | 10-2011-0064928 | | 6/2011 | |
| KR | 10-1160247 | | 6/2012 | |
| KR | 10-2015-0053382 | | 5/2015 | |
| KR | 10-2016-0073207 | | 6/2016 | |
| KR | 20-0480835 | | 7/2016 | |
| KR | 10-2018-0013146 | | 2/2018 | |
| KR | 10-2019-0038467 | | 4/2019 | |
| KR | 20090122351 | A * | 11/2019 | |
| WO | WO-2019066508 | A1 * | 4/2019 | A47B 67/04 |
| WO | WO-2019066509 | A1 * | 4/2019 | A47B 67/04 |
| WO | WO 2019/088745 | | 5/2019 | |

OTHER PUBLICATIONS

Korean Office Action dated Sep. 26, 2022 issued in Application No. 10-2018-0110540.
Korean Office Action dated Oct. 27, 2022 issued in Application No. 10-2018-0139447.
U.S. Office Action dated Feb. 21, 2023 issued in U.S. Appl. No. 17/277,510.

* cited by examiner

【FIG. 1】
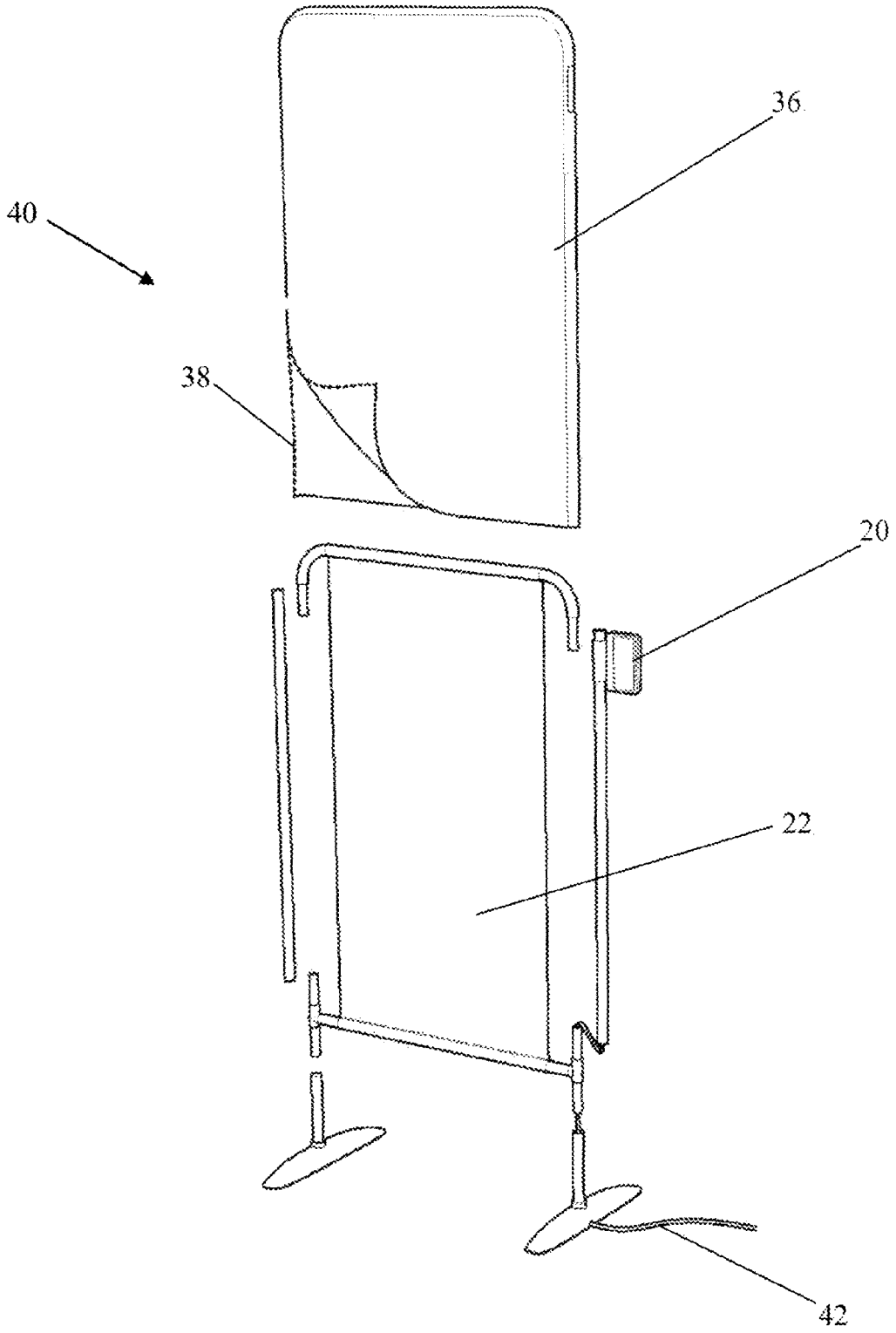

【FIG. 2】
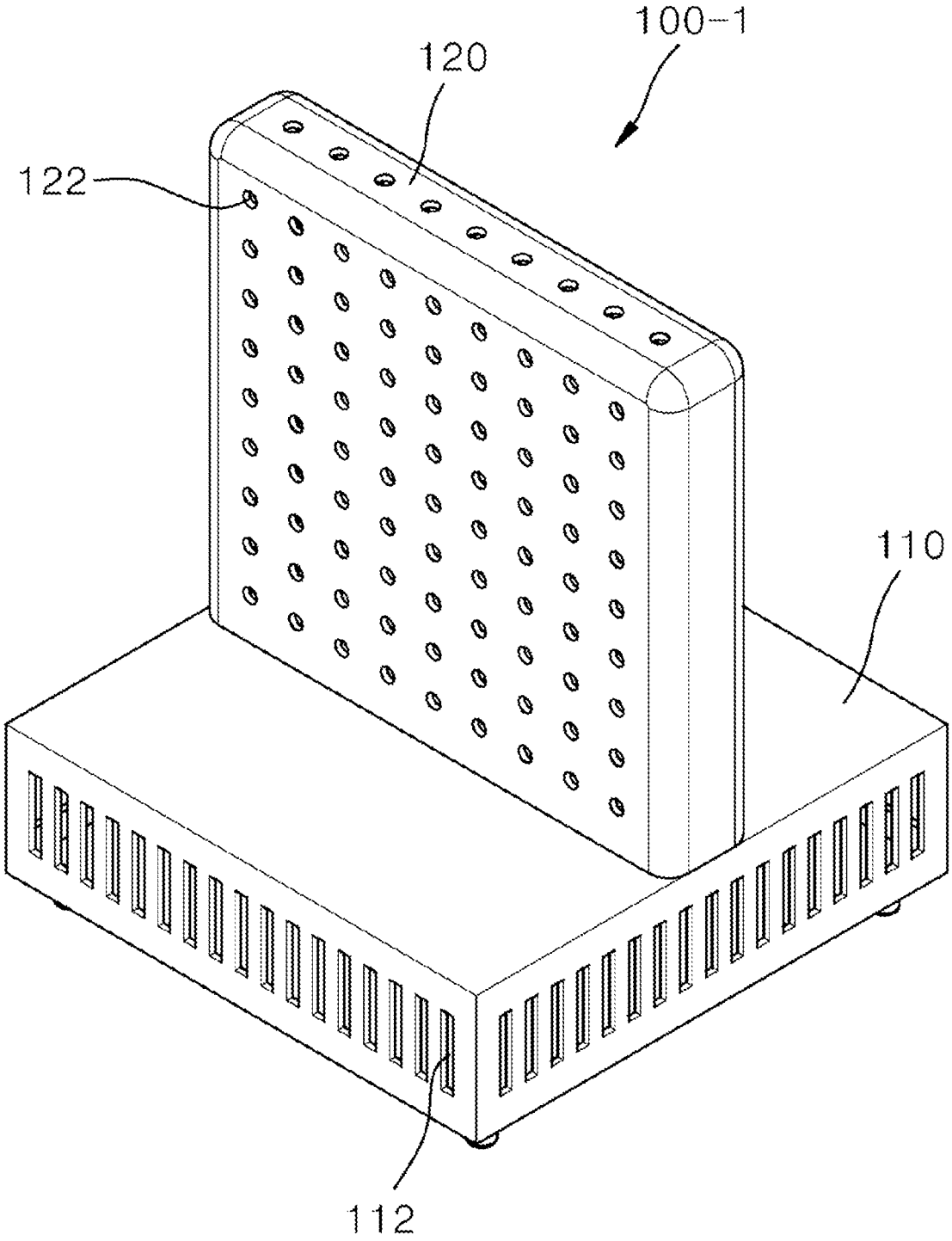

【FIG. 3】
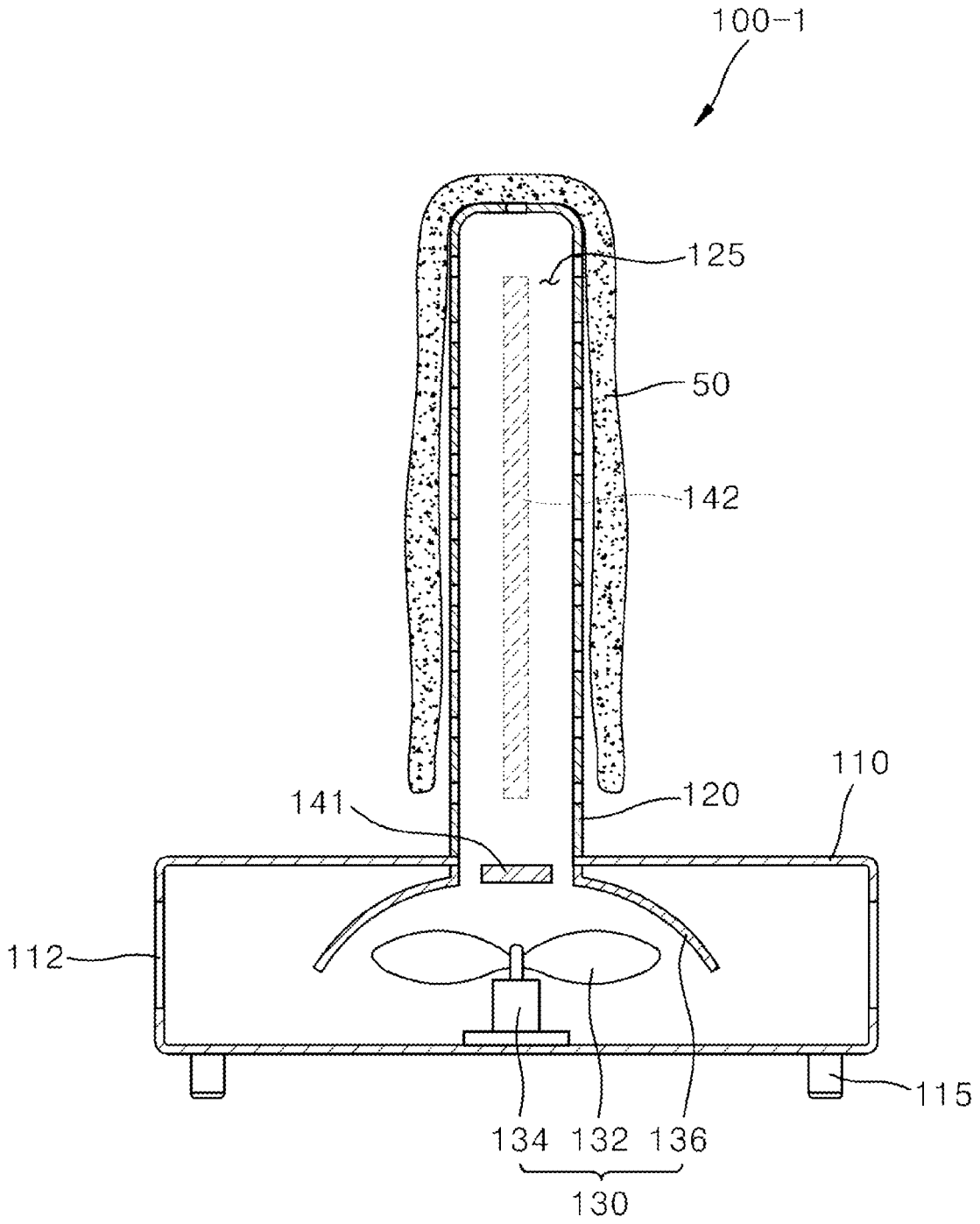

【FIG. 4】
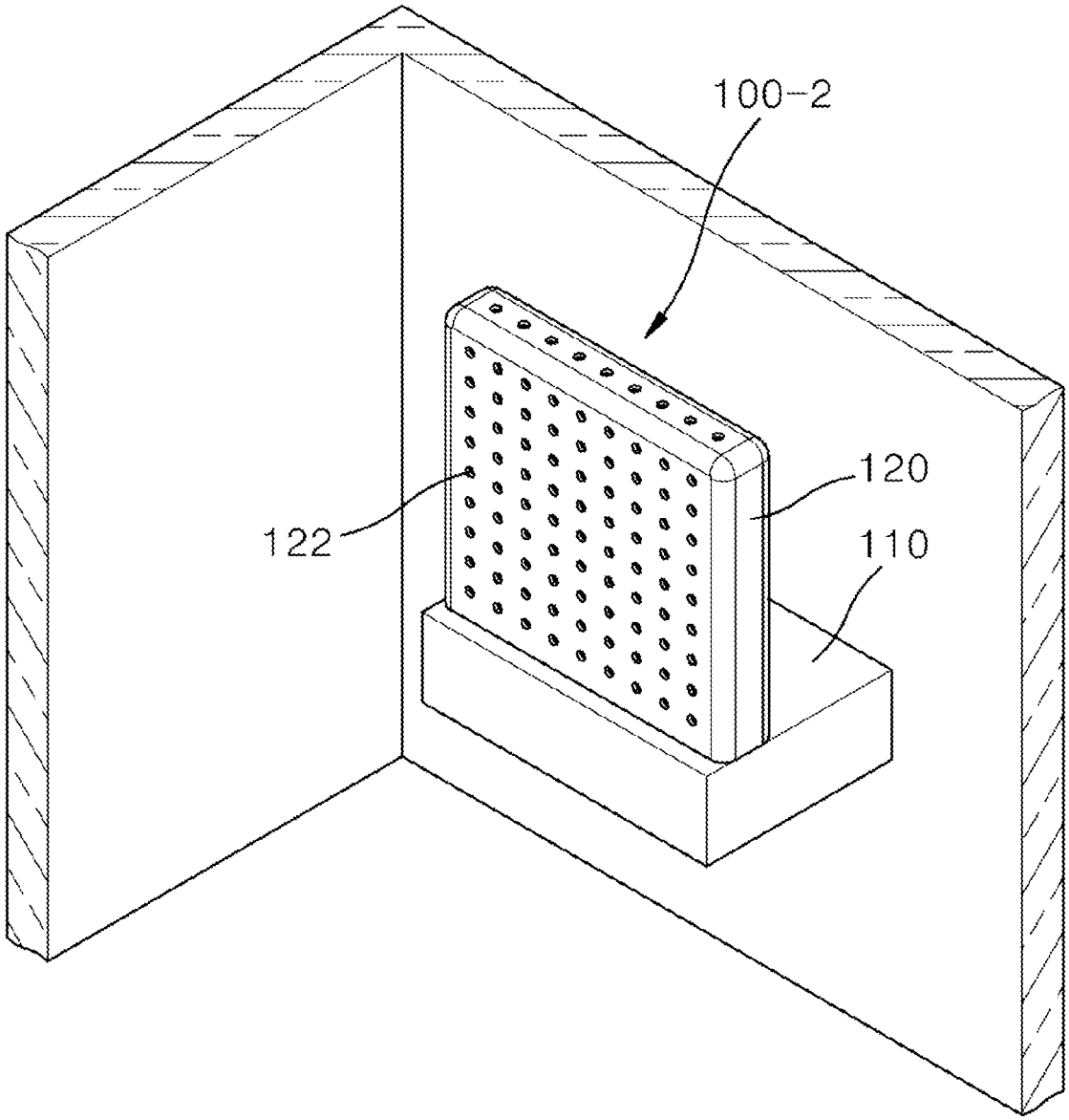

【FIG. 5】
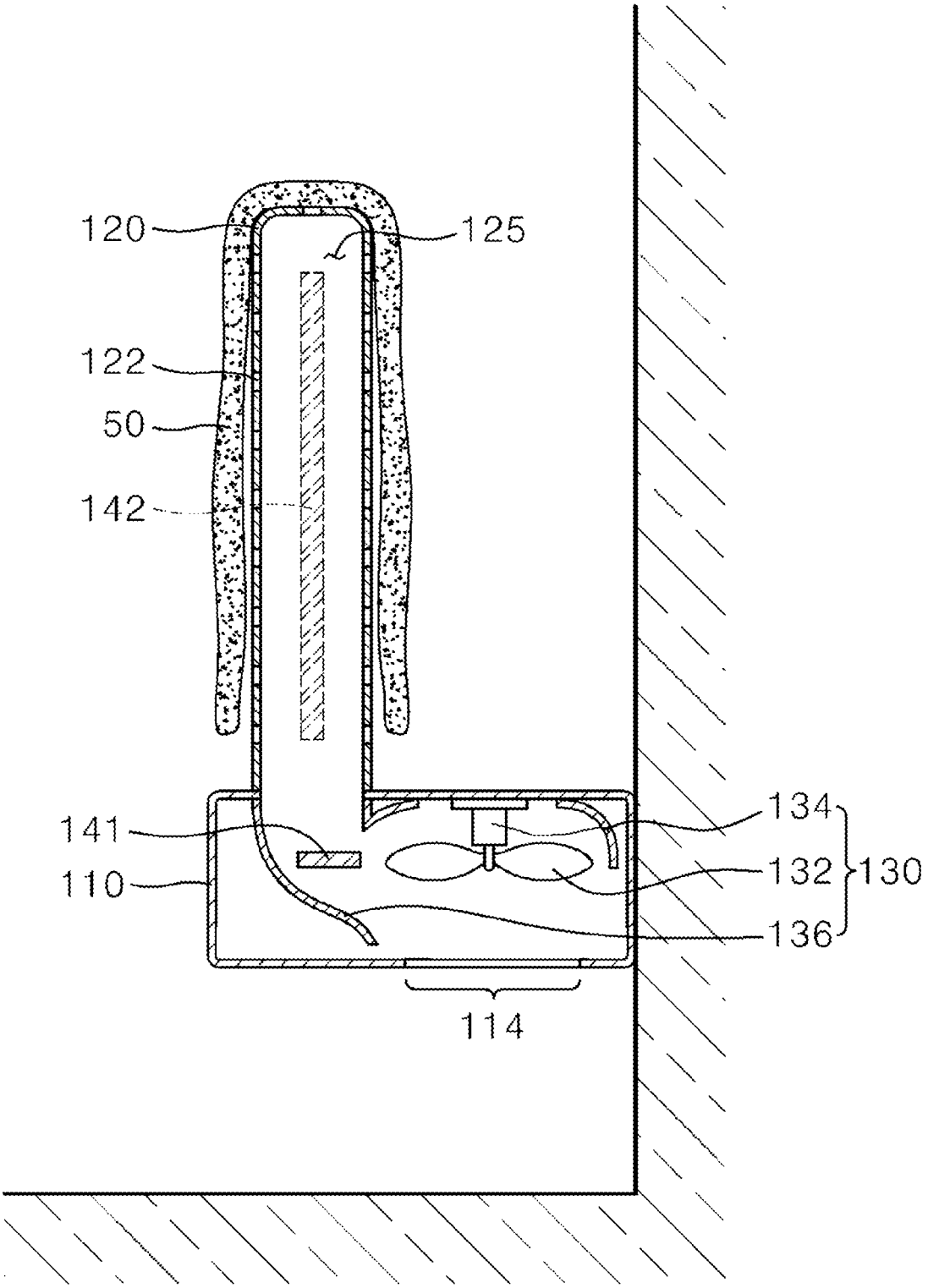

【FIG. 6】
100-3
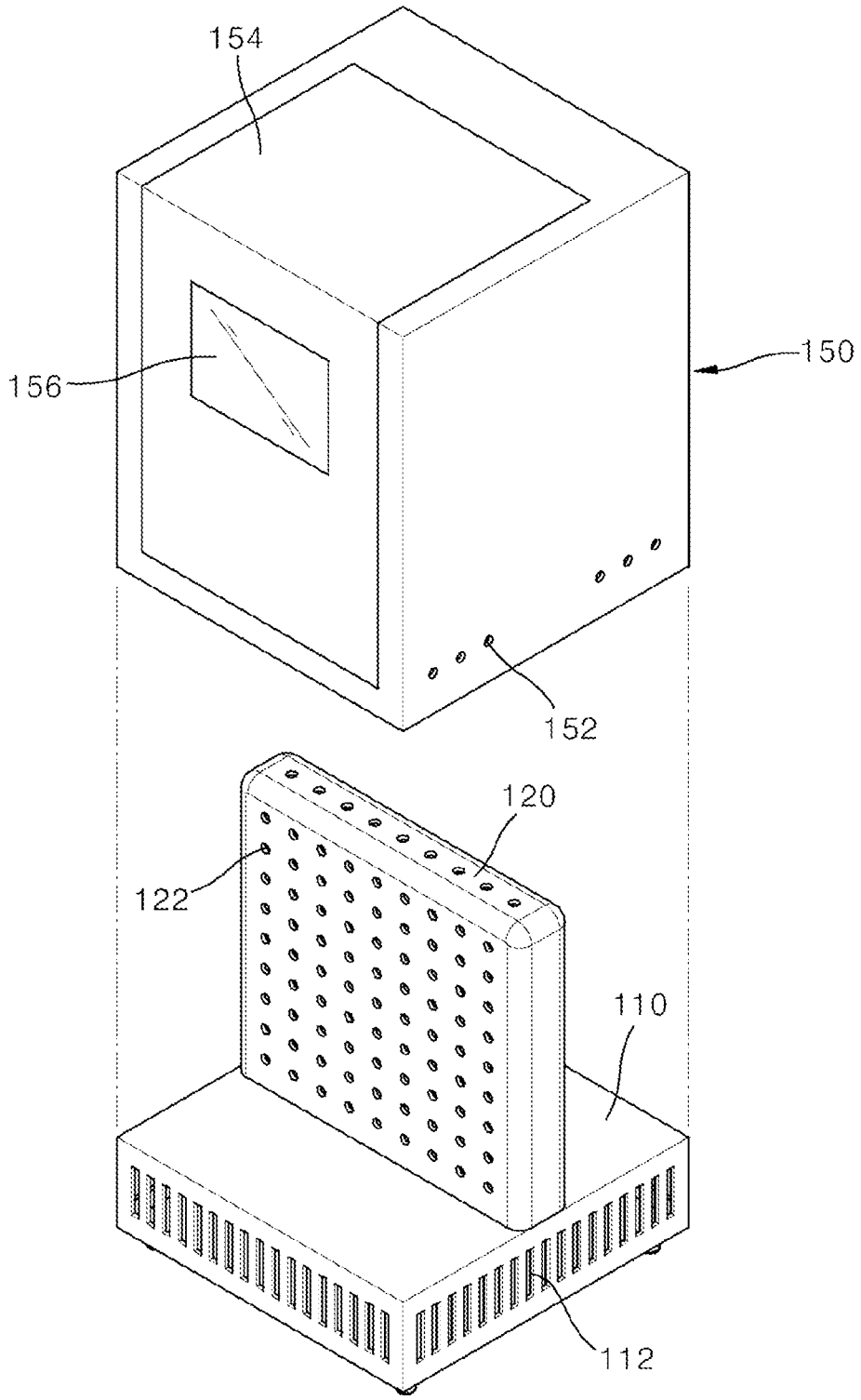

【FIG. 7】
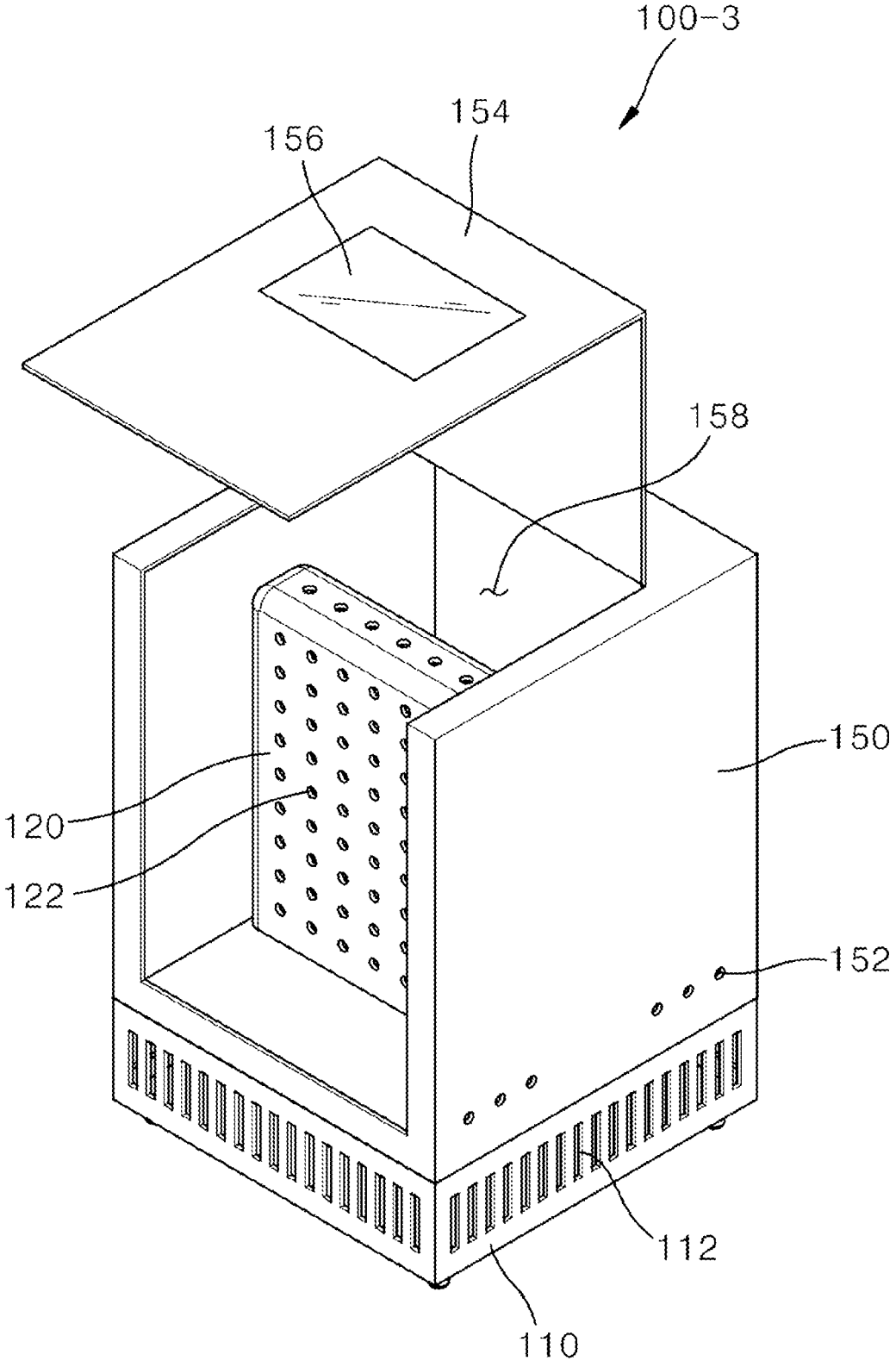

【FIG. 8】
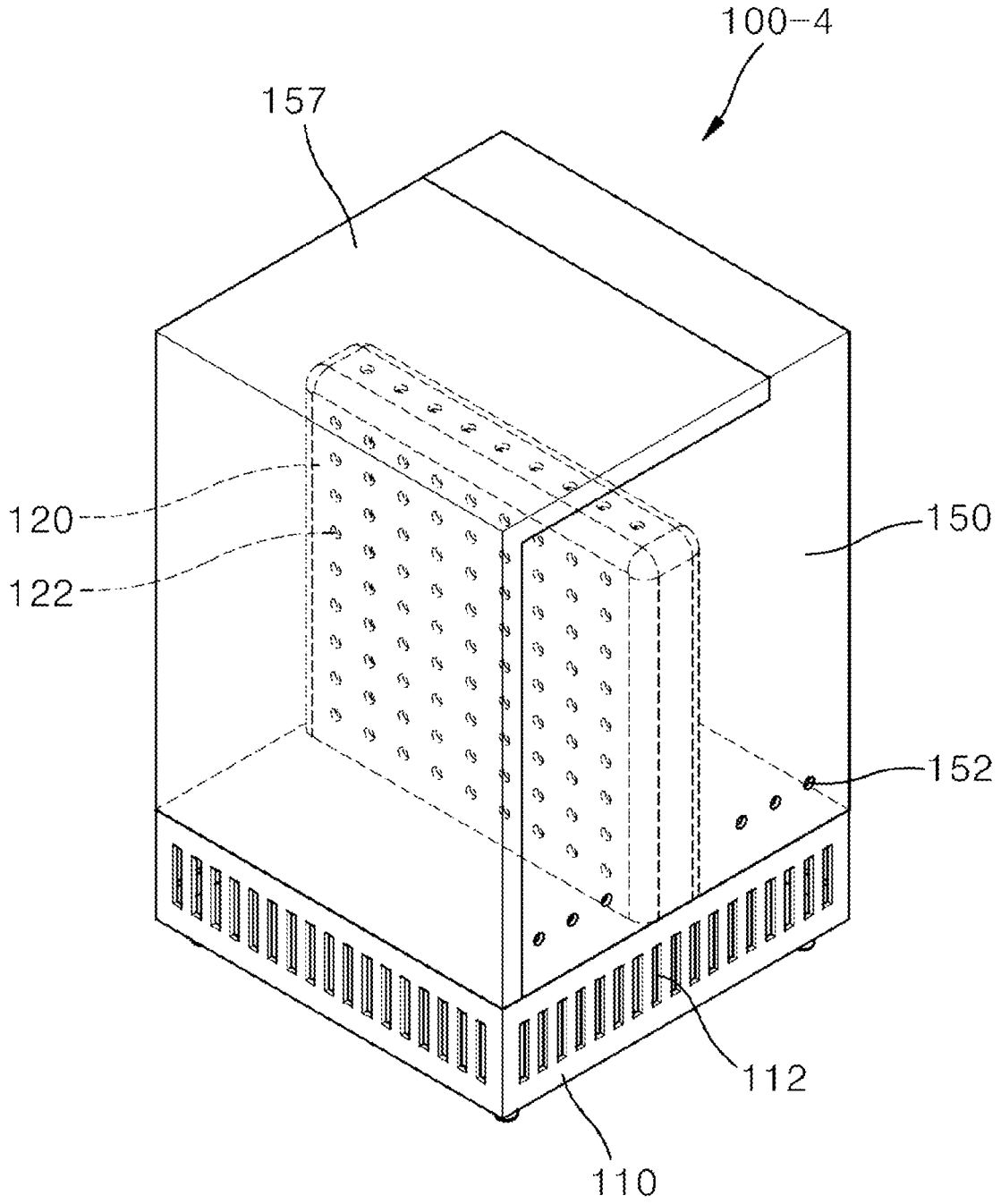

【FIG. 9】
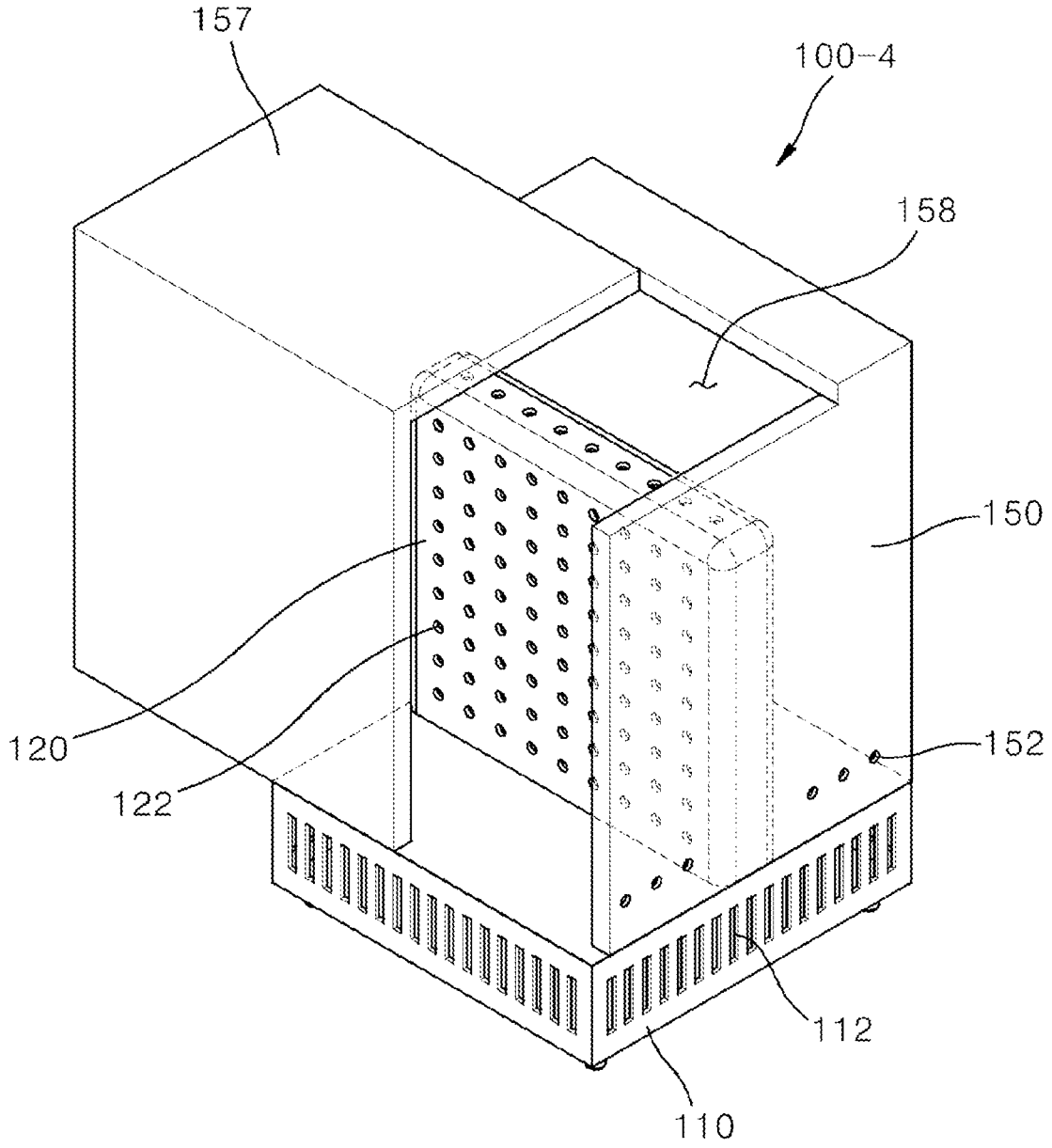

【FIG. 10】
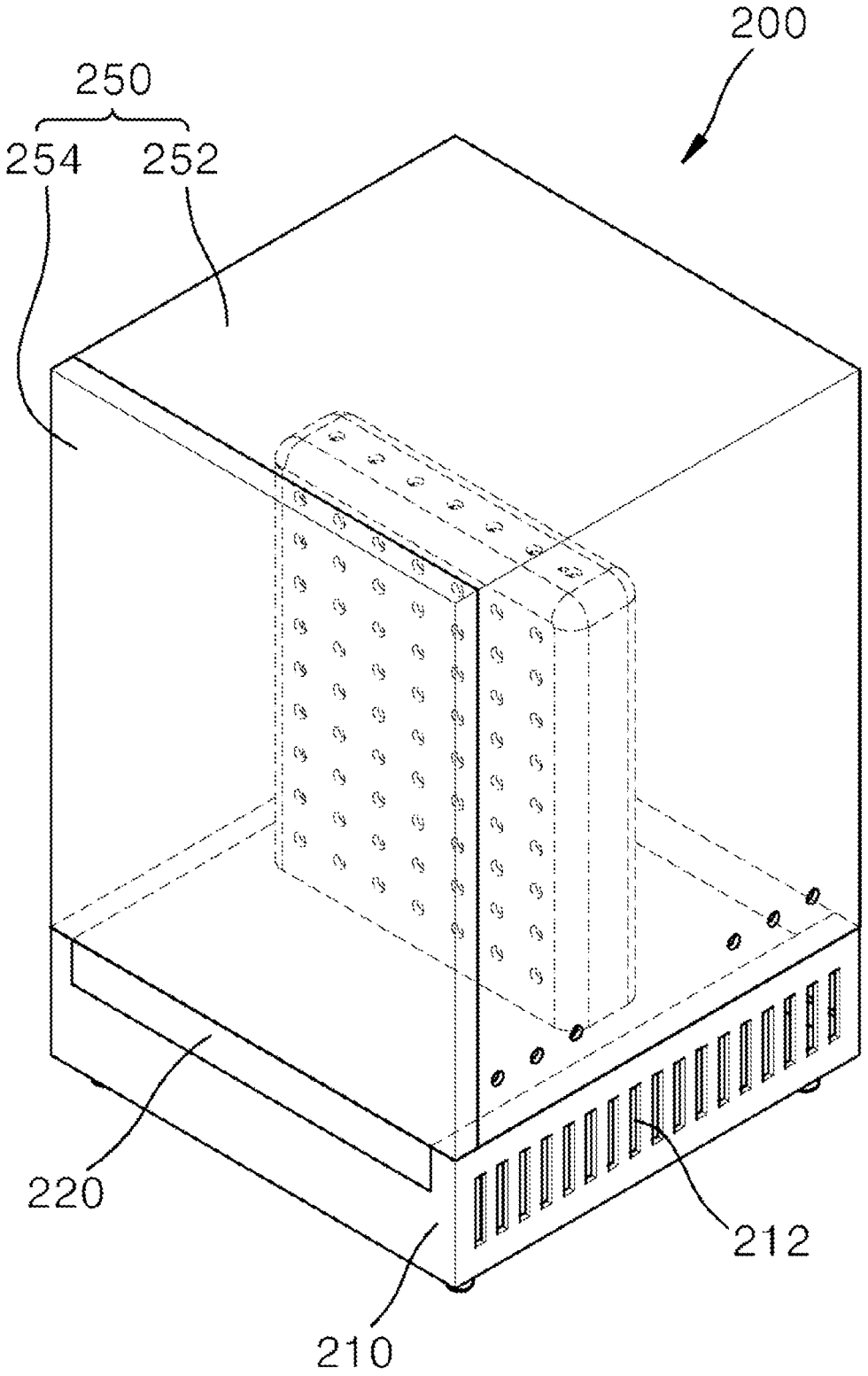

【FIG. 11】
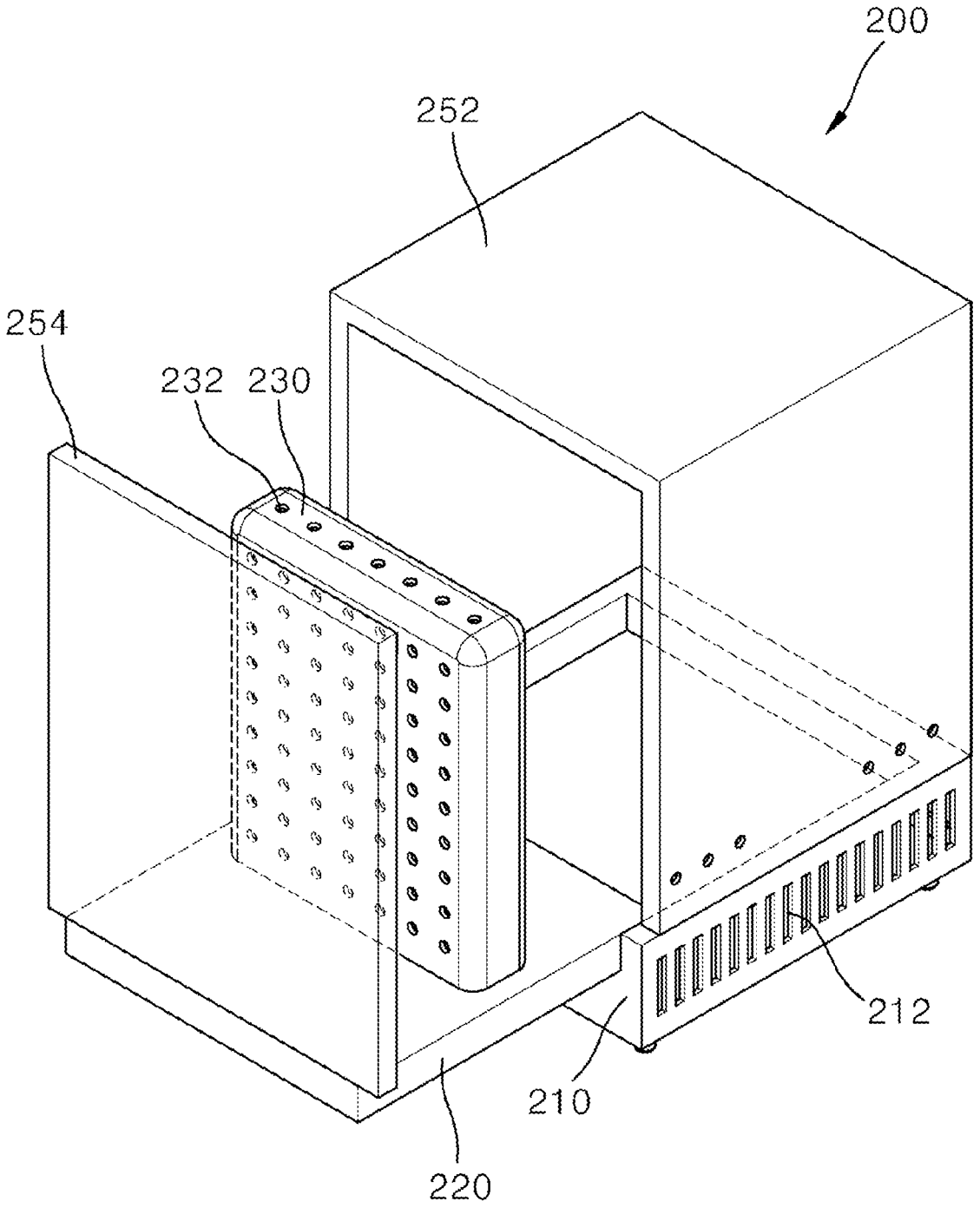

【FIG. 12】
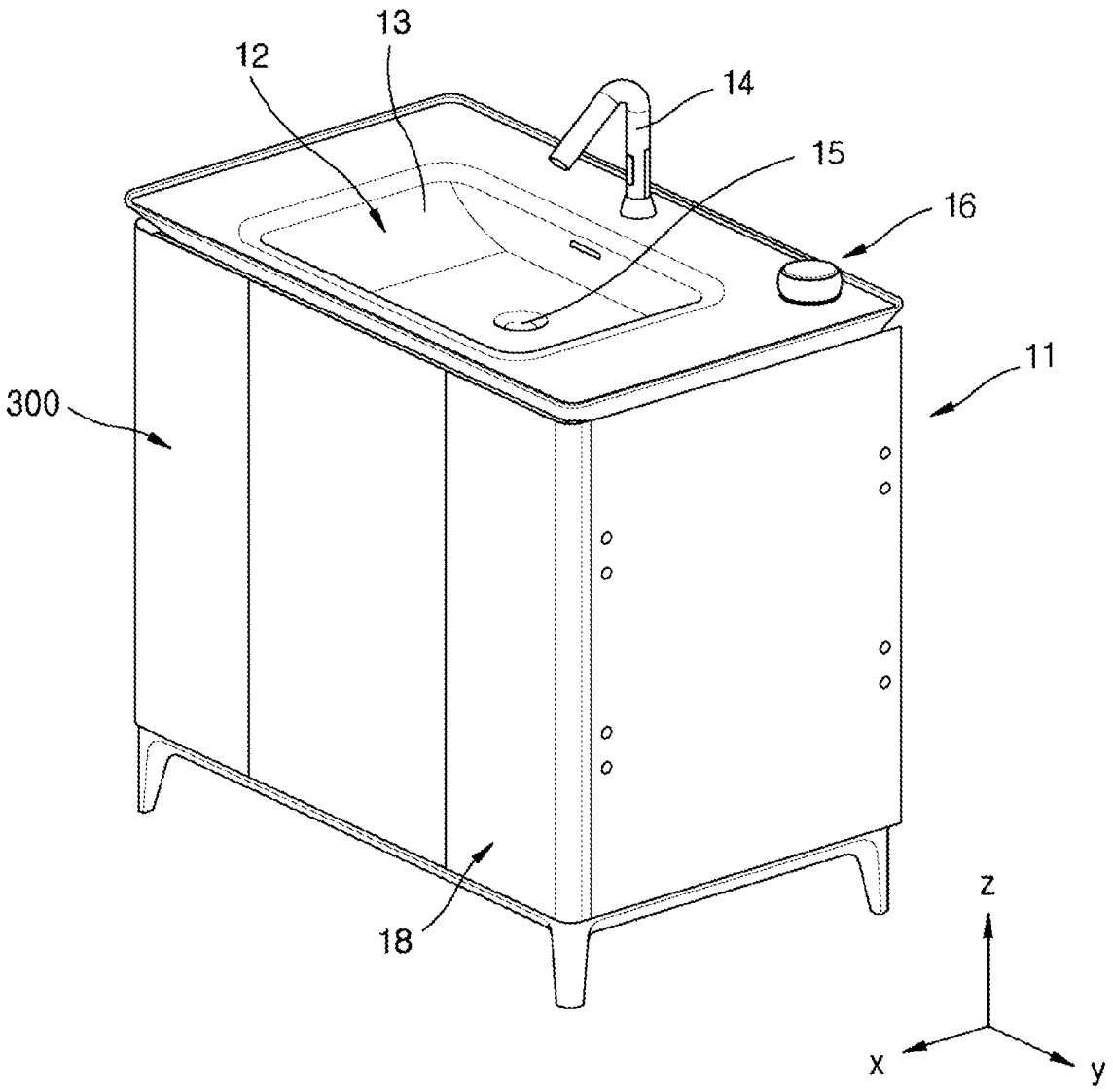

【FIG. 13】
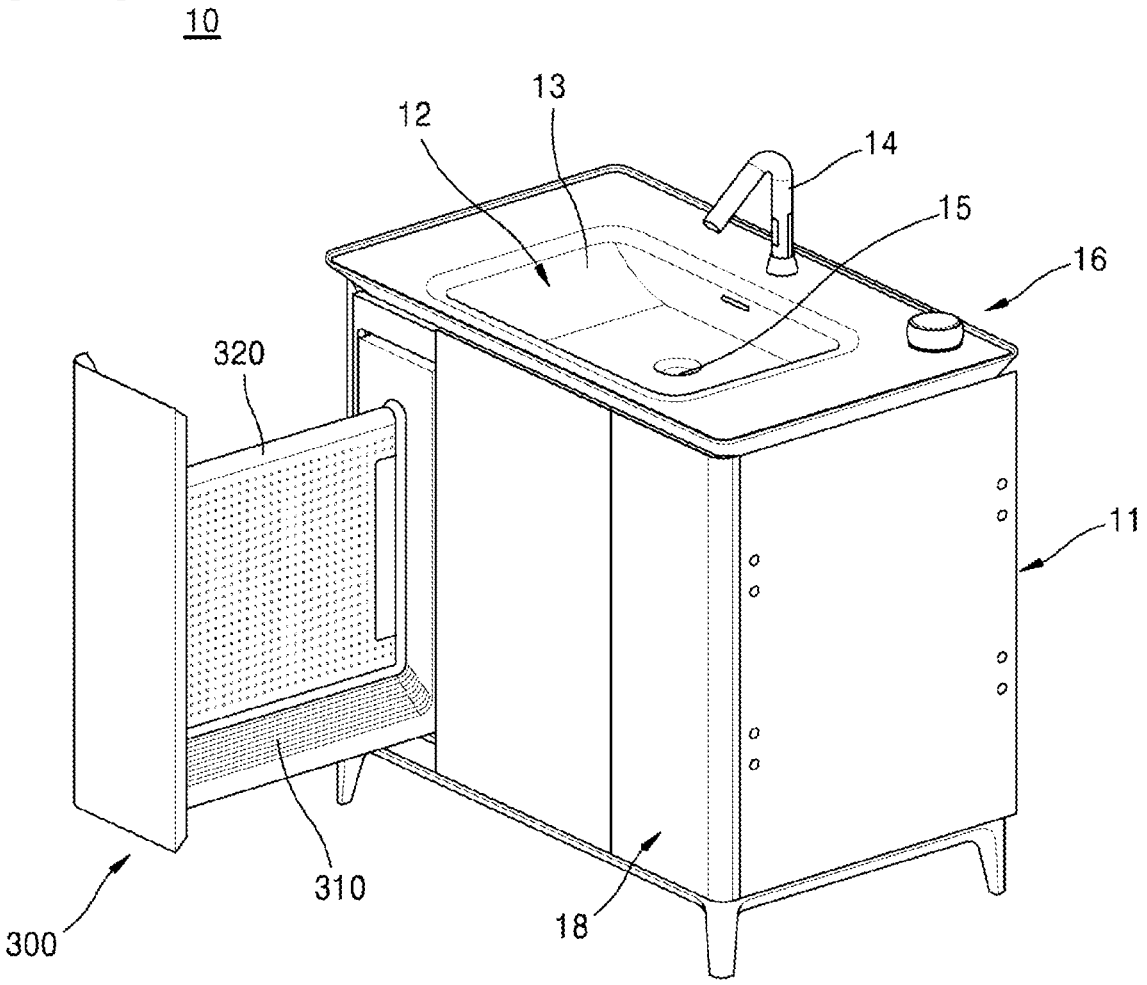

【FIG. 14】
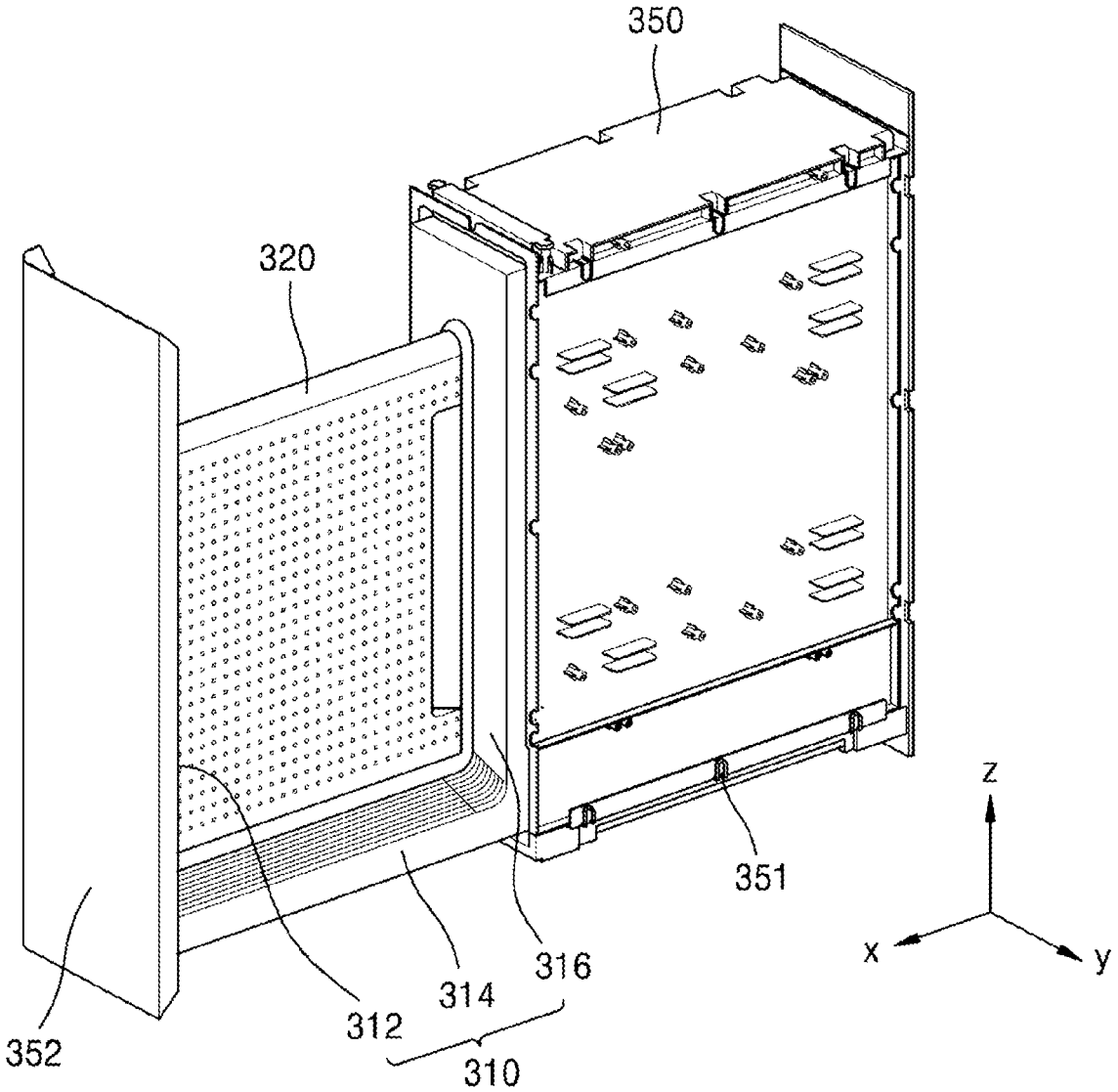

【FIG. 15】
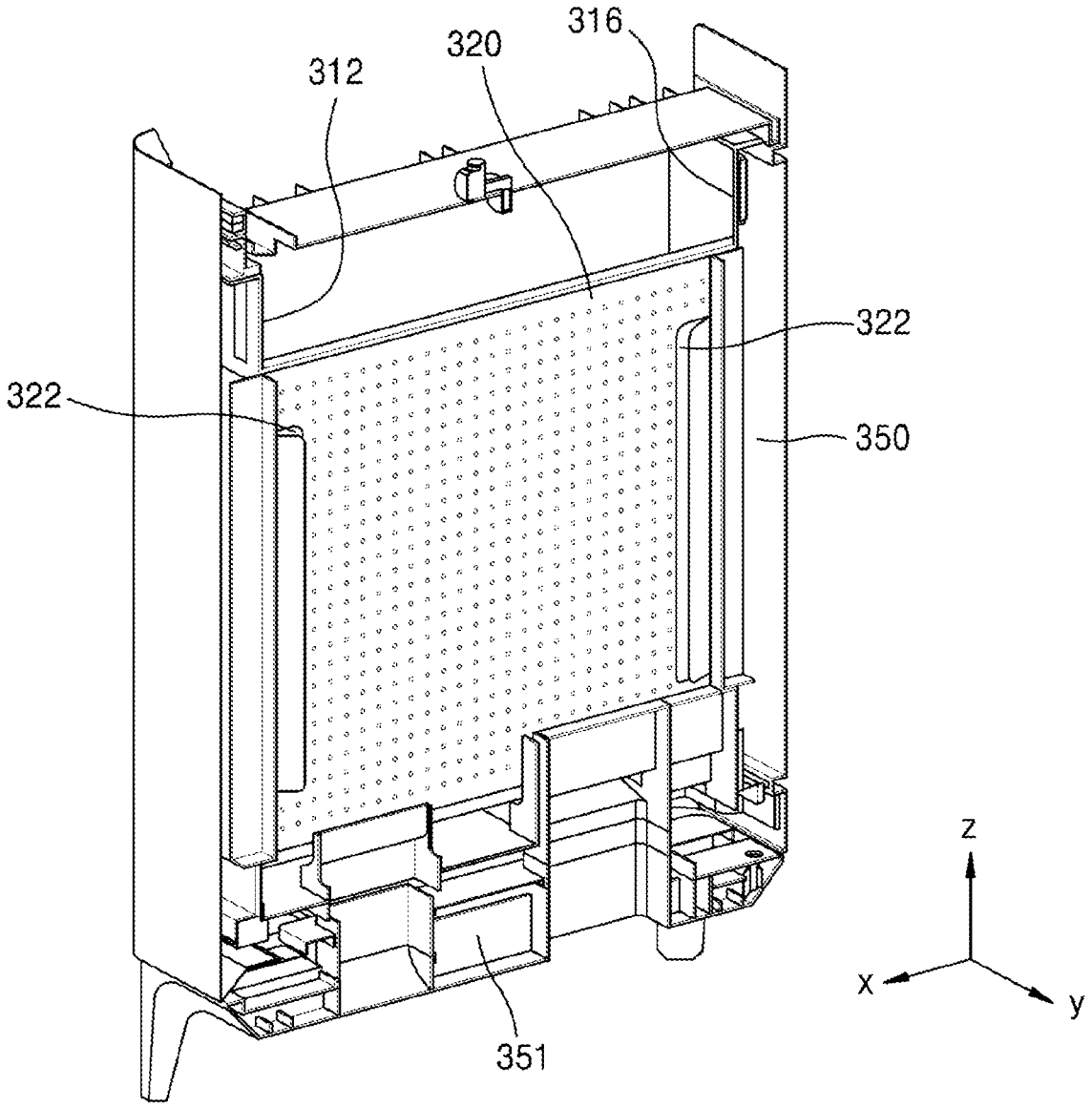

【FIG. 16】
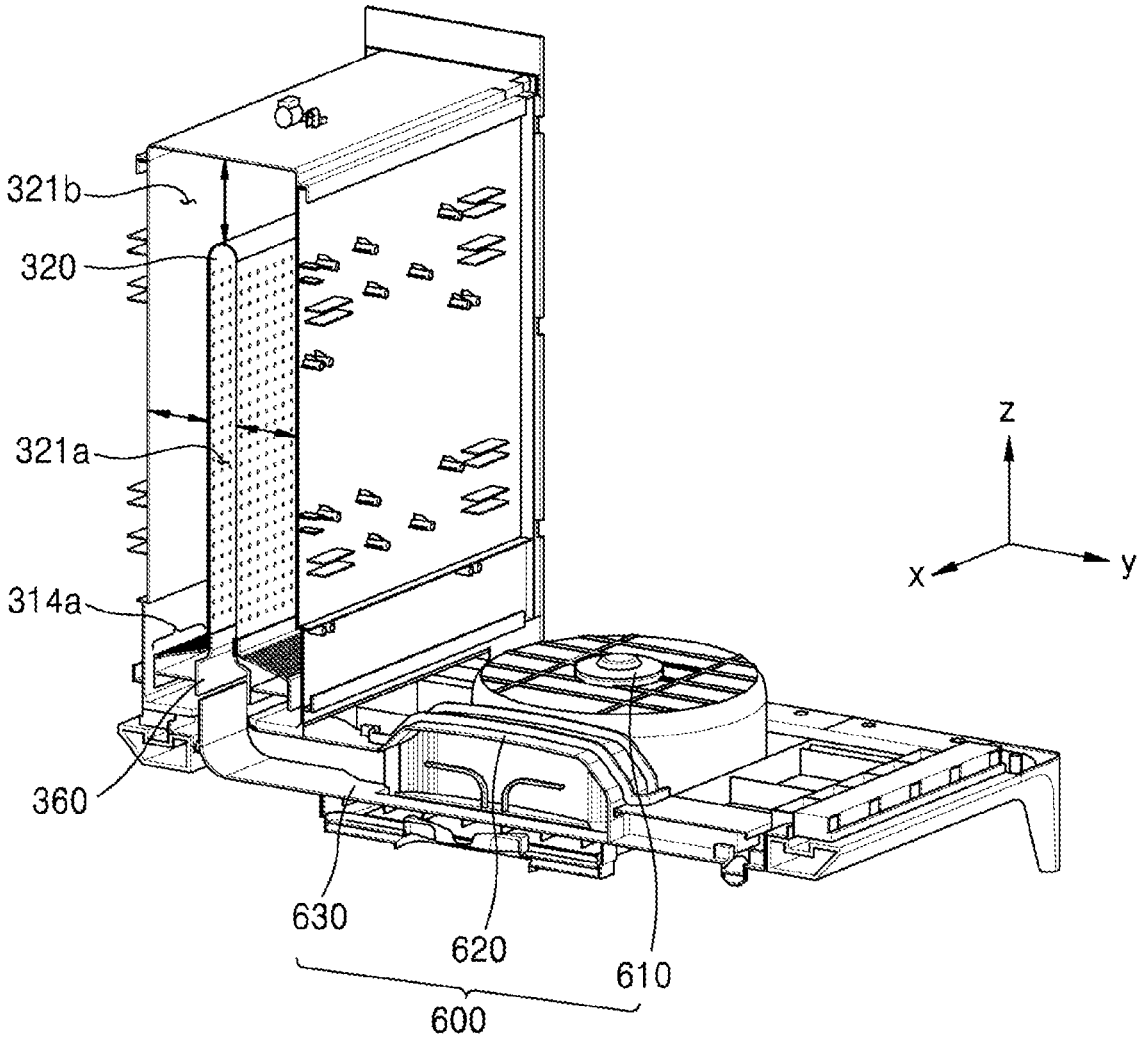

【FIG. 17】
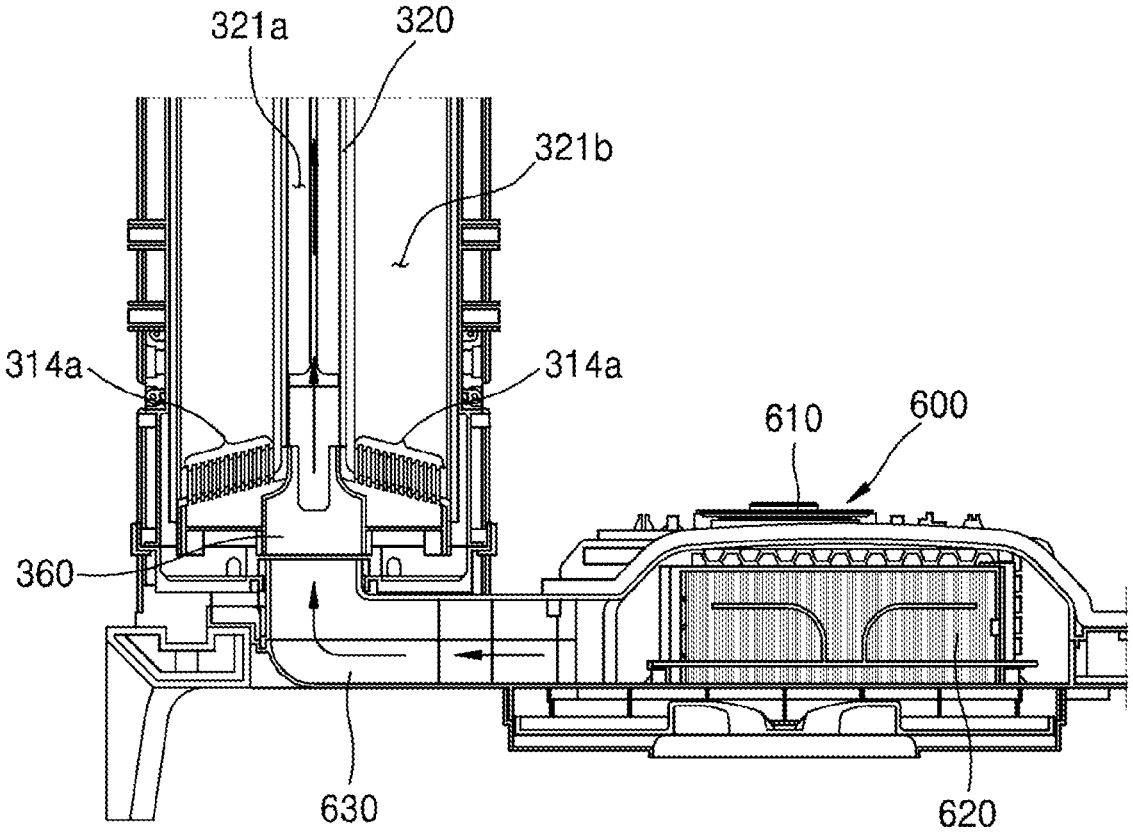

【FIG. 18】
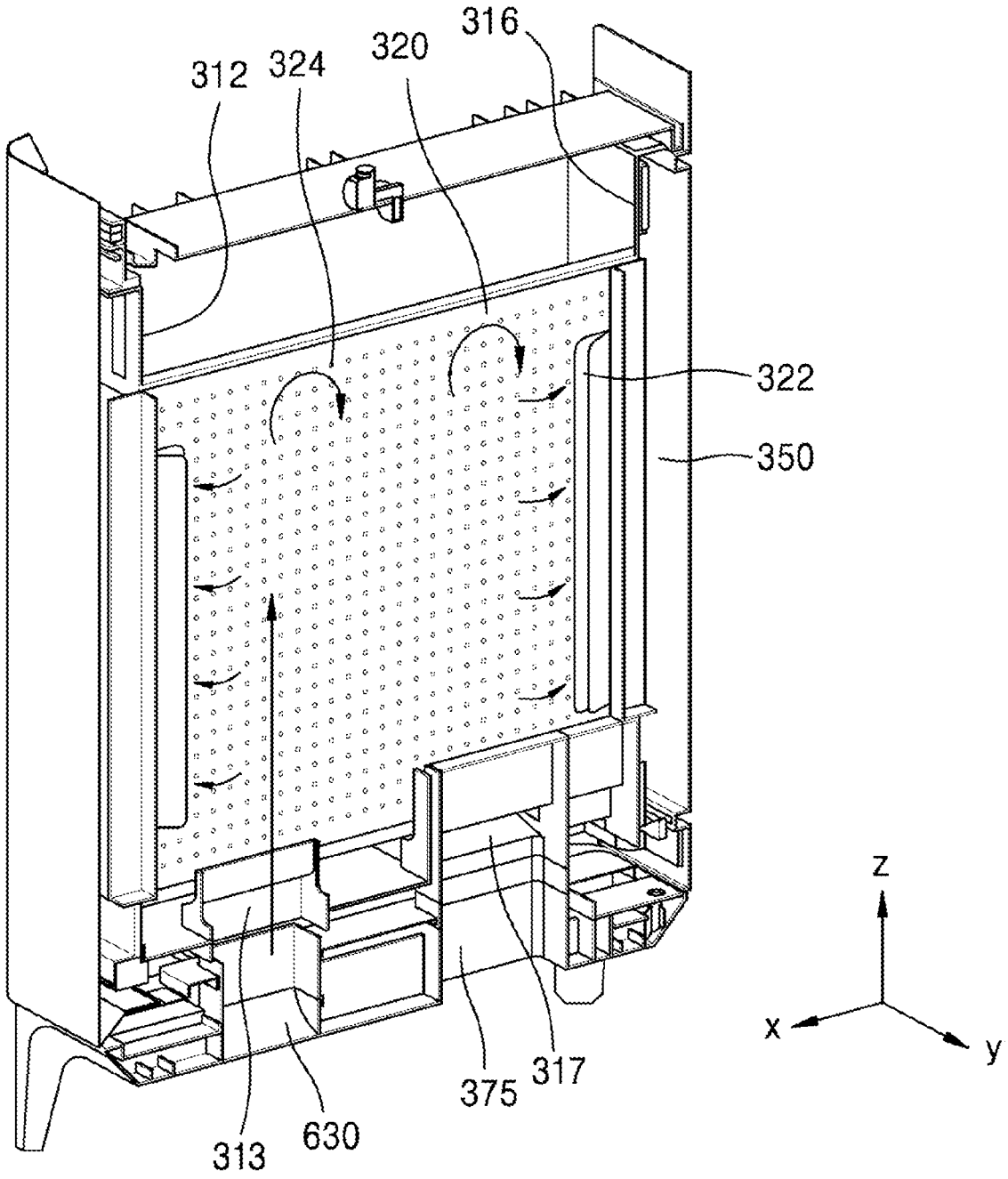

【FIG. 19】
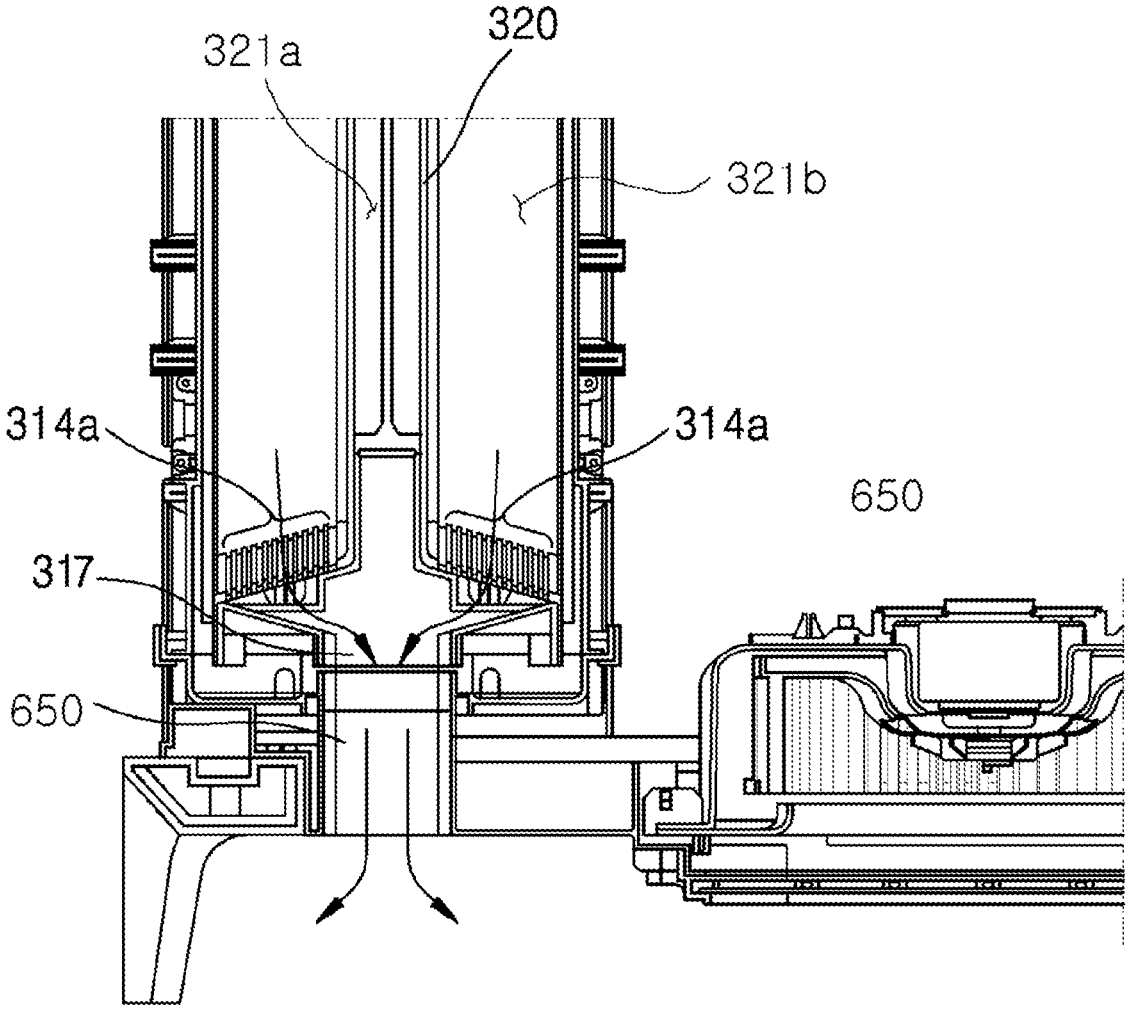

【FIG. 20】
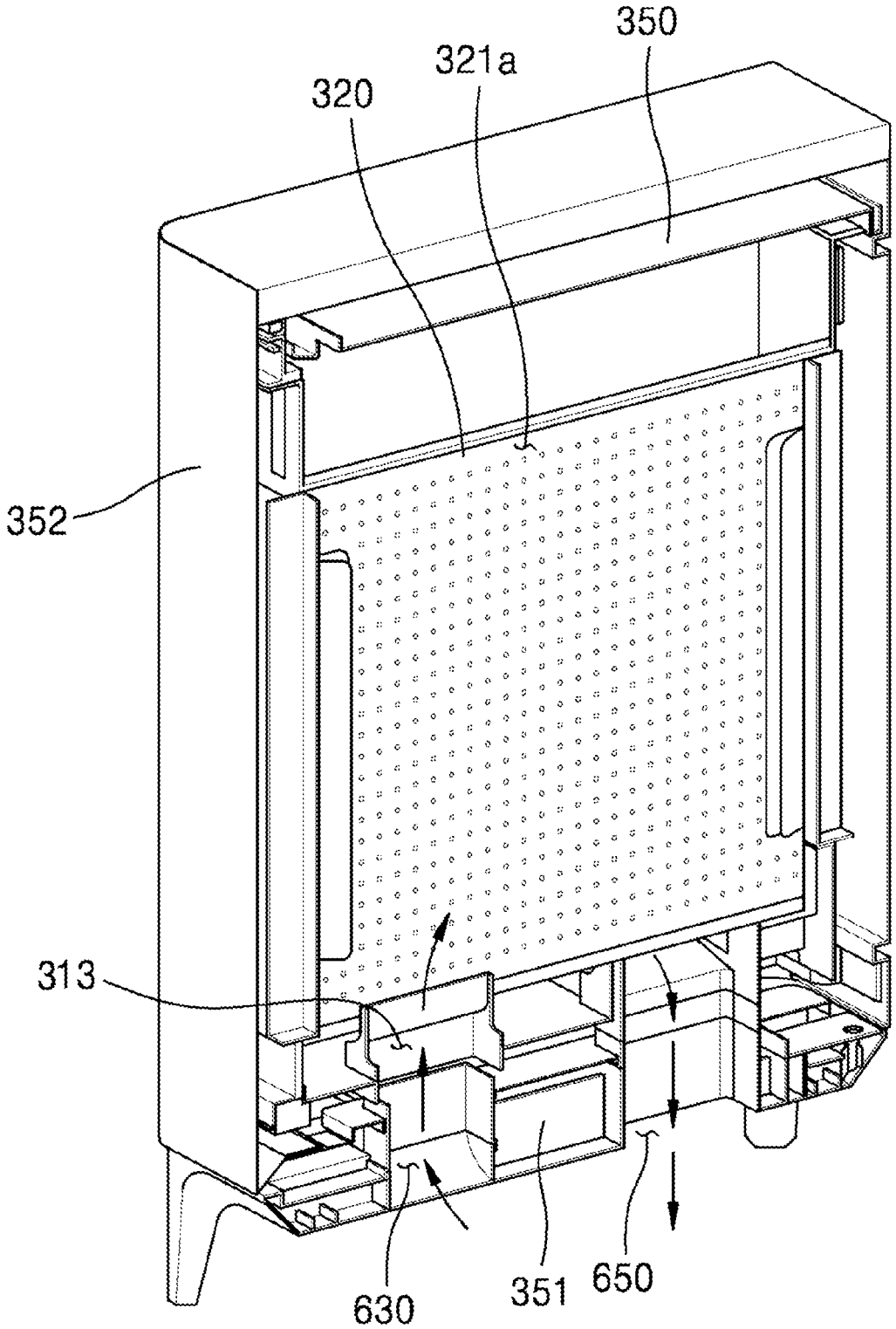

【FIG. 21】
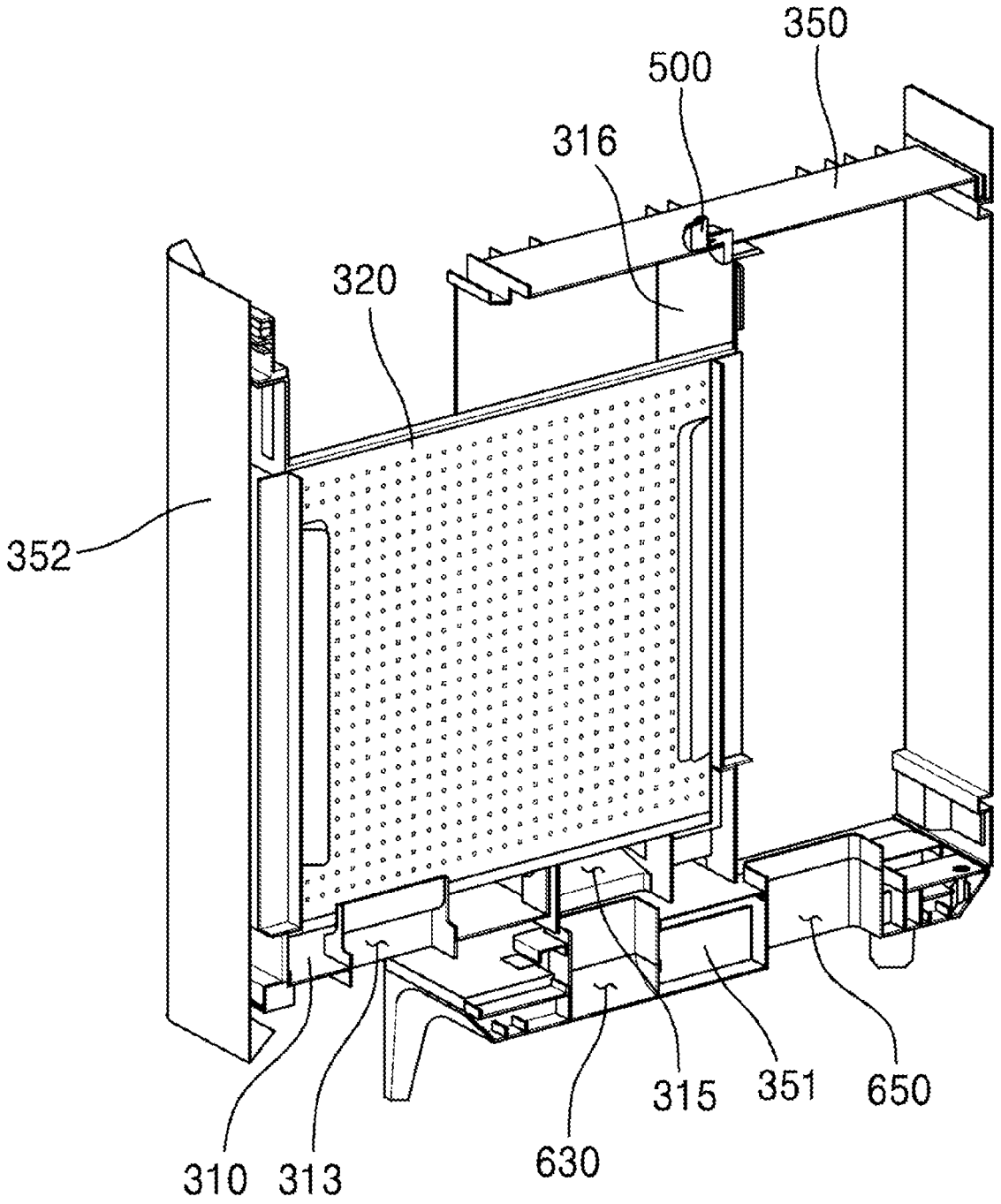

【FIG. 22】
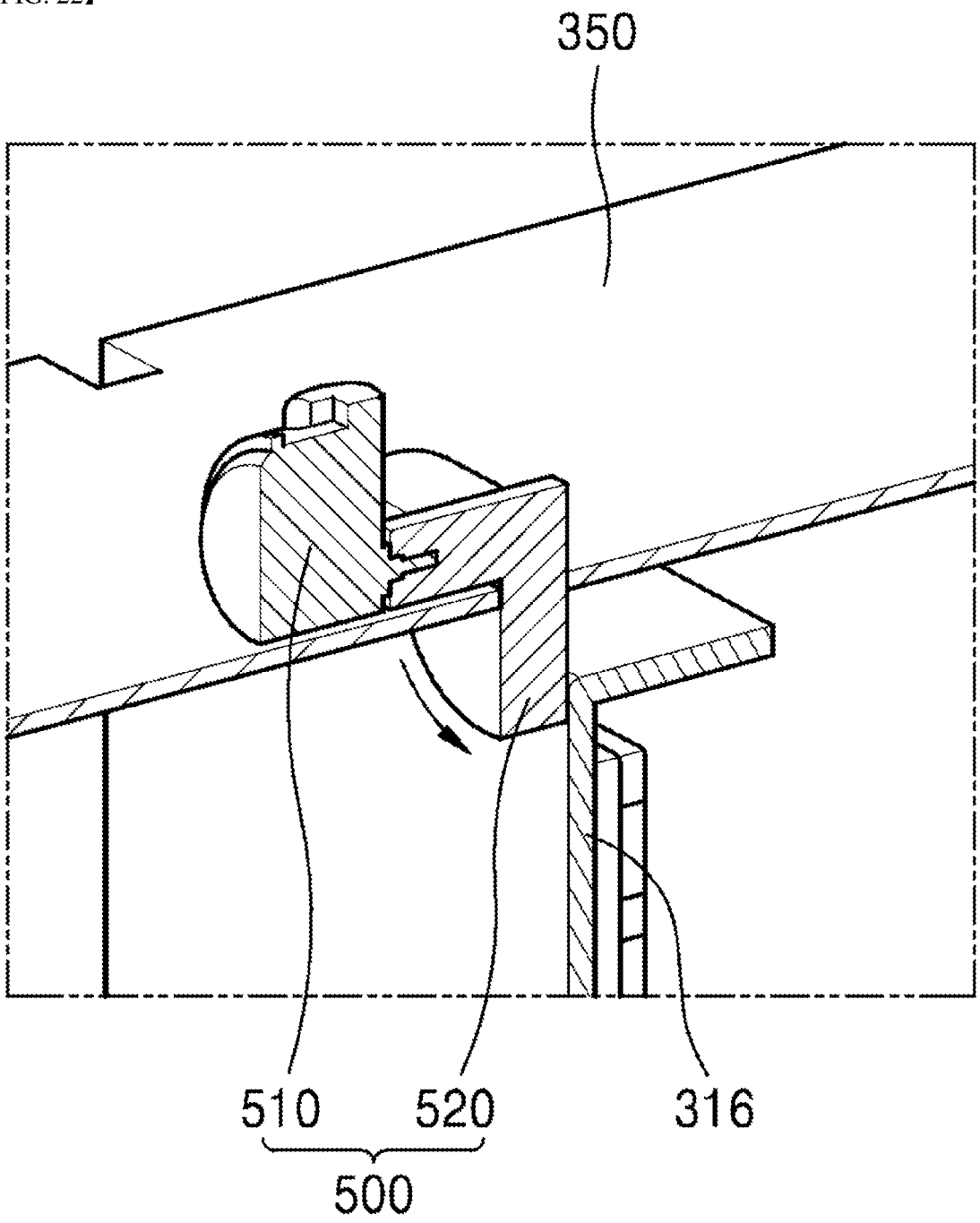

【FIG. 23】
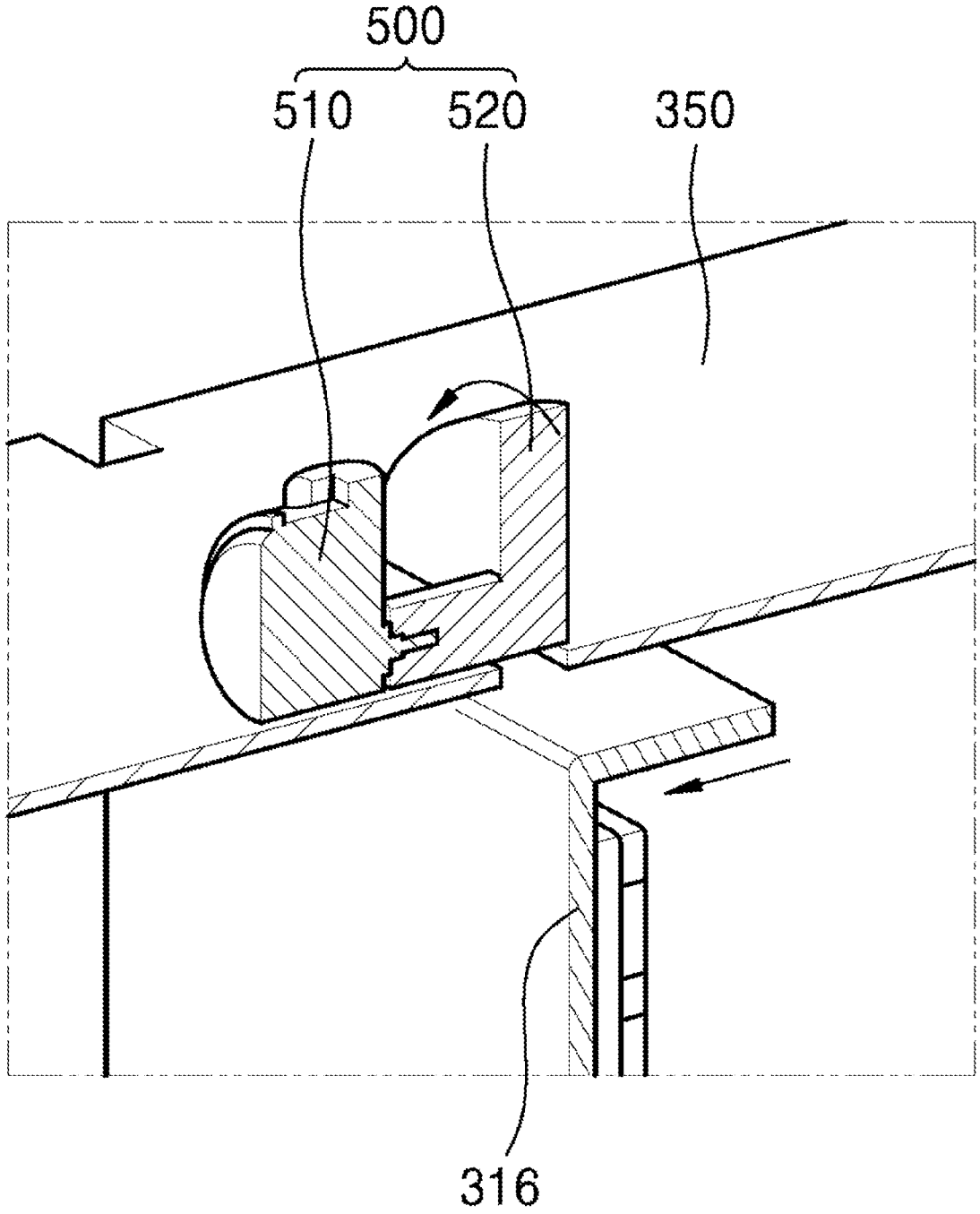

【FIG. 24】
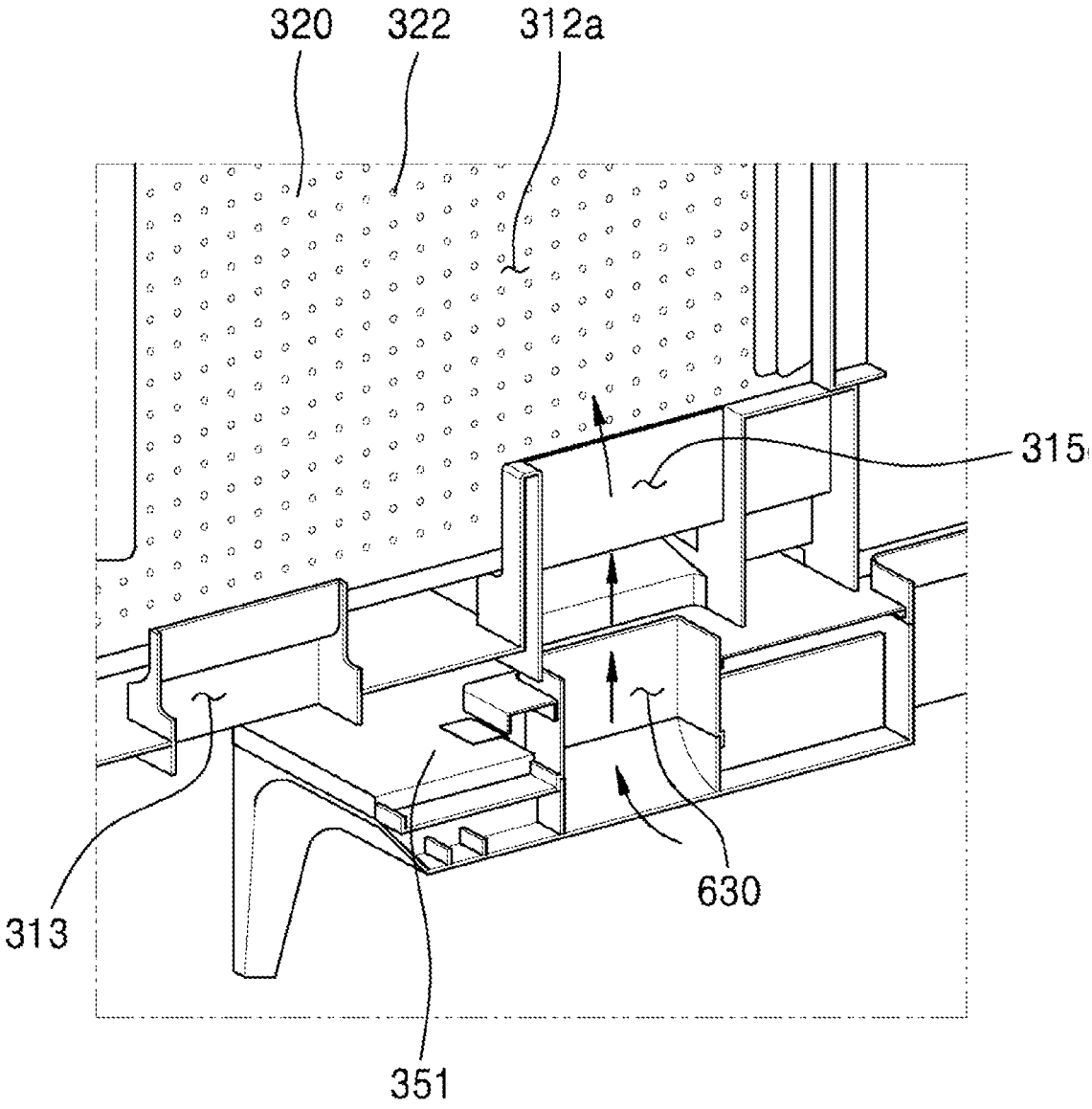

【FIG. 25】
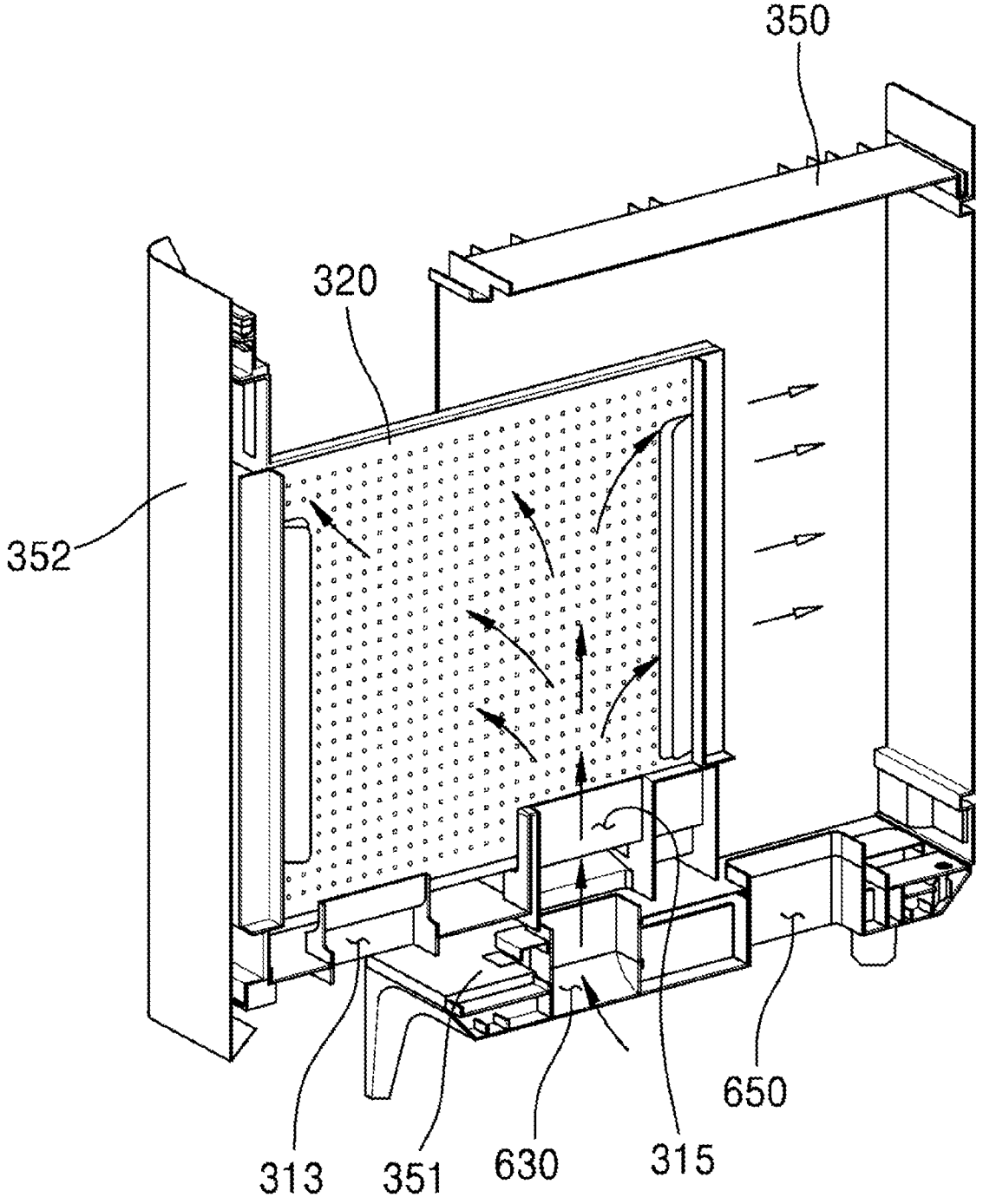

【FIG. 26】
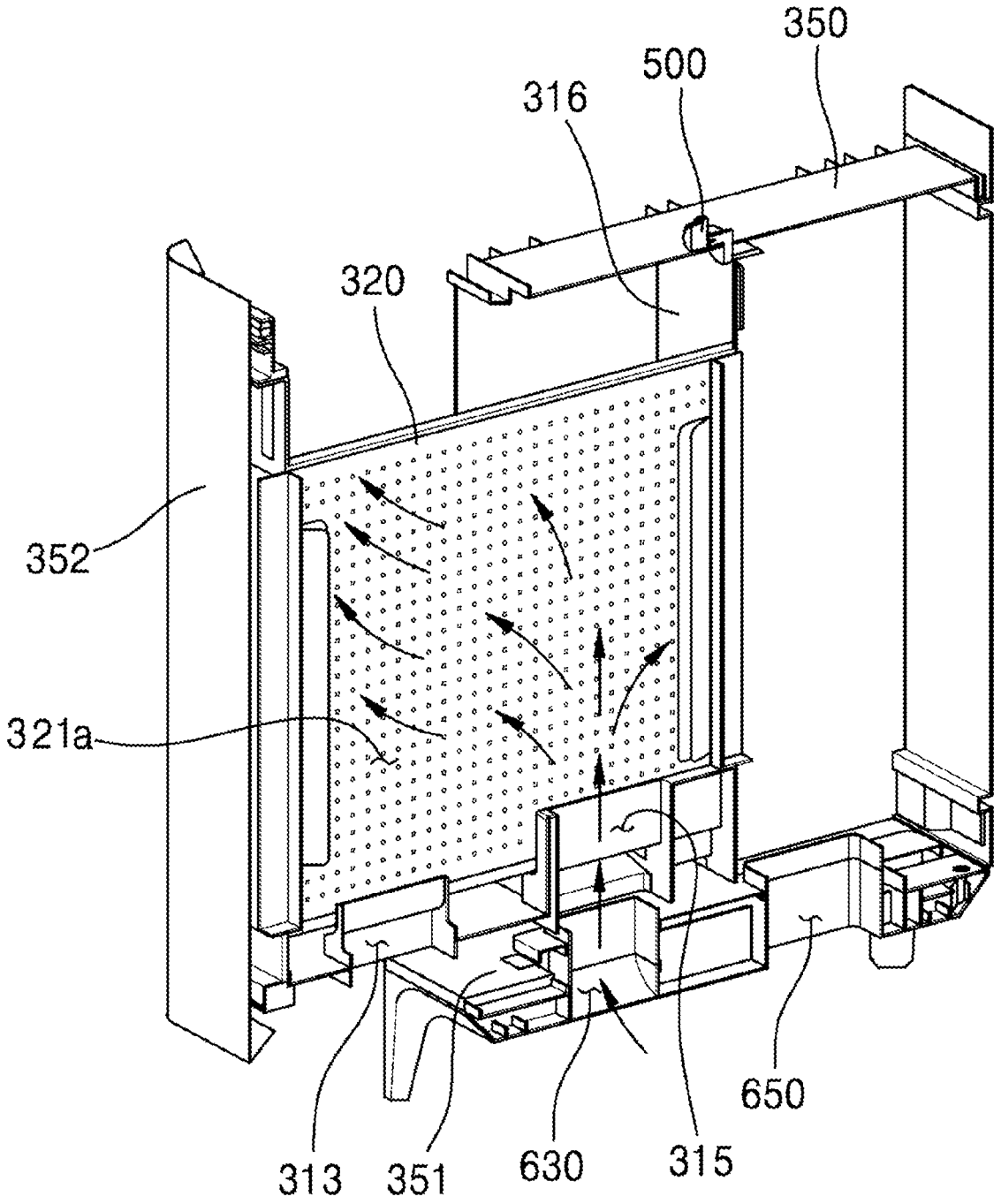

【FIG. 27】
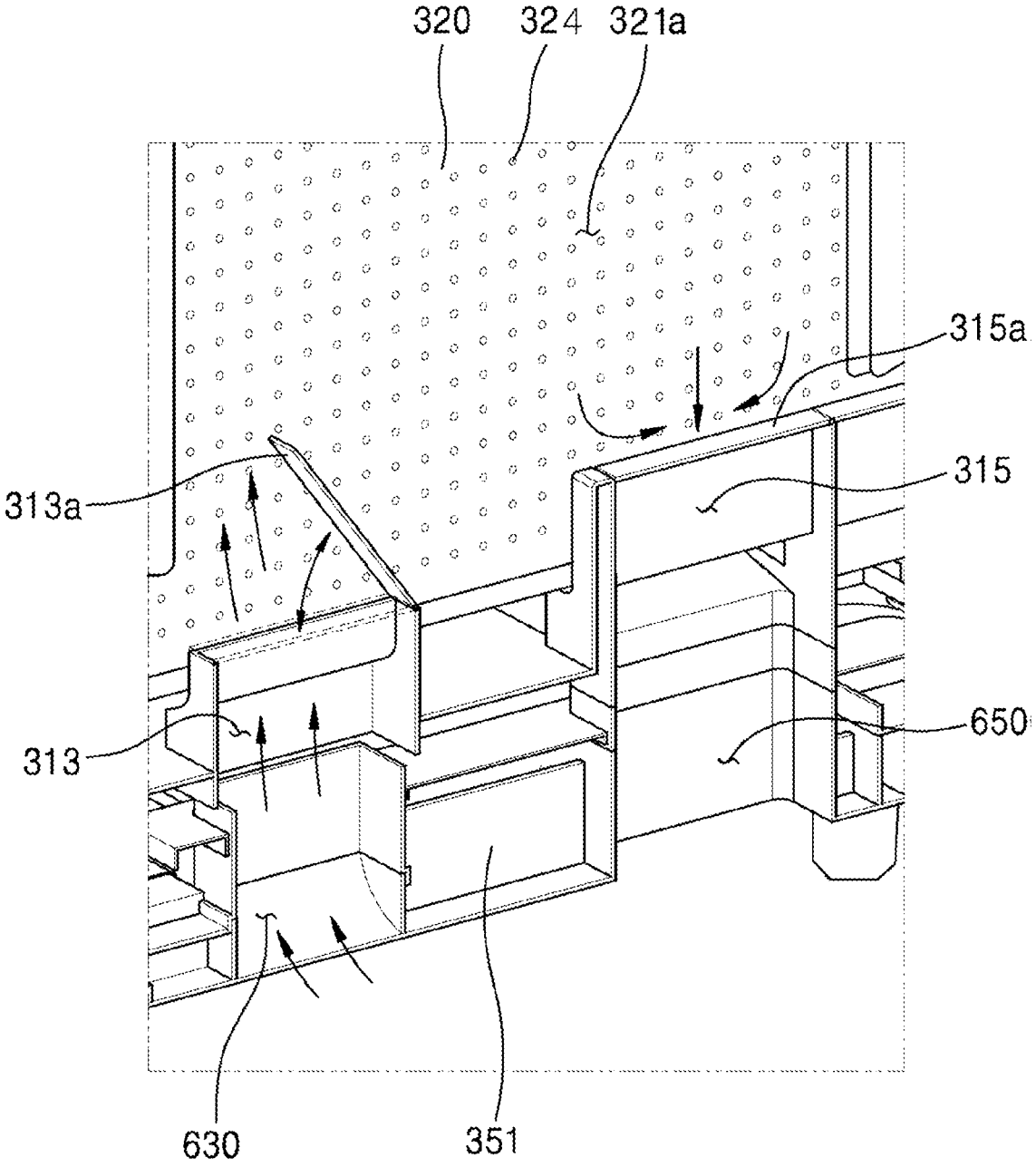

【FIG. 28】
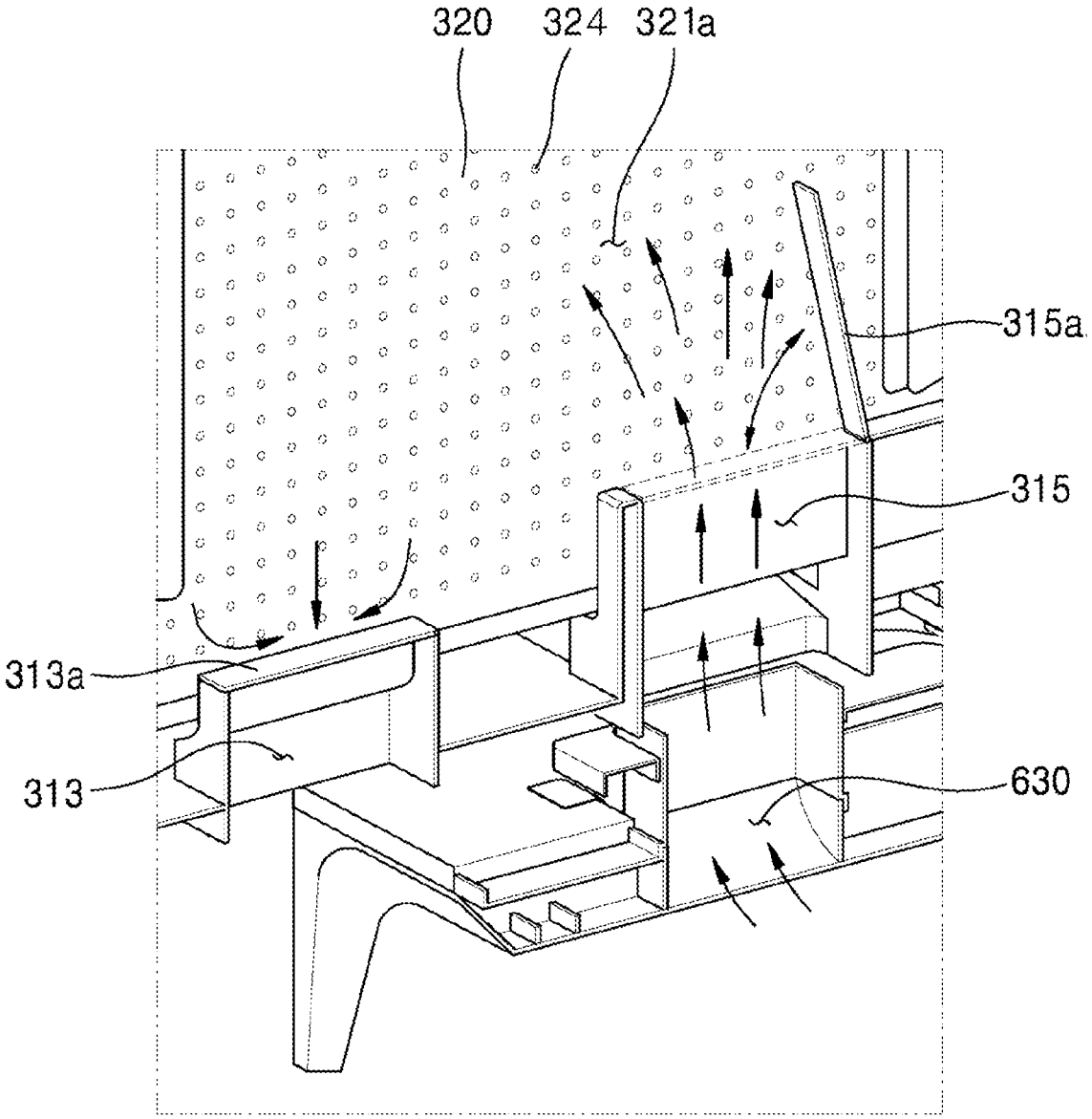

【FIG. 29】
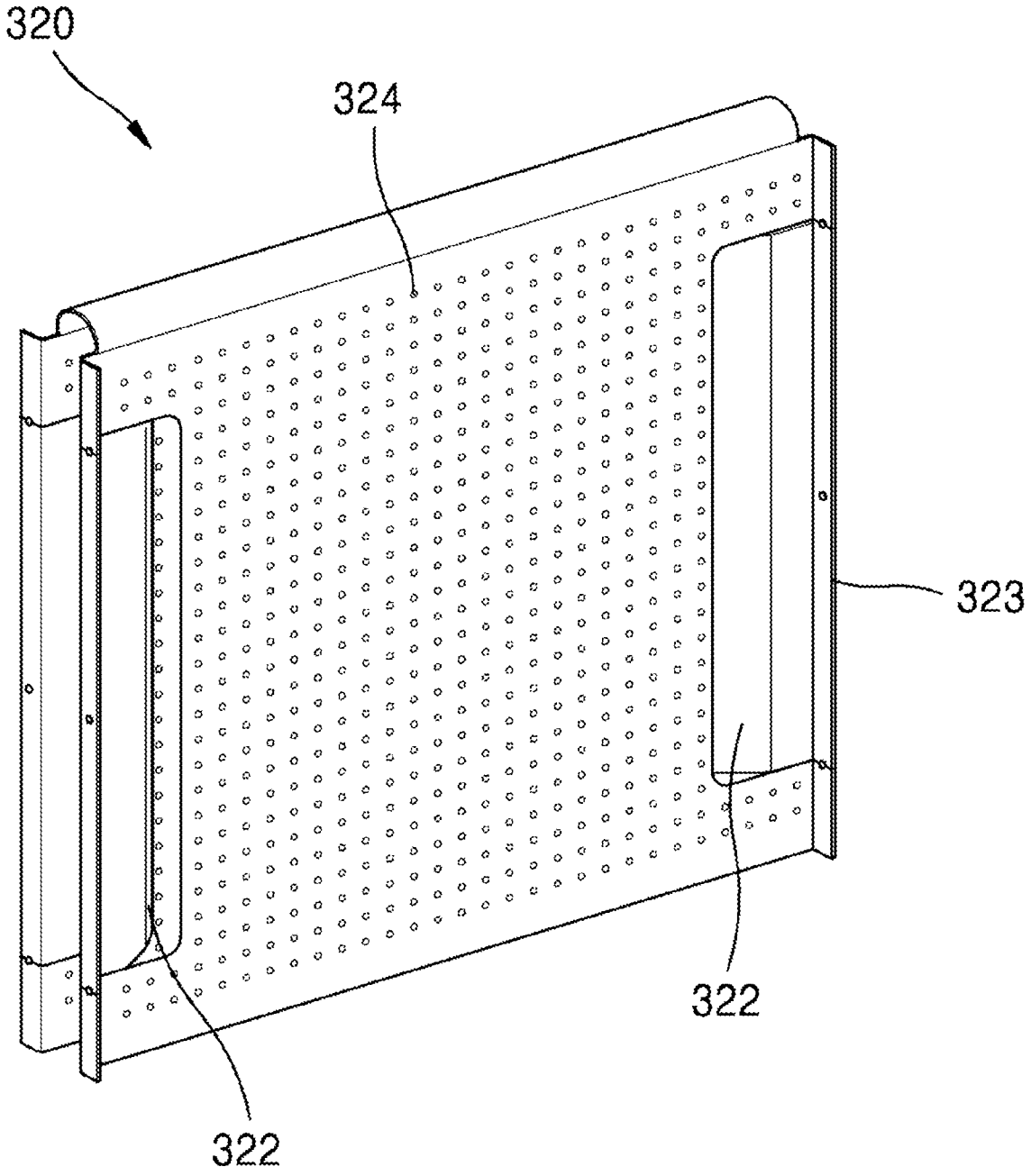

【FIG. 30】
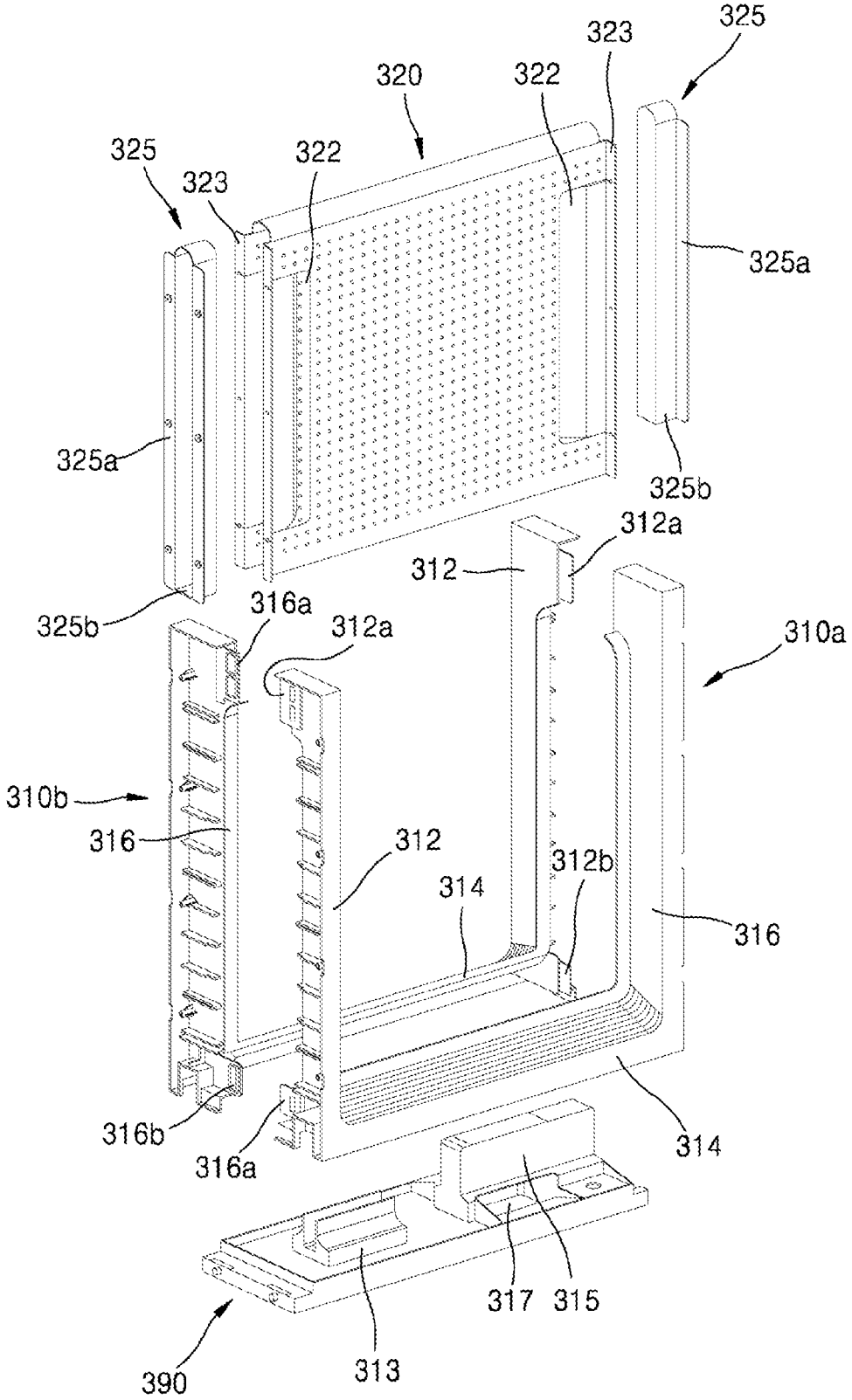

【FIG. 31】
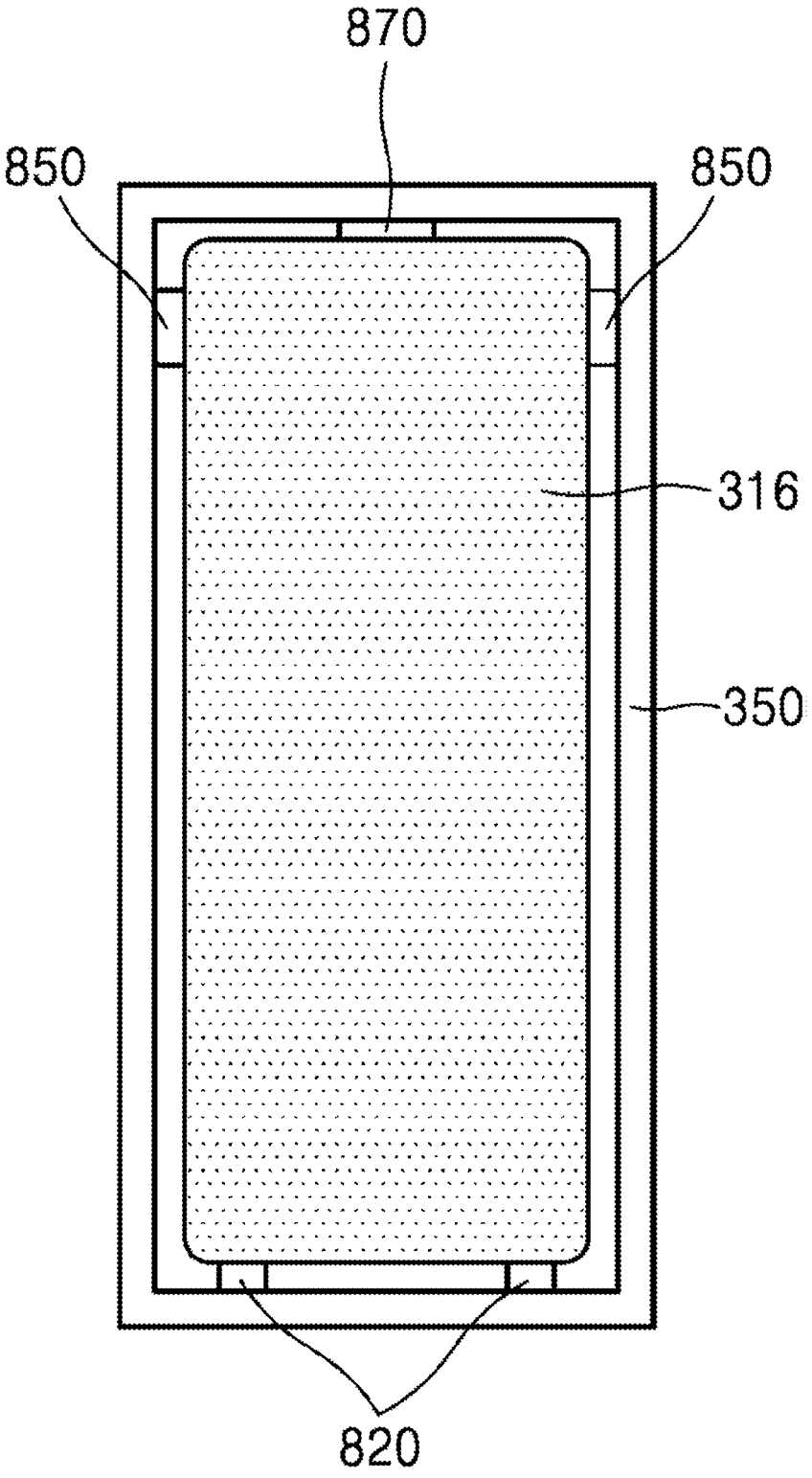

【FIG. 32】
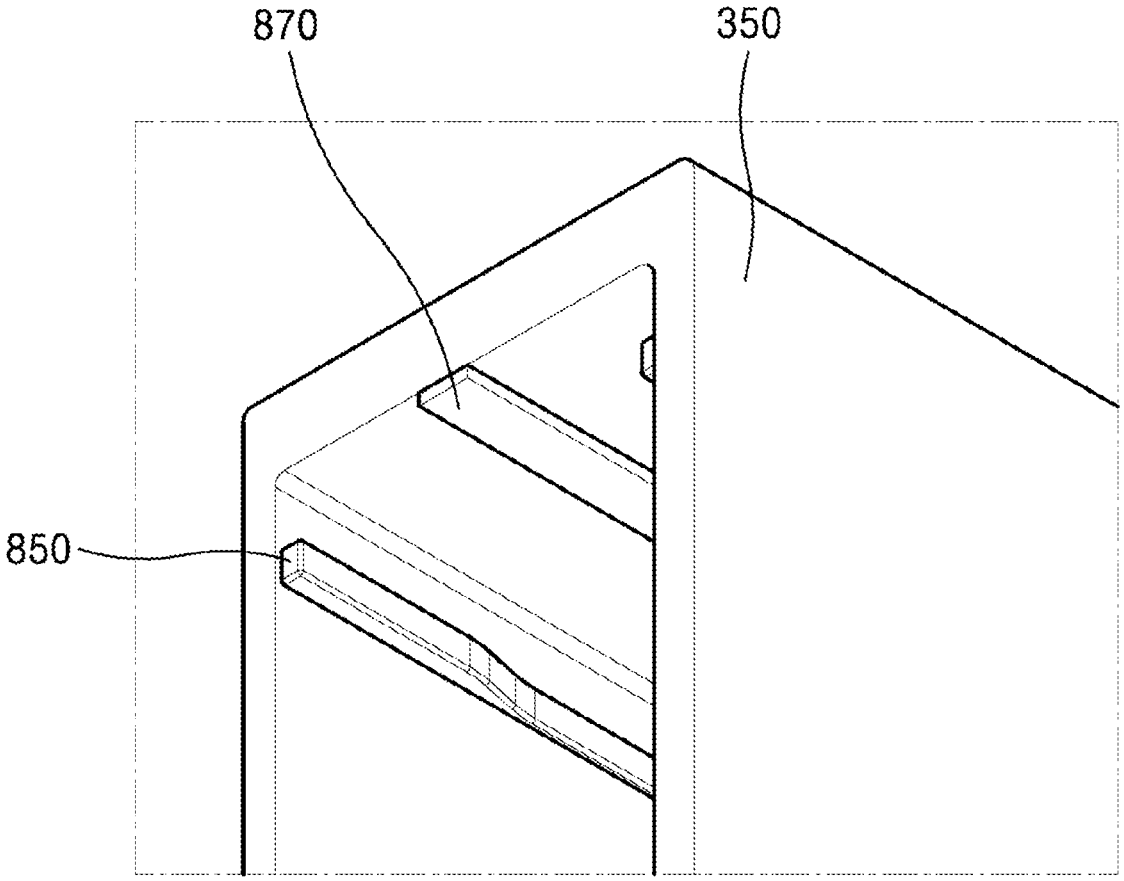

【FIG. 33】
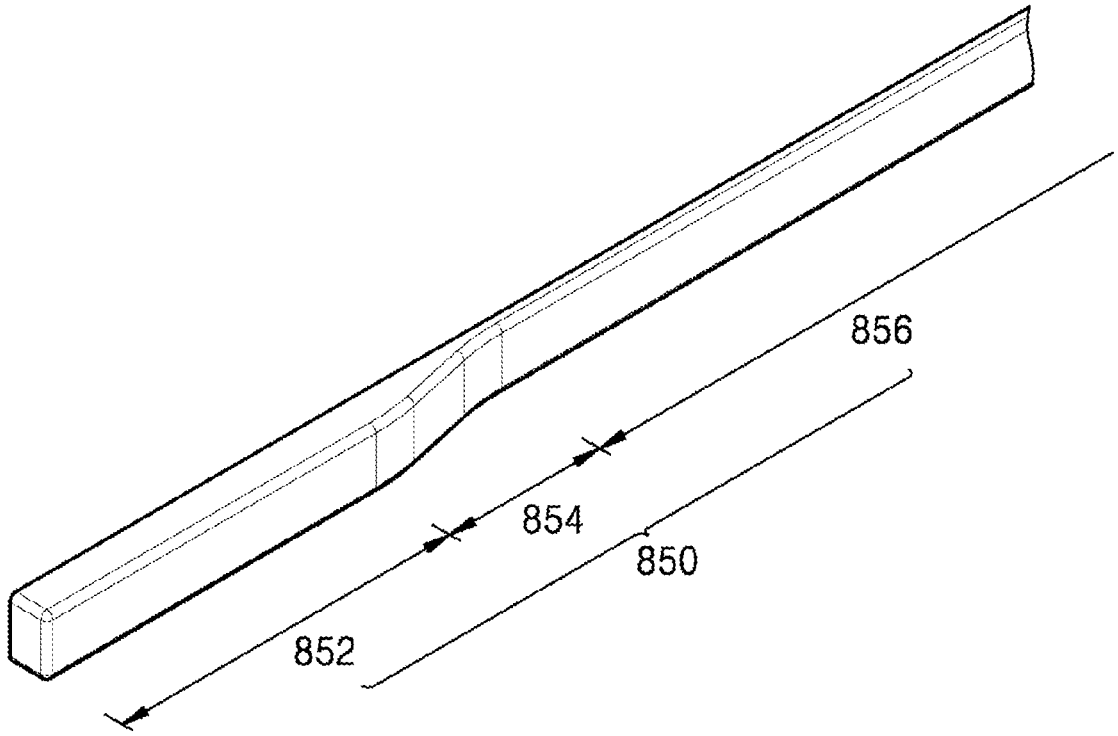

【FIG. 34】
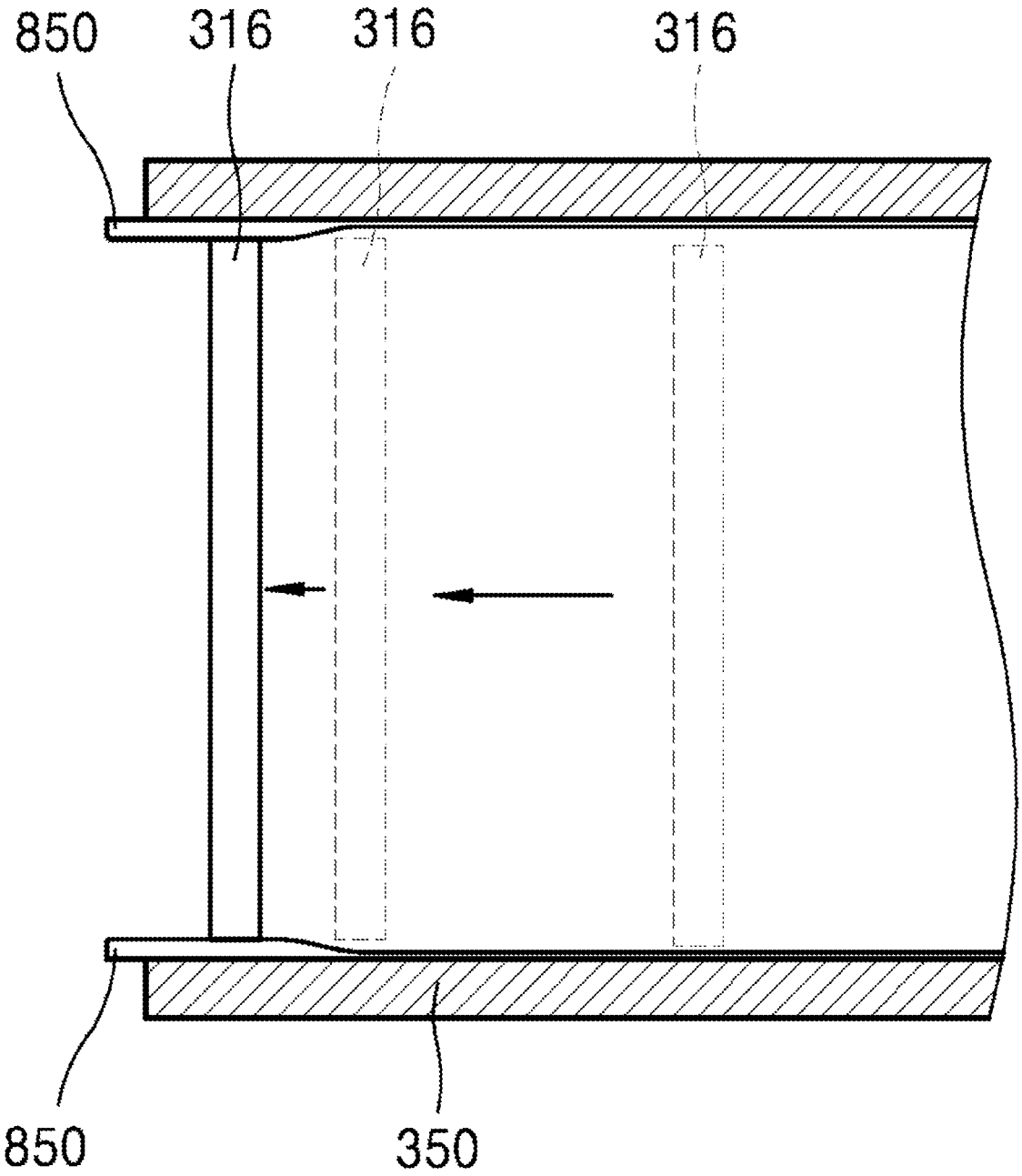

【FIG. 35】
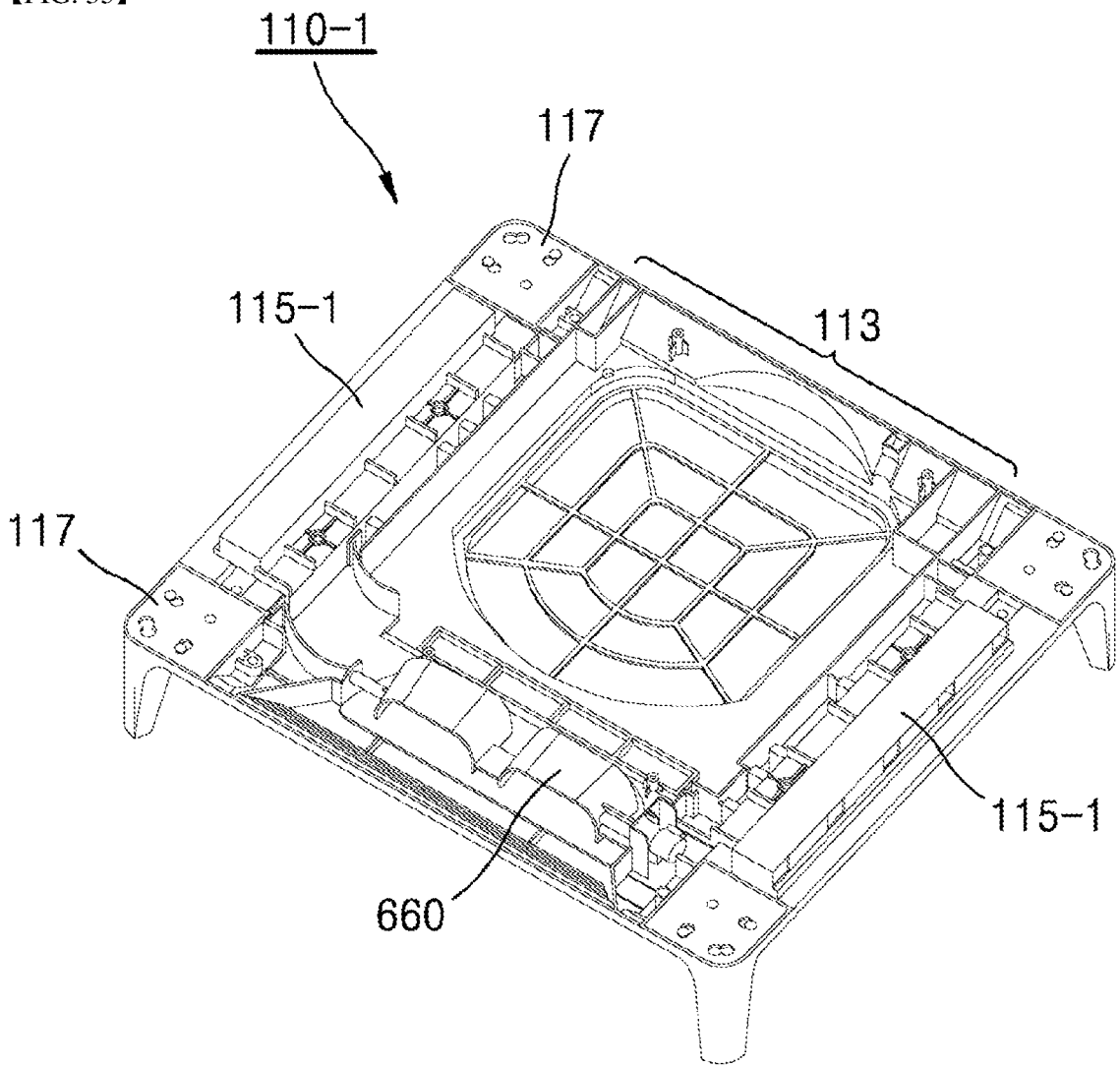

【FIG. 36】
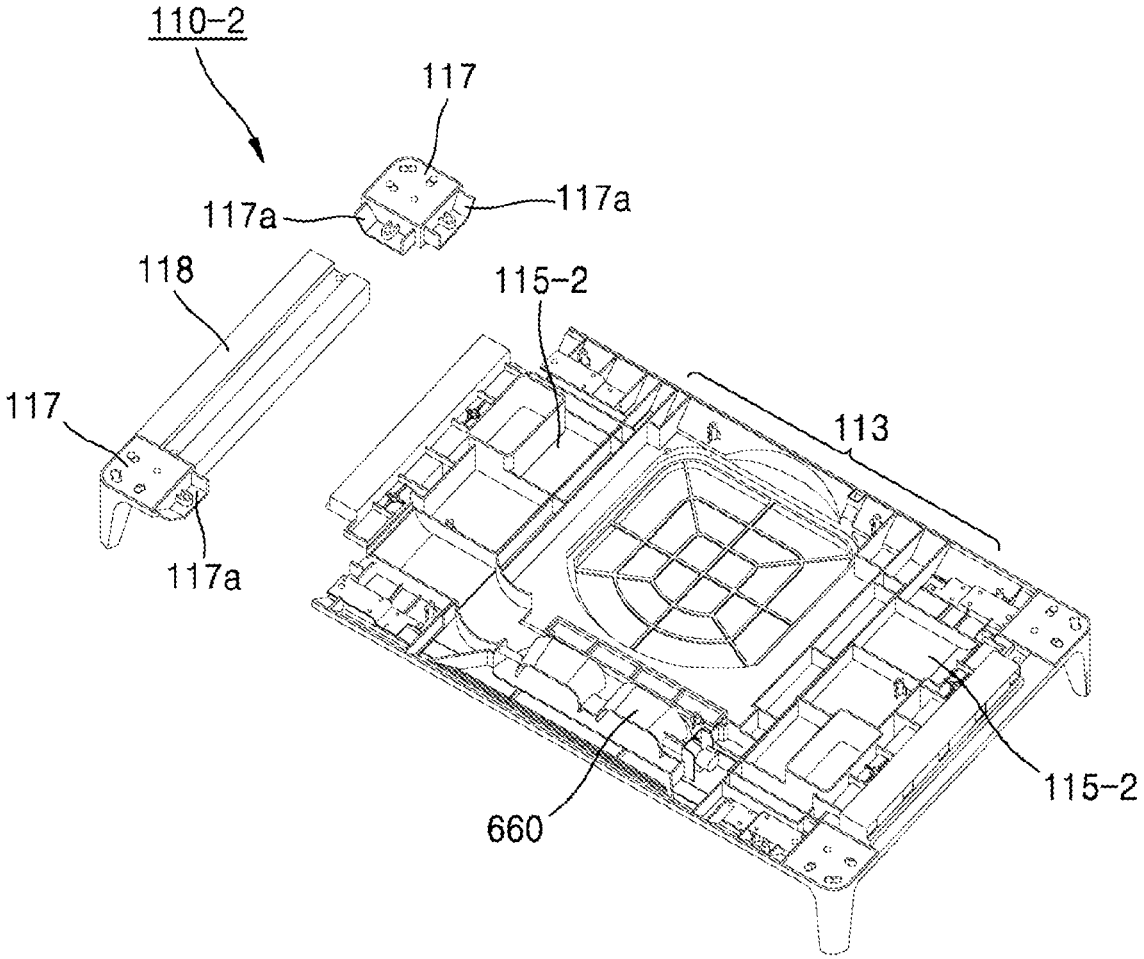

【FIG. 37】
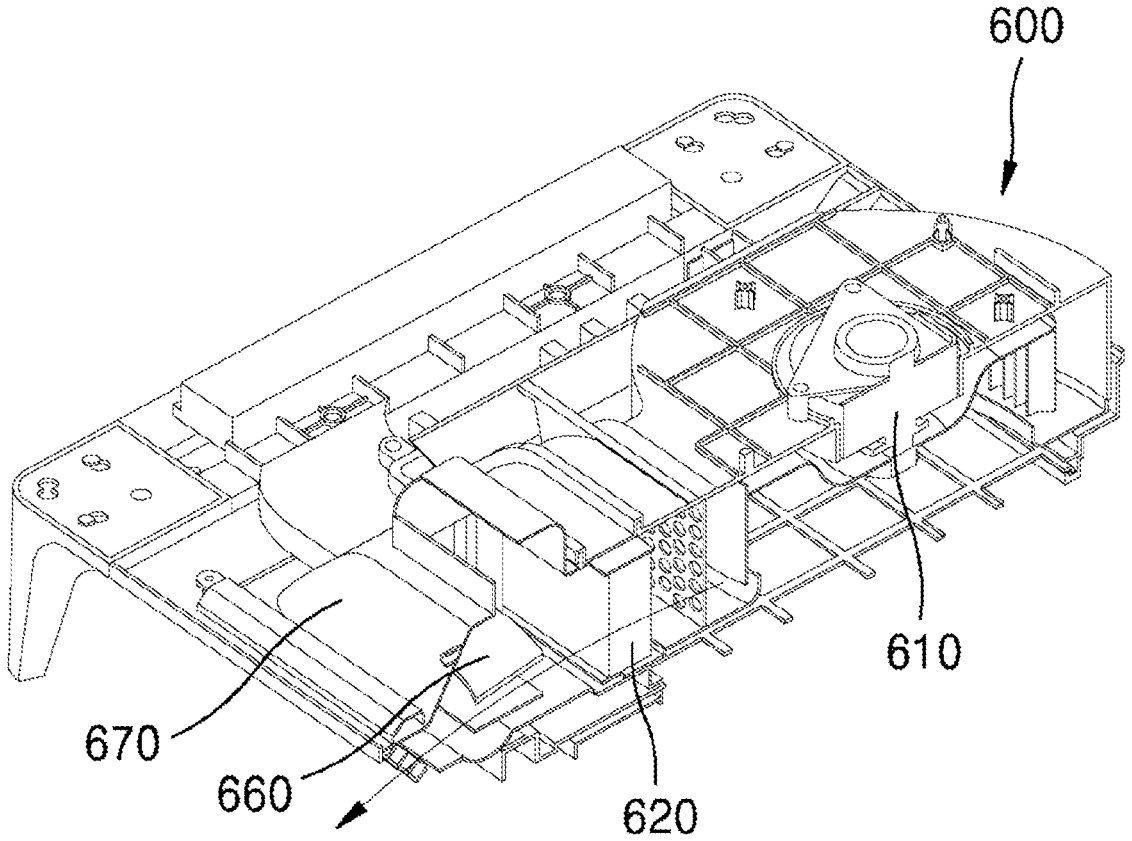

【FIG. 38】
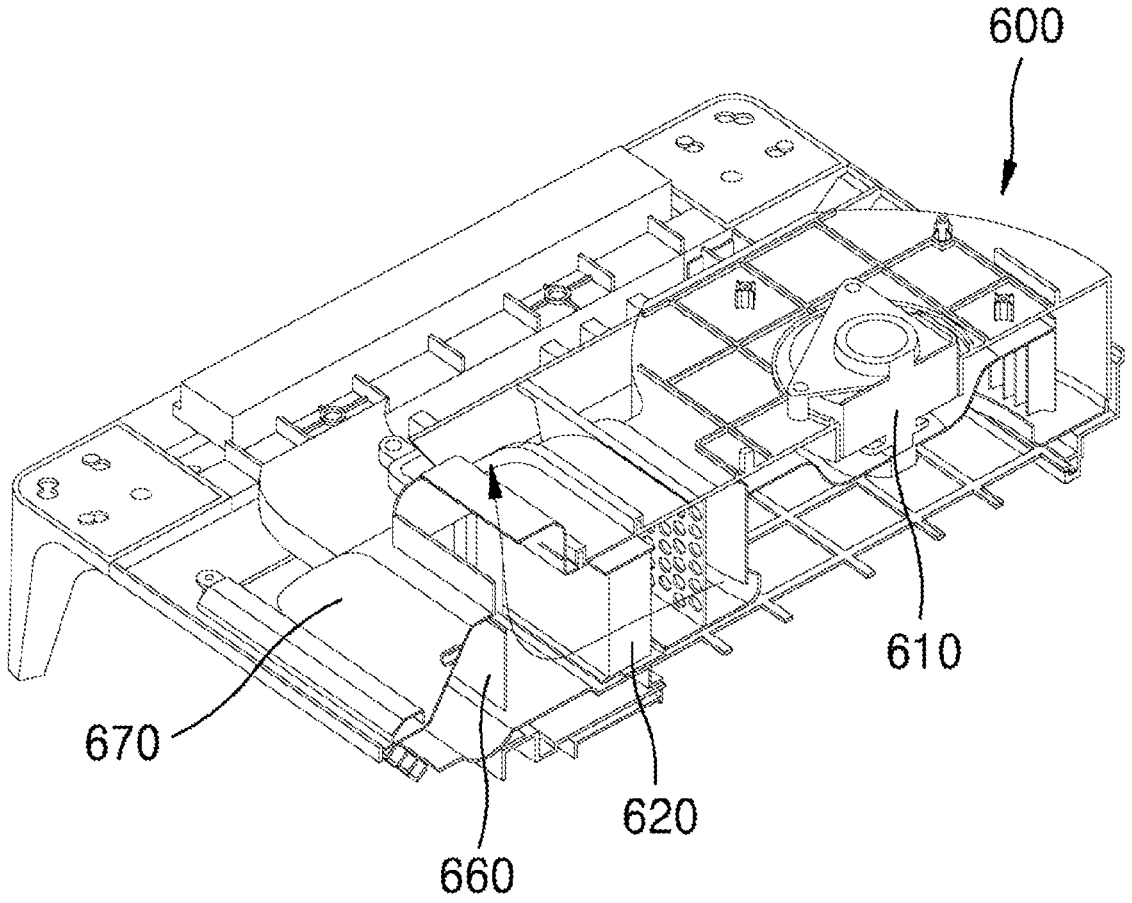

【FIG. 39】
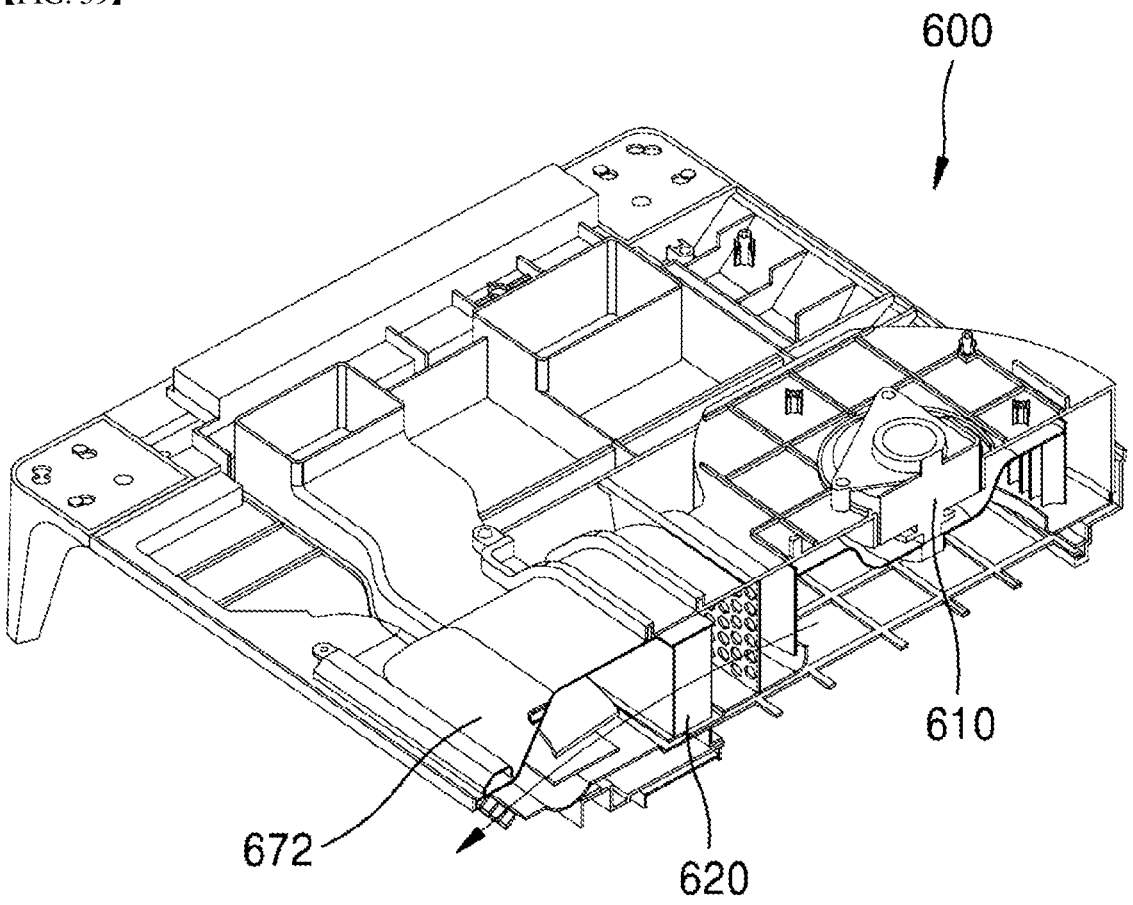

【FIG. 40】
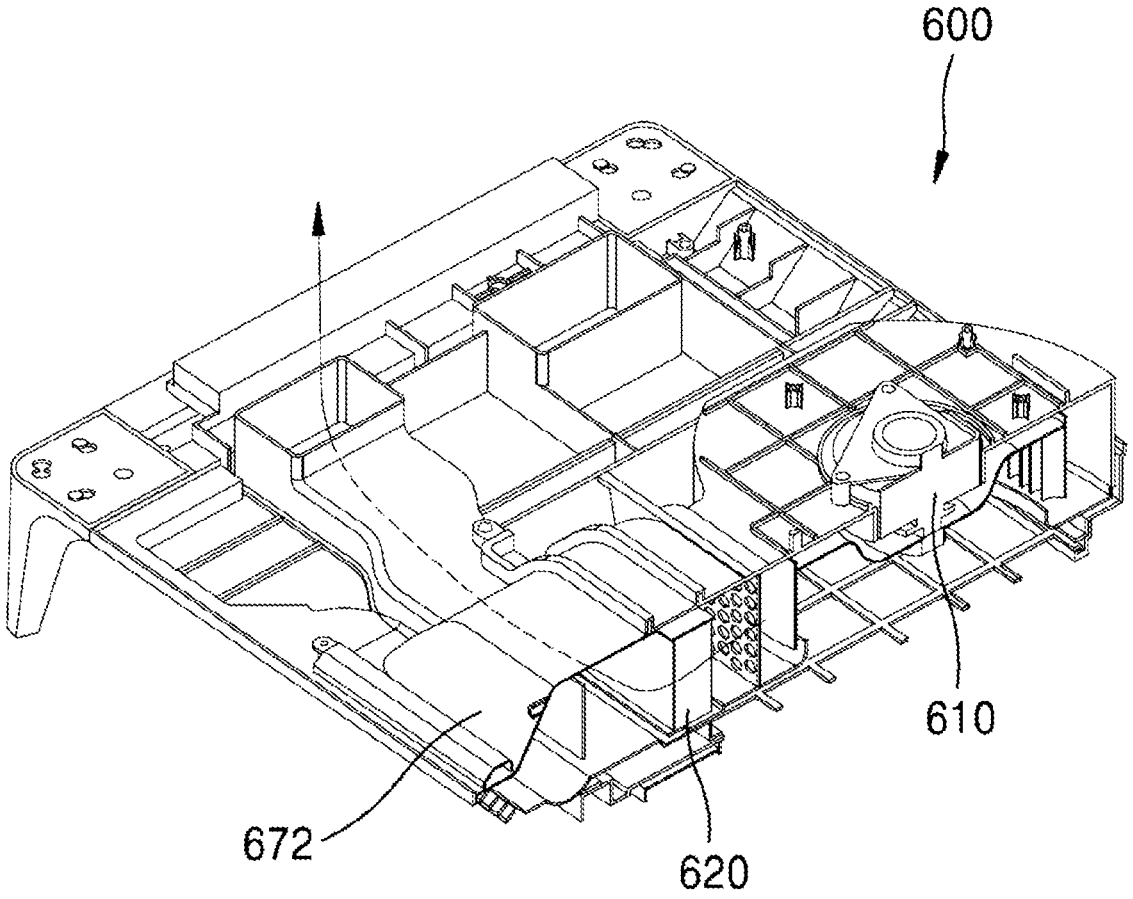

TOWEL MAINTENANCE DEVICE

CROSS-REFERENCE TO RELATED PATENT APPLICATIONS

This application is a U.S. National Stage Application under 35 U.S.C. § 371 of PCT Application No. PCT/KR2018/011459, filed Sep. 27, 2018, which claims priority to Korean Patent Application Nos. 10-2017-0128277, filed Sep. 29, 2017, 10-2017-0144282, filed Oct. 31, 2017, 10-2017-0144967, filed Nov. 1, 2017, 10-2017-0153363, filed Nov. 16, 2017 and 10-2018-0110541, filed Sep. 14, 2018, whose entire disclosures are hereby incorporated by reference.

TECHNICAL FIELD

Disclosed herein is a towel maintenance device that can store and keep a textile product such as a towel or a robe and the like used in a bathroom, supply heat to the textile product stored and kept therein, and warm the textile product stored and kept therein.

BACKGROUND ART

FIG. 1 is a view showing a standing towel warmer of the related art.

The standing towel warmer 40 disclosed in US Patent No. 2013/0153560 includes a heating fiber 22 mounted onto a frame, a cover 36 made of a waterproof material and covering the heating fiber, and a controller 20, as illustrated.

When a towel is held on the cover 36, heat generated by the heating fiber 22 in the cover can be delivered to the towel through the cover 36.

In the structure, an inner surface of the towel, directly contacting a surface of the cover 36, can be sufficiently heated, but sufficient heat cannot be delivered to a surface of the towel, exposed to the outside.

Additionally, since the towel held covers the cover 36, vapor generated during the process of drying the towel cannot be smoothly discharged. Accordingly, drying and heating processes require much time and energy.

DESCRIPTION OF INVENTION

Technical Problem

The present disclosure is directed to a towel maintenance device that may effectively heat a towel stored and kept therein, and may heat and dry the towel stored and kept therein.

The present disclosure is also directed to a towel maintenance device that may heat the space in a bathroom or dry the floor in a bathroom using heated air supplied by the towel maintenance device.

The present disclosure is also directed to a towel maintenance device that may deliver heat for heating a towel based on two heat transfer routes including convection and conduction, and reduce flow loss that happens on an air supply route by allowing heated air to move along a continuous upward flow route.

The present disclosure is also directed to a towel maintenance device that may accommodate a towel stored and kept therein in an isolated space, thereby reducing the effect of humidity in an external environment on the towel stored and kept therein and reducing the possibility of contaminating the towel stored and kept therein by dust.

The present disclosure is also directed to a towel maintenance device that may allow heated air for drying a towel to flow smoothly, thereby enabling vapor generated during a process of drying a towel to be smoothly discharged and reducing time and energy spent on drying a towel.

The present disclosure is also directed to a towel maintenance device that may readily store and keep a towel and have a structure enabling a towel stored and kept to be easily withdrawn.

The present disclosure is also directed to a towel maintenance device that may be provided with a safety device for preventing a user from being injured by heat generated in the towel maintenance device.

The present disclosure is also directed to a towel maintenance device that may rapidly discharge heat generated in the towel maintenance device, such that a user experiences no inconvenience and suffers no injury by a heat transfer plate heated of the towel maintenance device.

The present disclosure is also directed to a drawer-type towel maintenance device that may be built into bathroom furniture, thereby ensuring efficient space utilization of a bathroom.

The present disclosure is also directed to a drawer-type towel maintenance device built into bathroom furniture, in which a sliding body is manufactured as a result of assembly of separate components, thereby enabling components of the sliding body to be commonly used and reducing manufacturing costs of the towel maintenance device.

The present disclosure is also directed to a structure in which a sliding body of a drawer-type built-in towel maintenance device may be stably put into and withdrawn in a sliding manner, and in a state in which the sliding body is completely withdrawn, movement of the sliding body may be reduced.

Technical Solution

The towel maintenance device according to the present disclosure may store and keep an object to be dried such as a towel and the like, and may heat and dry the object to be dried stored and kept therein, in which heated air is supplied to a first staying space disposed in the heat transfer plate and heats the heat transfer plate, thereby allowing the object to be dried held on the heat transfer plate to be heated as a result of thermal conduction from the heat transfer plate and in which heat is supplied to the object to be dried based on convection of air while air discharged from the first staying space of the heat transfer plate stays in a second staying space formed in a cover body and flows around the object to be dried held.

In the towel maintenance device according to the present disclosure, a sliding body to which the heat transfer plate is mounted may be withdrawn like a drawer, thereby improving ease of use and ensuring efficient space utilization.

The towel maintenance device according to the present disclosure may be provided with a safety device that stops the heat transfer plate from being withdrawn in a state in which the heat transfer plate is heated to a predetermined safety temperature or greater, thereby reducing the risk that might be caused when a user directly contacts the heat transfer plate heated.

In the towel maintenance device according to the present disclosure, cool air may be rapidly introduced into the heat transfer plate in a state in which the heat transfer plate is stopped from being withdrawn, thereby allowing a user to quickly withdraw an object to be dried stored and to use the object to be dried.

Advantageous Effect

In the towel maintenance device according to the present disclosure, heated air may be delivered to a towel through the heat transfer plate, and heat may be transferred to the towel based on thermal conduction at a portion contacting the heat transfer plate and based on convection of air discharged from the heat transfer plate, thereby rapidly heating and drying the towel.

In the towel maintenance device according to the present disclosure, heated air may be supplied to an inside or an outside of the towel maintenance device, thereby heating air in a bathroom or drying the floor of a bathroom using the heated air.

In the towel maintenance device according to the present disclosure, the heat transfer plate may be disposed at a position higher than a position of an air blower, such that air supplied through the air blower is supplied to the heat transfer plate while the air continues to flow upward.

In the structure, air may be supplied into the heat transfer plate based on an upward air current that is naturally generated by heated air, thereby reducing flow loss and improving energy efficiency.

The towel maintenance device according to the present disclosure may further include a cover body that accommodates a towel held on the heat transfer plate and provides a second staying space allowing heated air, discharged from the heat transfer plate, to stay around the accommodated towel, thereby reducing an effect of vapor in a bathroom on the towel stored and kept. Additionally, since the towel is stored in the cover body, the towel may be protected from contaminants such as dust and the like.

In the towel maintenance device according to the present disclosure, the cover body may be provided with an opening-closing door and a sight glass, thereby readily confirming whether a towel is stored in the cover body and easily placing and withdrawing a towel as a result of opening of the opening-closing door.

In the towel maintenance device according to the present disclosure, the heat transfer plate on which a towel is held may be withdrawn from a base body in a sliding manner, thereby readily placing and withdrawing the towel.

In the towel maintenance device according to the present disclosure, a safety device may be provided to stop the heat transfer plate from being withdrawn when a temperature of the heat transfer plate is a predetermined temperature or greater, thereby reducing a user's unpleasant feeling or injury that might be caused by when the user's skin contacts the heat transfer plate heated, and preventing the user's injury.

In the towel maintenance device according to the present disclosure, a safety device may be provided to stop the heat transfer plate from being withdrawn under predetermined conditions, thereby preventing an accident that might occur when a user's body contacts the heat transfer plate.

In the towel maintenance device according to the present disclosure, the safety device may operate to rapidly discharge heated air and rapidly cool the heat transfer plate in a state in which the heat transfer plate is stopped from being withdrawn, thereby reducing a user's injury or inconvenience further.

In the towel maintenance device according to the present disclosure, room-temperature air that is not heated may be supplied into the staying space in the heat transfer plate using the air blower when a temperature of the heat transfer plate is a predetermined temperature or greater, thereby enabling a user to withdraw a towel rapidly and safely and to use the towel.

In the towel maintenance device according to the present disclosure, components of an upper body constituting the sliding body may be commonly used, thereby reducing manufacturing costs of the towel maintenance device.

The towel maintenance device according to the present disclosure may be built into bathroom furniture like a drawer, thereby improving ease of use and efficient space utilization in a bathroom.

In the towel maintenance device according to the present disclosure, movement of the sliding body and the heat transfer plate may be reduced in a state in which the sliding body is completely withdrawn, thereby enhancing product reliability and user convenience.

BRIEF DESCRIPTION OF DRAWING

FIG. 1 is a view showing a structure of a standing towel maintenance device of the related art separated into parts.

FIG. 2 is a view showing a structure of a towel maintenance device according to a first embodiment.

FIG. 3 is a cross-sectional view showing the structure of the towel maintenance device according to the first embodiment.

FIG. 4 is a perspective view showing a structure of a towel maintenance device according to a second embodiment.

FIG. 5 is a cross-sectional view showing the structure of the towel maintenance device according to the second embodiment.

FIGS. 6 and 7 are views showing a structure of a towel maintenance device according to a third embodiment.

FIGS. 8 and 9 are views showing a structure of a towel maintenance device according to a fourth embodiment.

FIGS. 10 and 11 are views showing a structure of a towel maintenance device according to a fifth embodiment.

FIG. 12 is a perspective view showing an exterior of bathroom furniture provided with a towel maintenance device according to a sixth embodiment.

FIG. 13 is a perspective view showing an exterior of a drawer-type towel maintenance device according to the sixth embodiment, withdrawn from bathroom furniture.

FIG. 14 is a view showing a state in which the towel maintenance device according to the sixth embodiment is separated from bathroom furniture.

FIG. 15 is a lengthwise cross-sectional view showing a structure in the towel maintenance device according to the sixth embodiment.

FIG. 16 is a left-right cross-sectional view showing the structure in the towel maintenance device according to the sixth embodiment.

FIG. 17 is a view for describing a flow of hot air of the drawer-type towel maintenance device according to the sixth embodiment into a heat transfer plate.

FIG. 18 is a view for describing a flow of air in a heat transfer plate of the drawer-type towel maintenance device according to the sixth embodiment.

FIG. 19 is a view for describing a flow of air through an exhaust port of the drawer-type towel maintenance device according to the sixth embodiment.

FIG. 20 is a view for describing an inflow route and a discharge route of air of the towel maintenance device according to the sixth embodiment.

FIG. 21 is a view showing a state in which the drawer-type towel maintenance device according to the sixth embodiment is stopped from being withdrawn by a stopping device.

FIG. 22 is a view showing a state in which the stopping device, configured to stop the heat transfer plate of the drawer-type towel maintenance device according to the sixth embodiment from being withdrawn, is operated.

FIG. 23 is a view showing a state in which the heat transfer plate can be withdrawn after the stopping device of the drawer-type towel maintenance device according to the sixth embodiment stops operating.

FIG. 24 is a view showing a state in which air is introduced into a cool air inlet of the drawer-type towel maintenance device according to the sixth embodiment.

FIG. 25 is a view showing a flow of air in the drawer-type towel maintenance device according to the sixth embodiment without a back blocking plate.

FIG. 26 is a view showing a flow of air in the drawer-type towel maintenance device according to the sixth embodiment with a back blocking plate.

FIGS. 27 and 28 are views for describing opening-closing dampers of the inlet and cool air inlet of the drawer-type towel maintenance device according to the sixth embodiment.

FIG. 29 is a perspective view showing the heat transfer plate of the towel maintenance device according to the sixth embodiment.

FIG. 30 is a perspective exploded view showing a sliding body and the heat transfer plate in the towel maintenance device according to the sixth embodiment.

FIGS. 31 and 32 are views showing a back blocking plate and a friction guide for guiding a sliding body of a towel maintenance device according to the present disclosure.

FIG. 33 is a perspective view for describing a structure of a movement prevention guide according to an embodiment.

FIG. 34 is a view for describing an operation of a movement prevention guide according to an embodiment.

FIGS. 35 and 36 are views showing a structure of a base body applied to a towel maintenance device according to the present disclosure.

FIGS. 37 and 38 are views showing a base body and a hot air supplier of a towel maintenance device according to a seventh embodiment.

FIGS. 39 and 40 are views showing a base body and a hot air supplier of a towel maintenance device according to an eighth embodiment.

DESCRIPTION OF SYMBOL

10: Bathroom furniture 11: Bathroom furniture body
12: Washbasin 13: Washbasin body
14: Faucet 15: Pop-up valve
18: Drawer-type console 20: Controller
50: Towel (Object to be dried)
100-1, 100-2, 100-3, 100-4: Towel maintenance device
110: Base body 112, 114: Suction port
114: Suction port 120: Heat transfer plate
122: Communicating hole 125: Staying space
130: Air blower 132: Air blowing fan
134: Driving motor 136: Path case
141, 142: Heater 150: Cover body
152: Outlet 154, 157: Opening-closing door
156: Sight glass 158: Second staying space
200: Towel maintenance device 210: Base body
220: Sliding body 230: Heat transfer plate
250: Cover body 252: Fixed body
254: Opening-closing door 258: Second staying space
300: Towel maintenance device 310: Sliding body
310*a*, 310*b*: Upper body 312: Outer plate
312*a*, 312*b*: Coupling projection
313: Inlet 313*a*: First opening-closing damper
314: Bottom plate 314*a*: Exhaust port
315: Cool air inlet 315*a*: Second opening-closing damper
316: Back blocking plate 316*a*, 316*b*: Coupling groove
320: Heat transfer plate
321*a*: First staying space 321*b*: Second staying space
322: Communicating hole 323: Flange
324: Micro hole 325*b*: Inserted box
325*a*: Bent plate 325: Blocking rod
329: Flange 350: Cover body
351: Base body 352: Opening-closing door
390: Lower body 500: Stopping device
510: Actuator 520: Hook
600: Hot air supplier 610: Air blower
620: Heater 630: Supply path
650: Exhaust path

DETAILED DESCRIPTION OF EXEMPLARY EMBODIMENT

The embodiments set forth in this specification and the components illustrated in the drawings will be presented only as some of numerous other embodiments, and various equivalents and modifications replaceable with the embodiments and components can exist at the time of filing this application. The terms described hereunder are those defined considering the functions described in the present disclosure and vary depending on the intention or the practice of the user or operator. Therefore, such terms should be defined on the basis of description throughout the specification.

Below, a towel maintenance device according to embodiments is described with reference to the drawings.

FIG. 2 is a perspective view showing a structure of a towel maintenance device according to a first embodiment, and FIG. 3 is a cross-sectional view showing the structure of the towel maintenance device according to the first embodiment.

The present disclosure relates to a towel maintenance device that stores and keeps a textile product such as a towel or a robe and heats and dries the textile product such as a towel or a robe stored and kept therein.

An object to be dried such as a towel or a robe is collectively referred to as a towel, hereunder.

The towel maintenance device 100-1 according to the first embodiment may include a base body 110, a heat transfer plate 120 mounted onto the base body 110, an air blower 130 configured to blow air into the heat transfer plate 120, and a heater 141 or 142 for heating air supplied through the air blower 130.

The base body 110 may support the towel maintenance device 100-1. The base body 110 may be provided with the air blower 130 therein and a suction port 112 through which air suctioned into the air blower 130 communicates. The suction port 112, as illustrated, may be disposed on a lateral surface or a bottom surface of the base body 110.

When the suction port 112 is disposed on the bottom surface of the base body 110, the bottom surface of the base body 110 may be spaced from a floor where the base body 110 is installed, for example. To this end, the base body 110 may be provided with a support leg 115 for spacing the bottom surface of the base body 110 from the floor, on the bottom surface thereof.

An exterior of the heat transfer plate 120 may have a plate shape of a predetermined thickness, and may be disposed vertically in the base body 110. The heat transfer plate 120 may have a staying space 125 in which heated air stays, therein.

Additionally, an outer surface of the heat transfer plate 120 may contact a surface of a towel 50 held on the heat transfer plate. The heat transfer plate 120 may be provided with a communicating hole 122 through which air in the staying space 125 is discharged outward.

The heat transfer plate 120 may be formed into a plate made of a metallic material having an excellent thermal conductivity. Accordingly, the heat transfer plate 120 itself may be rapidly heated by heated air supplied to the staying space 125.

The heat transfer plate 120 may include two lateral surfaces vertically formed, and an upper surface configured to connect the two lateral surfaces from above. Accordingly, an inner surface of a towel 50 held on the heat transfer plate 120 may be held on the heat transfer plate 120 and may contact the same by self-weight of the towel 50. Thus, the heat transfer plate 120 may contact the inner surface of the towel smoothly.

Edges of the two lateral surfaces and the upper surface may be rounded and curved or may be orthogonal, or the entire upper surface may be curved.

In the illustrated embodiment, a gap between both lateral surfaces of the heat transfer plate 120 remains constant and the heat transfer plate 120 is formed perpendicularly. However, the gap may be tapered in a way that the gap between both lateral surfaces of the heat transfer plate becomes narrow toward an upper portion of the heat transfer plate. When the gap between both lateral surfaces of the heat transfer plate 120 becomes narrow toward the upper portion of the heat transfer plate, in other words, becomes wide toward a lower portion of the heat transfer plate, a lower portion of the towel held on the heat transfer plate 120 may contact the heat transfer plate 120 more effectively.

The towel maintenance device 100-1 according to the present disclosure may supply heated air into the staying space 125 of the heat transfer plate 120, the heat transfer plate 120 may be heated by the heated air flowing in the staying space 125, and the heated air supplied into a first staying space 125 may pass through the towel 50 while being discharged out of the first staying space 125 through the communicating hole 122 formed on the heat transfer plate 120.

Vapor, which is generated from the towel while the heated air passes through the towel 50, is smoothly discharged. Additionally, in the towel maintenance device 100-1 according to the present disclosure, the air blower 130 may be disposed at a position lower than a position of the heat transfer plate 120, thereby ensuring a continuous upward flow of air as a whole.

The continuous upward flow may not denote a state in which air flows upward and downward but a state in which air continues to flow upward or flow at least horizontally. When heated air flows upward continuously, flow velocity may be further increased along the upward flow by natural convection, thereby flow loss may be reduced.

In this embodiment, air may be suctioned through the lateral surfaces of the base body 110, may continue to flow upward through an air blowing fan 132, may stay in the staying space in the heat transfer plate 120 and then may be discharged, to heat and dry the towel 50.

The towel 50 held on the heat transfer plate 120 may contact a surface of the heat transfer plate 120. Accordingly, when the heat transfer plate 120 is heated, heat of the heat transfer plate 120 may be delivered to the towel 50 in contact with the heat transfer plate 120, based on conduction. Additionally, the towel may also receive heat based on convection in which heated air, discharged out of the heat transfer plate 120 through the communicating hole 122, is diffused while passing through the towel 50.

In the above towel warmer of the related art, heat is mainly delivered to a towel in contact with a cover member based on conduction. In this case, heat is hardly delivered to an outer surface of the towel having no contact with the cover member, and vapor is not smoothly discharged from a surface of the towel in contact with the cover member. Thus, it takes an excessive amount of time to dry the towel.

On the contrary, according to the present disclosure, heat may be delivered to a surface of a towel in contact with the heat transfer plate 120 based on conduction, and heat may also be delivered to a towel based on convection of air when heated air discharged from the heat transfer plate 120 passes through a towel or flows around a towel. Thus, heat may be more efficiently delivered to a towel 50 as a whole.

Accordingly, in the case of a towel 50 stored and kept in the towel maintenance device 100-1 according to the present disclosure, the inner surface of the towel, having direct contact with the heat transfer plate 120, may be heated effectively, and the other surfaces (a surface exposed to the outside and overlapped surfaces in the towel folded) of the towel, having no direct contact with the heat transfer plate 120, may also be heated and dried effectively by contacting heated air discharged from the communicating hole 122 of the heat transfer plate 120. Thus, the entire towel may be effectively heated and dried.

The air blower 130 may include an air blowing fan 132, a driving motor 134 configured to rotate the air blowing fan 132, and a path case 136 configured to guide a flow of air, generated by the air blowing fan 132, into the staying space 125 formed in the heat transfer plate 120.

The heater 141 for heating air supplied through the air blower 130, as illustrated, may be installed in the path case 136.

In another embodiment, the heater 142, as indicated by the dashed line, may be disposed in the staying space 125 formed in the heat transfer plate 120. Certainly, a plurality of heaters may all be disposed in the path case 136 and in the staying space 125 of the heat transfer plate 120. When the heater 142 is disposed in the heat transfer plate 120, heat of the heater may be delivered to the heat transfer plate 120 based on conduction, convection and radiation. Accordingly, time taken for the heat transfer plate 120 to be heated may be reduced.

FIG. 4 is a perspective view showing a structure of a towel maintenance device according to a second embodiment, and FIG. 5 is a cross-sectional view showing the structure of the towel maintenance device according to the second embodiment.

The towel maintenance device 100-2 according to the second embodiment may have a wall-mounted structure.

The towel maintenance device 100-2 according to the second embodiment may include a base body 110 fixed onto a wall, a heat transfer plate 120 mounted onto the base body 110, an air blower 130 configured to blow air into the heat transfer plate 120, and a heater (141 or 142) for heating air supplied by the air blower 130.

When the base body 110 is fixed onto a wall, air may be suctioned into the air blower 130 through a bottom surface of the base body 110. In other words, a suction port 114 may be disposed on the bottom surface of the base body 110 rather than a lateral surface of the base body 110.

In this structure, since the suction port is not formed on a lateral surface of the base body 110, an aesthetic quality of an exterior of the base body 110 may be ensured, and water may be prevented from permeating into the base body 110. Even though water permeates into the base body 110, the permeating water may be discharged from a lower portion of the base body 110 as a result of free fall.

When the suction port 114 of the air blower 130 is disposed near a wall on the bottom surface of the base body 110, permeation of water through the suction port 114 may be prevented more effectively.

Configurations and operations of the heat transfer plate 120 and the heater 141, 142 are the same as those of the heat transfer plate and the heater described with reference to the first embodiment. Accordingly, description in relation to the configurations and operations may be omitted.

In this embodiment, air may pass through the suction port 114 and moves upward, and then moves upward again and is supplied into the heat transfer plate 120, as it does in the first embodiment.

FIGS. 6 and 7 are views showing a structure of a towel maintenance device according to a third embodiment.

The towel maintenance device 100-3 according to the third embodiment may further include a cover body 150 providing a second staying space 158 that allows heated air, discharged through the communicating hole 122 of the heat transfer plate 120, to stay outside the towel held on the heat transfer plate 120.

The cover body 150 may provide an accommodating space for accommodating the heat transfer plate 120 and a towel held on the heat transfer plate 120, and the accommodating space may be the second staying space 158 that helps to increase a period of time during which heated air, discharged from the communicating hole 122 of the heat transfer plate 120, stays around a towel held on the heat transfer plate 120.

The cover body 150 may be provided with an outlet 152 that allows air in the second staying space 158 in the cover body 150 to be discharged outward, for example. When the cover body 150 is provided with no outlet 152, air may not be smoothly blown into the staying space in the heat transfer plate 120 through the air blower due to an increase in exhaust resistance caused when heated air is discharged. In other words, an excessive level of exhaust resistance may lead to a reduction in air flow, and overheating of the heater portion or an overload of the air blower.

The outlet 152 may be disposed in a lower portion of the cover body 150, for example. Heated air may rise to an upper portion of the second staying space 158 of the cover body 150. When the outlet 152 is disposed in the lower portion, a distance of a route on which the heated air moves may increase, and heat transfer between the heated air and the towel may improve in the cover body 150.

In the illustrated embodiment, the outlet 152 is formed on the cover body 150. However, the outlet 152 may also be formed on an upper surface of the base body 110, which is a lower portion of the second staying space.

The cover body 150 may be provided with an opening-closing door 154 to easily store and withdraw a towel stored in the cover body 150. The opening-closing door 154, as illustrated, may be formed in a way that an upper surface and a lateral surface of the cover body 150 connect and may be opened and closed by a swivel hinge. Certainly, the opening-closing door 154 of the cover body 150 may be formed in a way that the lateral surface is solely opened and closed or in a way that the upper surface is solely opened and closed.

Additionally, the cover body 150 may be provided with a sight glass 156 made of a transparent material or a translucent material such that an inside of the cover body 150 can be seen. Accordingly, the sight glass may be used to see whether a towel is stored in the cover body 150 with no need to open the opening-closing door 154. Certainly, the entire cover body 150 may be made of a transparent material or a translucent material such that the entire cover body 150 serves as a sight glass.

FIGS. 8 and 9 are views showing a structure of a towel maintenance device according to a fourth embodiment.

In the towel maintenance device 100-4 according to the fourth embodiment, the cover body 150 may be provided with a sliding opening-closing door 157, as illustrated.

As illustrated, the opening-closing door 157, a lateral surface and an upper surface of which slide, may be provided. The opening-closing door 157 may be opened as a result of sliding, and then a towel may be held on the heat transfer plate 120 or may be withdrawn from the heat transfer plate 120.

In the illustrated embodiment, the opening-closing door 157 slides horizontally. However, the opening-closing door may be configured to slide vertically.

FIGS. 10 and 11 are views showing a structure of a towel maintenance device according to a fifth embodiment.

The towel maintenance device 200 according to the fifth embodiment may include a base body 210, a sliding body 220 slid and withdrawn from the base body 210, a heat transfer plate 230 mounted onto the sliding body 220, and a cover body 250 providing a second staying space 258 as an accommodating space that accommodates the heat transfer plate 230 and a towel held on the heat transfer plate 230.

In this case, the cover body 250 may include a fixed body 252 fixed to the base body 210, and an opening-closing door 254 fixed to the sliding body 220 and withdrawn along with the sliding body 220.

In the towel maintenance device 200 according to the fifth embodiment, provided is a drawer-type withdrawn structure in which the heat transfer plate 230 and the opening-closing door 254 are mounted onto the sliding body 220 slid and withdrawn from the base body, and the sliding body 220 is withdrawn to withdraw the heat transfer plate 230 out of the cover body 250.

In the structure, a user may place a towel on the heat transfer plate 230 or take out a towel from the heat transfer plate 230 in a state in which the heat transfer plate 230 is withdrawn out of the cover body 250, thereby improving user convenience.

FIG. 12 is a perspective view showing an exterior of bathroom furniture provided with a towel maintenance device according to a sixth embodiment, and FIG. 13 is a perspective view showing an exterior of a drawer-type towel maintenance device according to the sixth embodiment, withdrawn from bathroom furniture.

In the sixth embodiment, provided is a structure in which the towel maintenance device may be built into storage furniture placed in a bathroom such that the heat transfer plate of the towel maintenance device is withdrawn like a drawer.

The bathroom furniture 10, as illustrated, may include a bathroom furniture body 11 providing structural strength and forming an exterior, a washbasin 12 including a faucet 14, a drawer-type towel maintenance device 300 configured to store and manage a towel, and a drawer-type console 18 configured to store small-sized home appliances such as a hair drier and the like.

The bathroom furniture 10 may be installed in a way that is placed on the floor of a bathroom and integrated with the washbasin 12 including the faucet 14.

The bathroom furniture 10 may include a bathroom furniture body 11, a washbasin 12, a drawer-type towel maintenance device 300 and a drawer-type console 18.

The bathroom furniture body 11 may include a frame providing structural strength, an exterior panel attached to the frame and forming an exterior, an inner panel attached to the frame and dividing an inner space, and a bottom plate forming a bottom surface.

The washbasin 12 may include a washbasin body 13, a faucet 14, and a pop-up valve 15 disposed in a lower portion of the washbasin body 13.

The washbasin body 13 may be made of a light transmitting material. A washbasin body 13 made of a light transmitting material may further include a washbasin light in the lower portion of (or inside) the washbasin body 13.

The faucet 14 of the washbasin 12 may connect to a water supply pipe, and the pop-up valve 15 may connect to a water drainage pipe. The water supply pipe to which the faucet 14 connects may include a cool water pipe and a hot water pipe.

The faucet 14 may be provided with an additional handle to adjust an amount and a temperature of water coming from the faucet 14 as a result of manipulation of the handle.

An electronic valve for controlling the faucet 14 may be provided to electronically control a temperature and an amount of water supplied through the faucet 14. The electronic control of the faucet may be performed by an integrated manipulation switch described below or may be performed as a result of sensing by an additional sensor and the like.

In the illustrated embodiment, the drawer-type towel maintenance device 300 is disposed on a left side of the bathroom furniture 10, and the drawer-type console 18 is disposed on a right side of the bathroom furniture. However, the drawer-type towel maintenance device may be disposed on the right side of the bathroom furniture, and the drawer-type console may be disposed on the left side of the bathroom furniture.

When a left-right length of the bathroom furniture 10 increases, a plurality of drawer-type towel maintenance devices 300 or drawer-type consoles 18 may be provided, and a drawer providing only a storage space may be further provided.

The drawer-type towel maintenance device 300 may heat or dry a stored towel. The drawer-type towel maintenance device 300 may include a sliding body 310 connected to the bathroom furniture body 11 and withdrawn like a drawer, and a heat transfer plate 320 serving as a holder on which a towel is held.

The heat transfer plate 320 may be made of a metallic material having a high thermal conductivity, for example. The heat transfer plate 320 may have a "∩"-shaped cross section as the heat transfer plate 320 is provided with a first staying space therein. The "∩"-shaped cross section may help heated air to be supplied to the first staying space in the heat transfer plate 320 and to heat the heat transfer plate 320.

Additionally, the heat transfer plate 320 may be provided with a plurality of communicating holes 322 on a surface facing a towel. Heated air, introduced into the heat transfer plate 320, may be supplied to the towel through the communicating holes 322.

In order for heated air to be supplied into the heat transfer plate 320, a heater and an air blowing fan need to be provided. In this case, the heater and the air blowing fan may be disposed in a lower portion of the bathroom furniture body. The heater and air blowing fan may be collectively referred to as a hot air supplier.

Additionally, the heater and air blowing fan may perform a function of supplying heated air to other parts as well as the function of supplying heated air to the drawer-type towel maintenance device 300. Other parts described above may be another storage space in the bathroom furniture 10 or a bathroom space.

For example, a structure capable of changing a flow path of heated air may be provided to supply heated air to a lower portion of the bathroom furniture 10 and to dry the floor of a bathroom or a rug on the floor of a bathroom.

Alternatively, heated air may be supplied from the lower portion to an upper portion of the bathroom furniture 10 to dry the body of a user in front of the bathroom furniture.

The bathroom furniture according to the present disclosure may further include a sensor capable of sensing an approach of the user's body or a position of the user's hand in the washbasin and the like.

The bathroom furniture 10 according to the present disclosure may further include an integrated manipulation switch 16.

For example, to adjust an amount of water coming out of the faucet, a dial may be turned clockwise and then the amount of the water may increase. To adjust a temperature of water coming out of the faucet, the dial may be turned clockwise and then the temperature of the water may rise.

Further, the dial may be turned to select an object to be adjusted.

The integrated manipulation switch 16 may be used to manipulate the towel maintenance device 300. For example, the dial may be turned to manipulate or set an air amount or an operation period (a timer) of the towel maintenance device 300.

FIG. 14 is a view showing a state in which the towel maintenance device according to the sixth embodiment is separated from bathroom furniture, FIG. 15 is a lengthwise cross-sectional view showing a structure in the towel maintenance device according to the sixth embodiment, and FIG. 16 is a left-right cross-sectional view showing the structure in the towel maintenance device according to the sixth embodiment.

The towel maintenance device 300 according to the present disclosure, as illustrated, may have a structure in which the towel maintenance device is pushed into and withdrawn from the bathroom furniture 10 like a drawer.

The towel maintenance device 300 according to the present disclosure may include a cover body 350 built into the bathroom furniture, a base body 351 connected to a lower portion of the cover body 350, a sliding body 310 connected to the base body 351 in a way that the sliding body is pushed into and pulled out of the base body, and a heat transfer plate 320 coupled to the sliding body 310.

In this embodiment, the base body 351 according to the embodiments described above is integrated into the lower portion of the cover body 350.

The sliding body 310 may have a " Ш" shape that is open upward. Each portion of the " Ш" shape may be respectively referred to as an outer plate 312, a bottom plate 314 and a back blocking plate 316.

The heat transfer plate 320 may be coupled to the outer plate 312 and the back blocking plate 316 of the sliding body 310 in a way that the heat transfer plate connects the outer plate and the back blocking plate, and may also be coupled to the bottom plate 314 of the sliding body 310.

The sliding body 310 may be formed to be symmetrical in a front-rear direction, and the heat transfer plate 320 may also be formed to be symmetrical in the front-rear direction.

Additionally, the sliding body 310 may be formed to be symmetrical in a left-right direction. The symmetrical shape of the sliding body 310 in the front-rear and left-right directions may ensure aesthetic qualities in design.

Further, the sliding body 310 may be implemented as a result of assembly of two identical components, thereby reducing manufacturing costs. A synthetic resin-based injection molded product may be applied to the sliding body 310. In this case, as the injection molded product may be scaled up, an injection molding may be scaled up, and a manufacturing process may become more complex. In this embodiment, for the sliding body 310, two symmetrical components may be assembled, thereby scaling down a molding for manufacturing the sliding body 310.

The cover body 350 may have a hexahedron shape a front surface of which is open, and an opening-closing door 352 closing the open surface may be fixed to the sliding body 310. An inner space of the cover body 350 may provide a second staying space that allows heated air to stay around a towel in a state in which the sliding body 310 is stored in the cover body 350.

In a towel maintenance device 300 built into the bathroom furniture 10, the cover body 350 may be coupled to the frame of the bathroom furniture.

Considering heated air is supplied through the base body 351 disposed on a bottom surface of the cover body 350, the base body 351 may be integrated into a bottom frame of the bathroom furniture.

The towel maintenance device 300 according to the present disclosure may be put into the inner space of the cover body 350 in a state where a towel or a robe and the like is held on the heat transfer plate 320. In this state, heat may be transferred to the towel based on conduction and convection, and the towel may be heated and dried, in the inner space of the cover body 350.

Heated air may be supplied through a hot air supplier 600 including a heater and an air blower installed in the bathroom furniture 10. The hot air supplier 600 may suction external air to blow air, and may include a heater for heating.

Heater air supplied by the hot air supplier 600 may be supplied to the first staying space 321*a* in the heat transfer plate 320 through a supply path 630. The air supplied to the first staying space 321*a* of the heat transfer plate 320 may be discharged to the second staying space 321*b* through a communicating hole formed on the heat transfer plate 320 while heating the heat transfer plate 320. The supply path 630 may be formed into an L shape and may allow supplied air to flow upward, for example.

To improve efficiency of air supply, an amount of leaked air needs to be reduced. In this embodiment, a gap may be unavoidably formed between the supply path 630 and a connection path 313. To prevent gases from leaking through the gap, supplied air needs to have a fast flow velocity, and an upward flow of heated air as a result of natural convection may lead to an upward flow of air.

The communicating hole 322 may be disposed at a front and rear of the heat transfer plate 320 in a slot shape that is formed in an up-down direction. The shape may help air to be smoothly discharged through the communicating hole 322 in the state where a towel or clothing is held on the heat transfer plate 320.

The air discharged from the heat transfer plate 320 through the communicating hole 322 may still stay in the second staying space 321*b* that is the inner space of the cover body 350. The air may circulate in the second staying space 321*b* in the cover body and then may be discharged again out of the bathroom furniture through an exhaust port 314*a* disposed on the bottom plate of the sliding body 310.

Water falling from a product to be dried may be discharged through the exhaust port 314*a*. A wet towel or a wet robe may be stored in the towel maintenance device. In this case, water may fall from the wet towel. The water falling may pass through the base body and may be discharged outward through the exhaust port 314*a*.

To this end, a discharge route after the exhaust port 314*a* may be formed into a flow path that inclines downward toward the bottom surface/floor, for example.

Considering drainage of water, electronic components such as an air blower, a sensor and the like may not be disposed on a route on which water falls, for example.

Since the heat transfer plate 320 heats a held towel based on thermal conduction, the heat transfer plate 320 may be made of a material having an excellent heat conductivity, for example.

Additionally, since textile products such as a towel and the like held on the heat transfer plate 320 are wet, the heat transfer plate 320 may be made of a material having erosion resistance, for example.

Accordingly, the heat transfer plate 320 may be made of a metallic material such as stainless steel, copper or a copper alloy, aluminum or an aluminum alloy and the like, and may be manufactured as a result of press forming of a metallic plate.

FIG. 17 is a view for describing a flow of hot air of the drawer-type towel maintenance device according to the sixth embodiment into a heat transfer plate, FIG. 18 is a view for describing a flow of air in a heat transfer plate of the drawer-type towel maintenance device according to the sixth embodiment, and FIG. 19 is a view for describing a flow of air through an exhaust port of the drawer-type towel maintenance device according to the sixth embodiment.

Referring to FIG. 17, the towel maintenance device 300 according to the embodiment may receive heated air (hot air) from the hot air supplier 600 installed in the bathroom furniture 10. The hot air supplier 600 may include an air blower 610, a heater 620 and a supply path 630.

Hot air supplied by the air blower 610 and the heater 620 may be supplied to the supply path 630. The supply path 630 may guide hot air into the first staying space 321*a* of the heat transfer plate 320. The supply path 630 may have an outlet side bent in an L shape. Accordingly, air supplied through the supply path 630 may move upward.

The outlet side of the supply path may communicate with a first connection path 313 or a second connection path 315 disposed in the base body.

The hot air supplier 600 may be mounted onto the base body 351. The base body 351 may be integrated into the frame of the bathroom furniture body (11 in FIG. 12).

Referring to FIG. 18, hot air introduced into the heat transfer plate 320 may be discharged through the communicating hole 322 formed in the up-down direction at both sides of the front and rear of the heat transfer plate 320. Accordingly, the hot air may be discharged through the communicating hole 322 at both sides after moving along a relative long route in the heat transfer plate 320.

The hot air supplied to the inner space of the heat transfer plate 320 may heat the heat transfer plate 320 based on conduction and convection. Since a towel is held on an outer surface of the heat transfer plate 320, the towel held on the heat transfer plate 320 may be heated as a result of heating of the heat transfer plate 320.

Additionally, some of the heated air may be discharged through a micro hole 324 formed on the heat transfer plate 320, and the heated air may be supplied to a surface of the towel in contact with the heat transfer plate 320.

In other words, out of both surfaces of a towel stored in the towel maintenance device, a lower surface of the towel, having contact with the heat transfer plate 320, may be heated based on conduction with the heat transfer plate 320, and an upper surface of the towel, having no contact with the heat transfer plate 320, may be heated based on convection of air.

Efficiency of heating using hot air may closely relate to a route of movement of the hot air. To effectively transfer heat of hot air to a towel, a route of the hot air needs to be long, and the heat of the hot air needs to be transferred to the towel through the long route.

The towel maintenance device according to the embodiment may ensure a relatively long route (path way) of movement of hot air even in the heat transfer plate 320 and a route on which hot air sufficiently contacts a towel even in the cover body 350.

The heat transfer plate 320 may have a hollow shape forming the first staying space 321*a*, which allows heated air to stay, therein, and may have an upper surface closed. Hot air, supplied in an upward direction from a bottom surface of the heat transfer plate 320, may return after moving upward to the upper portion of the heat transfer plate 320 in the first staying space 321*a* and may be discharged through the communicating hole 322 formed on both sides of the heat transfer plate 320. Further, air may be supplied into the first staying space 321*a* while flowing along a continuous upward route.

In the structure, a sufficiently long route of movement of hot air may be ensured in the heat transfer plate 320. Accordingly, the heat transfer plate 320 may be heated while the hot air moves.

Additionally, the heat transfer plate 320 may be provided with a micro hole 324 on both lateral surfaces thereof, and some of the hot air may be discharged through the micro hole 324. However, the micro hole 324 is covered by a towel when the towel is held on the heat transfer plate 320. Accordingly, a flow rate of hot air discharged through the micro hole 324 is very low because flow resistance of hot air discharged through the towel is high.

Certainly, a relatively high flow rate of hot air may be discharged through a micro hole 324 that is exposed and not covered by a towel.

Hot air may flow along a route on which the hot air heats the heat transfer plate 320 while moving in the heat transfer plate 320, circulates in the inner space of the cover body that is an outside of the heat transfer plate 320, and then is discharged out of the cover body.

The heat transfer plate 320 may be provided with the communicating hole 322 that formed in the up-down direction on both sides of the heat transfer plate 320, and hot air supplied into the heat transfer plate 320 may be discharged through the communicating hole. The hot air discharged through the communicating hole 322 may circulate in the inner space of the cover body, and then may be discharged out of the cover body through the exhaust port 314*a*.

The exhaust port 314*a* may be formed on the bottom surface of the sliding body 310. When the exhaust port 314*a* is disposed on a bottom portion of the sliding body 310, air having a relatively low temperature may be pushed and discharged since hot air moves upward. Accordingly, heat transfer of hot air may improve.

The exhaust port 314*a* may further include an exhaust path 650 for guiding hot air discharged through the exhaust port 314*a*. The exhaust path 650 may allow hot air to be discharged toward the floor of a place in which the bathroom furniture 10 is installed. The exhaust path 650 may be disposed in the base body.

Accordingly, the floor of the bathroom in which the bathroom furniture 10 is installed may be dried. In a wet type bathroom, water and moisture on tiles of the floor may be dried, and in a dry type bathroom, a rug on the floor of the bathroom may be dried.

Additionally, the drawer-type towel maintenance device according to the present disclosure has a structure in which hot air is supplied into the cover body, which results in heating the cover body. Accordingly, when the drawer-type towel maintenance device is opened during supply of hot air, the user's body may contact the heat transfer plate heated and be injured.

To prevent this from happening, a temperature sensor capable of measuring a temperature in the cover body may be provided, and a safety device that prevents the sliding body from being withdrawn out of the cover body when the temperature in the cover body is high may be further provided.

FIG. 20 is a view for describing an inflow route and a discharge route of air of the towel maintenance device according to the sixth embodiment.

As illustrated, the base body may be provided with a supply path 630 and an exhaust path 650, and the sliding body may be provided with a first connection path 313 and a second connection path 315.

In a state in which the sliding body overlaps the base body, that is, the sliding body is completely put into the cover body, the first connection path 313 may communicate with the supply path 630, and the second connection path 315 may communicate with the exhaust path 650.

Air supplied by the hot air supplier 600 may be supplied to the first staying space 321*a* in the heat transfer plate 320 through the first connection path 313 formed in the sliding body 310 connected to the lower portion of the heat transfer plate 320, and air discharged out of the first staying space 321*a* may pass through the exhaust port 314*a* formed in the sliding body 310 into the second staying space 321*b*, may pass through the exhaust path 650 formed in the base body 351 and may be discharged out of the bathroom furniture.

Considering safety of the user of the drawer-type towel maintenance device 300, the heat transfer plate 320 may be heated only in the state in which the drawer-type towel maintenance device 300 is inserted into the bathroom furniture 10, for example. When heating is performed in a state in which the heat transfer plate 320 is withdrawn, air supplied to heat a towel may spread to a space without staying around the towel. Accordingly, the towel may not be effectively heated.

The first connection path 313 disposed in the sliding body 310 and the supply path 630 disposed in the base body may communicate in a state in which the sliding body 310 is stored in the bathroom furniture.

Air heated in the hot air supplier 600 may be supplied into the first staying space 321*a* in the heat transfer plate 320 along the supply path 630 through the first connection path 313 communicating with the supply path 630.

The heat transfer plate 320 may be heated by the air introduced into the first staying space 321*a* in the heat transfer plate 320, and the air in the first staying space 321*a* may be discharged through the communicating hole 322 and may flow to the second staying space 321*b*. The air in the second staying space 321*b* may pass through the exhaust port 314*a* disposed in the sliding body 310 and then may be discharged out of the bathroom furniture 10 through the exhaust path 650.

When the user withdraws a towel held on the heat transfer plate 320 after the drawer-type towel maintenance device 300 is put into and heated in the bathroom furniture 10, the heat transfer plate 320 heated may be exposed. In this case, when the user contacts the surface of the heat transfer plate 320, the user may feel unpleasant or suffer low temperature burns.

According to the present disclosure, provided is a safety device that may sense a temperature of the heat transfer plate 320, and when the temperature of the heat transfer plate 320 is a predetermined temperature or greater, may rapidly cool the heat transfer plate, in the state in which the drawer-type towel maintenance device 300 is withdrawn, for example.

For example, when the temperature of the heat transfer plate 320 is 50° C. or greater, the drawer-type towel maintenance device 300 may be stopped from being withdrawn, and when the temperature of the heat transfer plate 320 is less than 50° C., the drawer-type towel maintenance device 300 may be withdrawn.

To this end, the drawer-type towel maintenance device according to the present disclosure may further include a temperature sensor, a stopping device 500 and a controller that receives a temperature of the temperature sensor and controls an operation of the stopping device. The stopping device 500 may operate to stop the sliding body 310 of the drawer-type towel maintenance device 300 from being withdrawn.

The drawer-type towel maintenance device according to the present disclosure may further include a towel sensor (not illustrated) for sensing whether a towel is held on the heat transfer plate 320. The towel sensor may sense a change in thicknesses or a block of light and the like in an area in which a towel is placed using a proximity sensor or a photodiode, to sense a state in which the towel is placed.

Results of sensing of a towel may be delivered to the controller such that hot air is not supplied in a state in which a towel is not placed in the towel maintenance device, for example.

FIG. 21 is a view showing a state in which the drawer-type towel maintenance device according to the sixth embodiment is stopped from being withdrawn by a stopping device, FIG. 22 is a view showing a state in which the stopping device, configured to stop the heat transfer plate of the drawer-type towel maintenance device according to the sixth embodiment from being withdrawn, is operated, and FIG. 23 is a view showing a state in which the heat transfer plate can be withdrawn after the stopping device of the drawer-type towel maintenance device according to the sixth embodiment stops operating.

The stopping device 500 of the drawer-type towel maintenance device 300 according to the sixth embodiment may include a hook 520 protruding toward an inside of the cover body 350 and interfering with movement of the back blocking plate 316 connected to an inside of the heat transfer plate 320, and an actuator 510 configured to swivel the hook 520.

When the actuator 510 operates to allow the hook 520 to protrude as illustrated in FIG. 22, the hook 520 may interfere with movement of the back blocking plate 316 connected to an inner end of the heat transfer plate 320.

In the illustrated embodiment, the stopping device 500 is disposed on an upper surface of the cover body 350. However, the stopping device 500 may also be disposed on a lateral surface of the cover body 350. Additionally, in the illustrated embodiment, the hook 520 of the stopping device 500 is configured to interfere with the back blocking plate 316 of the sliding body 310. However, the hook may also be configured to interfere with another portion.

As illustrated in FIGS. 22 and 23, the stopping device 500 may be a structure that allows one side of the hook 520 to eccentrically connect to a rotational axis of the actuator 510. In the structure, a degree to which the hook 520 protrudes may vary depending on swiveling amount of the actuator 510.

In the illustrated embodiment, a rotational actuator 510 is applied. However, an actuator that makes a linear movement using an electromagnet and the like may also be applied.

Operations of the actuator 510 may be controlled by the controller (not illustrated) depending on a temperature of the heat transfer plate 320 which is sensed by the temperature sensor (not illustrated).

When the temperature of the heat transfer plate 320 is a predetermined safety temperature or greater, the stopping device 500 may operate to stop the heat transfer plate 320 from being withdrawn, and when the temperature of the heat transfer plate 320 is less than the predetermined safety temperature, the stopping device 500 may operate to allow the heat transfer plate 320 to be withdrawn.

In this case, the stopping device 500 may be disposed such that the heat transfer plate 320 is not withdrawn at all. However, the stopping device 500 may also be configured to stop the heat transfer plate 320 from being withdrawn after the heat transfer plate 320 is withdrawn by a predetermined distance, as illustrated. When the heat transfer plate 320 is withdrawn by a predetermined distance and then stopped, heated air in the second staying space 321*b* may be rapidly discharged through the withdrawn portion, and a temperature of the surface of the heat transfer plate 320 may rapidly decrease.

FIG. 24 is a view showing a state in which air is introduced through a second connection path of the drawer-type towel maintenance device according to the sixth embodiment.

The second connection path 315 may be disposed in the sliding body 310 in a way that communicates with the first staying space 321*a* in the heat transfer plate 320. The second connection path 315 may be disposed more inside than the first connection path 313.

The first connection path 313 may be disposed at the front of the sliding body, and the second connection path 315 may be disposed at the rear of the sliding body. The first connection path 313 and the second connection path 315 may be disposed side by side in the front-rear direction with respect to a movement direction of the sliding body.

In the structure, the supply path 630 and the first connection path 313 or the second connection path 315 may selectively communicate depending on a position of the sliding body.

When the temperature of the heat transfer plate 320, sensed by the temperature sensor (not illustrated), is a predetermined safety temperature or greater, the heat transfer plate 320 may be stopped from being withdrawn. At a position where the heat transfer plate 320 is stopped from being withdrawn, room-temperature air (air not heated by the heater) may be supplied into the heat transfer plate 320 through the second connection path 315.

In the structure, the heat transfer plate 320 may rapidly cool, and the user may withdraw the heat transfer plate 320 in a safe manner and take out a towel held on the heat transfer plate 320 to use the towel.

To this end, the second connection path 315 may be disposed to communicate with the supply path 630 disposed in the base body 351 at the position where the heat transfer plate 320 is stopped by the stopping device 500.

FIG. 25 is a view showing a flow of air in the drawer-type towel maintenance device according to the sixth embodiment provided with no back blocking plate, and FIG. 26 is a view showing a flow of air in the drawer-type towel maintenance device according to the sixth embodiment provided with a back blocking plate.

When the back blocking plate 316 is not provided as illustrated in FIG. 25, air, discharged through the communicating hole 322 of the heat transfer plate 320, may leak into the inner space of the cover body 350 in a significant amount. Accordingly, the air may remain in the inner space of the cover body 350.

When the back blocking plate 316 is provided as illustrated in FIG. 26, air discharged through the communicating hole 322 may be smoothly discharged to outside.

FIGS. 27 and 28 are views for describing opening-closing dampers disposed at the first connection path and the second connection path of the drawer-type towel maintenance device according to the sixth embodiment.

The first connection path 313 and the second connection path 315, as described above, may be disposed to selectively connect to the supply path 630 depending on a state in which the heat transfer plate 320 is withdrawn.

Since the first connection path 313 and the second connection path 315 are all disposed at positions where the first connection path 313 and the second connection path 315 communicate with the first staying space 321*a* in the heat transfer plate 320, heated air may be discharged outward through the second connection path 315 near the first connection path 313 when the heated air is supplied through the first connection path 313.

Even when room-temperature air, which is not heated, is supplied to the first staying space in the heat transfer plate 320 through the second connection path 315, the room-temperature air may be discharged outward through the first connection path 313.

To solve the problem, an opening-closing damper 313*a*, 315*a*, opened by pressure of air supplied to the first connection path 313 and the second connection path 315, may be provided, according to the present disclosure.

In the structure, the opening-closing damper 313*a*, 315*a* may be opened by pressure of air supplied through the supply path 630, and when heated air is supplied through the first connection path 313, discharge of the heated air through the second connection path 315 may be reduced. Likewise, even when room-temperature air is supplied through the second connection path 315, discharge of the room-temperature air supplied through the first connection path 313 may be reduced.

The opening-closing damper 313*a*, 315*a* may be connected to an inlet and the second connection path 315 respectively by a hinge shaft and may be moved upward and opened by air pressure.

As illustrated in FIG. 27, a first opening-closing damper 313*a* of the first connection path 313 may be opened by pressure of air supplied through the supply path in a state where the first connection path 313 communicates with the supply path 630, and a second opening-closing damper 315*a* of the second connection path 315 may be kept close.

As illustrated in FIG. 28, the second opening-closing damper 315*a* of the second connection path 315 may be opened by pressure of air supplied through the supply path in a state where the second connection path 315 communicates with the supply path 630, and the first opening-closing damper 313*a* of the first connection path 313 may be kept close.

FIG. 29 is a perspective view showing the heat transfer plate of the towel maintenance device according to the sixth embodiment, and FIG. 30 is a perspective exploded view showing a sliding body and the heat transfer plate in the towel maintenance device according to the sixth embodiment In the towel maintenance device 300 according to the sixth embodiment, a towel may be stored in the cover body in a state in which the towel is held on the heat transfer plate 320. In this case, a surface of the towel held on the heat transfer plate 320 may receive heat from the heat transfer plate 320 based on conduction, and a surface exposed to an inside of the storage space may receive heat based on convection of hot air.

Hot air supplied to the towel maintenance device 300 according to the present disclosure may move along a route on which the hot air heats the heat transfer plate 320 while moving in the heat transfer plate 320, and then is discharged out of the heat transfer plate 320, circulates in the inner space of the cover body 350 and then is discharged out of the bathroom furniture 10.

To effectively transfer heat of hot air, the flow route needs to be long. As the flow route becomes longer, a surface area heat exchanged as a result of contact with hot air may increase, and time for heat exchange may increase.

A surface of the heat transfer plate 320, in contact with a towel (or a robe) held thereon, may be heated based on conduction. The heat transfer plate 320 may be manufactured as a result of press forming of a metallic plate having an excellent thermal conductivity.

The heat transfer plate 320 may have enough strength to hold a towel. Accordingly, the heat transfer plate may not require a high strength. Since the heat transfer plate 320 needs to be heated by hot air moving in the heat transfer plate, the heat transfer plate may be made of a metallic thin plate having a high thermal conductivity, for example. Materials such as copper (or a copper alloy), aluminum (or an aluminum alloy), stainless steel and the like may be used for the heat transfer plate.

Since the heat transfer plate 320 holds a wet towel, the heat transfer plate may be made of a material having excellent erosion resistance against moisture, for example.

For the heat transfer plate 320, a plate may be bent in an upper portion. The heat transfer plate may have a "∩"-shaped cross section in the up-down direction. The heat transfer plate may have a hollow inside and a gap.

Additionally, a flange 323 coupled to an upper body may be disposed in both end portions of the heat transfer plate 320 in the front-rear direction. The flange 323 may be bent outward in a state in which the heat transfer plate 320 is inserted into a central portion of the upper body and may be coupled to the upper body 310*a*, 310*b*.

The upper body 310*a*, 310*b* may be formed as a result of coupling two identical components.

The upper body 310*a*, 310*b*, as illustrated, may be formed as a result of coupling of two components that are divided into two in a longitudinal direction. The upper body 310*a*, 310*b* may have a shape in which an outer plate 312, a bottom plate 314 and a back blocking plate 316 integrally connect.

A rear upper body 310*b* with the back blocking plate 316 on the left side thereof in the drawing may be coupled to a front upper body 310*a*.

The outer plate 312 and the back blocking plate 316 may be respectively provided with a coupling projection 312*a*, 312*b* and a coupling groove 316*a*, 316*b*, at rears thereof.

In the illustrated embodiment, the coupling projection 312*a*, 312*b* may be disposed on a rear surface of the outer plate, and the coupling groove 316*a*, 316*b* fitting-coupled to the coupling projection 312*a*, 312*b* may be disposed at the rear of the back blocking plate 316.

The bottom plate 314 may be provided with a lower body 390 therein. The lower body 390 may include a first connection path 313, a second connection path 315 and a discharge path 317. The discharge path 317 may provide a route on which air introduced into the bottom plate 314 through an exhaust port is discharged out of the bathroom furniture.

The heat transfer plate 320 may be coupled to the sliding body 310. In this case, an opening formed at the heat transfer plate 320 in the front-rear direction needs to be blocked by a blocking rod 325.

The blocking rod 325 may include an inserted box 325*b* inserted into the heat transfer plate 320, and a bent plate 325*a* bent to both sides of the inserted box 325*b* and coupled to a flange 323 described below of the heat transfer plate 320.

The heat transfer plate 320 may be provided with a flange 323 bent for surface contact with the sliding body 310, in both end portions in the front-rear direction. Since the flange 323 and the bent plate 325*a* are coupled to the sliding body 310, the heat transfer plate 320 and the blocking rod 325 and the sliding body 310 may be firmly coupled.

Hot air supplied by the air blower may be introduced into inside of the heat transfer plate 320 through the supply path 630 disposed on a lower side of the heat transfer plate 320. In this case, to prevent the introduced hot air from leaking through the openings on both sides of the heat transfer plate 320, the openings may be blocked by the blocking rod 325.

The hot air introduced through the supply path 630 may move in the inner space of the heat transfer plate 320 and may be discharged through the communicating hole 322 formed on both sides of the heat transfer plate 320.

The communicating hole 322 may be long in the up-down direction and may be disposed on both sides of the heat transfer plate 320. The communicating hole 322, disposed on both sides of the heat transfer plate in the up-down direction, may help hot air to be discharged smoothly when a towel is held on the heat transfer plate 320.

The communicating hole 322 may be disposed in edge portions on both sides of the heat transfer plate 320 in the up-down direction, and when a towel is held on the heat transfer plate, may be placed in edge portions of the held towel. Accordingly, hot air may be smoothly discharged through the communicating hole 322.

The hot air discharged through the communicating hole 322 needs to be discharged out of the cover body after circulating inside the cover body.

In this case, as the movement route of hot air becomes longer, the hot air may transfer more heat to the towel stored in the cover body.

Since air has increasing volume and decreasing density as temperature becomes higher. Accordingly, relatively hot air moves upward and relatively cold air moves downward in the natural convection phenomenon.

Hot air discharged through the above communicating hole 322 of the heat transfer plate 320 may be introduced into the cover body and discharged through the above exhaust port 314*a* disposed on the bottom plate of the sliding body 310.

A discharge path 317 passing through the bottom surface of the cover body and connected to the outside may be disposed in a space on a lower side of the exhaust port 314*a*.

In the structure, hot air may move along a longer route in the cover body and then may be discharged through the discharge path 370.

FIGS. 31 and 32 are views showing a back blocking plate and a friction guide for guiding a sliding body of a towel maintenance device according to the present disclosure.

As illustrated, the sliding body may be disposed in the accommodating space in the cover body 350, and may be put into and withdrawn from the cover body 350. The sliding body may be provided with a back blocking plate 316 configured to block the inner space of the cover body 350. The back blocking plate 316 may prevent water or a foreign substance from permeating into an area inside the back blocking plate 316. Additionally, the back blocking plate 316 may prevent a held towel from coming into a space created as a result of withdrawing of the sliding body.

The back blocking plate 316 may be spaced a predetermined movable distance apart from an inner surface of the cover body. The back blocking plate 316 may move in the cover body 350 when the heat transfer plate is put into and withdrawn from the cover body. In this case, the back blocking plate 316 may be spaced from the inner surface of the cover body not to cause a direct friction with the inner surface of the cover body.

The inner space of the cover body 350 may be a space supplied with heated air and heated by the heated air. Accordingly, it is desirable to provide a movable gap may be a few millimeters to prevent direct contact between the back blocking plate 316 and the inner surface of the cover body, caused by thermal expansion and thermal contraction.

The cover body 350 and the sliding body may be coupled by a pair of rails 820. The sliding body may be slid with respect to the cover body 350 by the rail 820. In the illustrated embodiment, the rail 820 is disposed on a bottom surface of the accommodating space in the cover body 350. However, the rail 820 may also be disposed in lower portions of both lateral surfaces in the accommodating space.

As described above, in the towel maintenance device, a towel may be held on the heat transfer plate and stored in the cover body. The accommodating space formed in the cover body 350 may have a shape with a height greater than a width.

A ratio of the width to the height of the accommodating space may be in a range of 1:2 to 1:5, for example. When the ratio of the width to the height of the accommodating space is less than 1:2, a length at which a towel is held on the heat transfer plate may be relatively short. Accordingly, the towel needs to be folded in layers and stored in the accommodating space.

When the ratio of the width to the height of the accommodating space is greater than 1:5, a structural rigidity of the heat transfer plate and the sliding body may not be ensured.

As a result, the sliding body withdrawn from the cover body 350 may have a height greater than a width. In this case, a left-right movement of the sliding body itself and the heat transfer plate fixed to the sliding body needs to be suppressed when the sliding body is put into and withdrawn from the cover body. If not, the left-right movement of the heat transfer plate or the sliding body may result in a collision of the heat transfer plate or the sliding body with the inner wall of the cover body, thereby causing damage to the heat transfer plate or the sliding body.

To solve the problem, the sliding body may be provided with the back blocking plate 316, and the friction guide 850, 870 for allowing the back blocking plate 316 to stay at a predetermined position in the accommodating space of the cover body 350 may be disposed, as illustrated.

In a state where the sliding body is completely withdrawn from the cover body, at least a portion of the back blocking plate 316 of the sliding body may remain in the cover body, for example. Accordingly, in the state where the sliding body is completely withdrawn, the back blocking plate 316 may be fixed by the friction guide 850, 870.

The friction guide may include a movement prevention guide 850 supporting both lateral surfaces of the back blocking plate 316, and a holding guide 870 supporting an upper surface of the back blocking plate 316.

When the sliding body is withdrawn, self-weight of the sliding body and weight of the heat transfer plate coupled to the sliding body and weight of a towel held on the heat transfer plate may all be applied to the sliding body. Thus, the back blocking plate 316 may be lifted. The holding guide 870 may prevent direct contact between an upper surface of the back blocking plate 316 and an upper surface in the accommodating space of the cover body and may suppress a lift of the back blocking plate 316, thereby preventing the withdrawn sliding body from sagging.

The holding guide 870 may be made of a material having excellent wear resistance and low friction coefficient, for example.

FIG. 33 is a perspective view for describing a structure of a movement prevention guide according to an embodiment, and FIG. 34 is a view for describing operation of a movement prevention guide according to an embodiment.

In an initial stage of withdrawing of the sliding body from the cover body, the sliding body needs to slide without causing significant friction with the back blocking plate 316, and since a towel is held or taken out in the state in which the sliding body is completely withdrawn, the sliding body needs to be somewhat firmly fixed.

In structure of the sliding body, a rail, as described above, is disposed limitedly on the bottom surface or a lower portion near the bottom surface, and the height is greater than the width. As a result, the sliding body may move in the left-right direction.

In a state in which the back blocking plate 316 remains in the cover body 350 and is stably fitted in the cover body 350, the heat transfer plate may be fixed more firmly.

To this end, the back blocking plate may be fixed by the movement prevention guide 850 in the state in which the sliding body is completely withdrawn, according to the present disclosure. The movement prevention guide 850 may have a different structure in a section where the back blocking plate 316 slides, and in a section where the back blocking plate 316 is fixed.

That is, in the section where the back blocking plate 316 needs to slide, a gap between the back blocking plate 316 and the movement prevention guide 850 may be formed, for example. In the section where the back blocking plate 316 needs to be fixed, the back blocking plate 316 may closely contact the movement prevention guide 850 without a gap therebetween, for example.

In a portion where a gap is formed between the back blocking plate 316 and the movement prevention guide 850, the back blocking plate 316 may slide causing low friction with the movement prevention guide 850, and in a portion where the back blocking plate 316 closely contacts the movement prevention guide 850, the back blocking plate 316 may be fixed.

As illustrated, the movement prevention guide 850 according to the embodiment may be provided with a stopping portion 852, an interim portion 854, and a moving portion 856 in a depthwise direction. A distance between the stopping portions 852 of a pair of movement prevention guides 850 may be less than a distance between the moving portions 856.

The stopping portion 852 and the moving portion 856 may protrude in a drawer space 1120 to a different degree. Accordingly, the back blocking plate 316 may be caught at a boundary between the moving portion 856 and the stopping portion 852 while sliding in the moving portion 856.

As illustrated, a distance between the interim portions 854 of the pair of movement prevention guides 850 may increase gradually in the depthwise direction, for example.

The interim portion 854 may be formed between the stopping portion 852 and the moving portion 856 such that the back blocking plate 316 sliding may smoothly move from the moving portion 856 to the stopping portion 852.

FIGS. 35 and 36 are views showing a base body of a towel maintenance device according to the present disclosure.

The base body 110-1, 110-2 may be supported by the floor, and support the towel maintenance device. The base body 110-1, 110-2 may have a size in accordance with a width W1, W2 and a depth D of the towel maintenance device.

The base body 110-1 in FIG. 35 may include a central plate 113, side plates 115-1 and support legs 117. The base body 110-2 in FIG. 36 may include a central plate 113, side plates 115-2 and support legs 117.

The base body 110-1 in FIG. 35 and the base body 110-2 in FIG. 36 may use the same components except for the side plates.

The central plate 113 at a center of the base body may correspond to the standard of the hot air supplier 600 described below and may be commonly applied like the air blowing fan.

The central plate 113 may have a shape that allows the same side plates to be coupled to both lateral surfaces thereof. In other words, both sides of the central plate 113 may have the same coupling structure as the side plates. As the width of the base body differs, the side plates may differ, but the rest components may be commonly used.

A length of the central plate 113 in the depthwise direction may be the same as a length of the side plate in the depthwise direction.

When the side plates have different sizes, the side plates may have the same depthwise length and a different widthwise length.

The side plate 115-1, 115-2 may be commonly used on left and right sides of the central portion, for example. To this end, the side plate 115-1, 115-2 may have a shape that is symmetrical in the front-rear direction.

Four support legs 117 may be provided, and may use the same components, for example. To this end, the support leg 117 may have a shape that is symmetrical in a diagonal direction. As illustrated, the support legs 117 may have an approximately square plane shape, and may be provided with a coupling projection 117*a* on surfaces facing an inside of the side plate 115-1, 115-2.

The coupling projections 117*a* may be fitted into and coupled to the side plate 115-1, 115-2, and may further include a support rod 118 connecting front and rear support legs 117.

In the structure in which the support legs 117 are fitted into and coupled to both ends of the support rod 118 as illustrated in FIG. 36, structural strength of the support leg 117 may improve.

Reference numeral 660, which is not described in the description of FIGS. 35 and 36, may denote a deflecting vane for deflecting a flow path. The deflecting vane is described hereunder with reference to FIGS. 33 to 36.

FIGS. 37 and 38 are views for describing deflection of a flow path of a towel maintenance device according to a seventh embodiment.

The towel maintenance device according to the present disclosure requires a hot air supplier supplying heated air. In embodiments described hereunder, heated air supplied by an hot air supplier may be used to dry the floor of a bathroom where the towel maintenance device is installed or to heat air in a bathroom.

As illustrated, a hot air supplier 600 including an air blower 610 and a heater 620 may be disposed in the base body of the towel maintenance device.

An outlet portion of the hot air supplier 600 may be wrapped by a branch path 670. The deflecting vane 660 may be disposed in the branch path 670. Additionally, the branch path 670 may be provided with a plurality of outlets.

The hot air supplier 600 may supply hot air to the outside of the towel maintenance device to dry the space (or floor) in the bathroom or supply hot air into the towel maintenance device.

FIG. 37 shows hot air discharged toward a bottom surface at a front of the towel maintenance device, and FIG. 38 shows hot air discharged toward an inside of the towel maintenance device.

An air blowing direction may be adjusted based on a position of the deflecting vane 660. The deflecting vane 660 may connect to an actuator such as a step motor, and may lie horizontally as illustrated in FIG. 37 or stand vertically as illustrated in FIG. 38.

The deflecting vane 660 and an actuator for driving the deflecting vane 660 may be referred to as a flow path deflecting means.

When the deflecting vane 660 stands vertically as illustrated in FIG. 38, hot air may be blocked by the deflecting vane 660, may move upward and then may communicate with the connection path describe above. In this case, the path may be referred to as a first air blowing path.

When the deflecting vane 660 lies horizontally as illustrated in FIG. 37, heated air may pass through the deflecting vane 660 and may be discharged forward and downward. In this case, the air flow may be referred to as a second air blowing path.

In the structure, heat air supplied by the hot air supplier 600 may be supplied to the space in a bathroom or to the floor of a bathroom, thereby heating air in the bathroom or drying the floor of the bathroom.

To measure temperature and humidity of air introduced into the hot air supplier 600, a temperature-humidity sensor (not illustrated) may be further provided, and a controller receiving information on temperature and humidity sensed by the temperature-humidity sensor and controlling the hot air supplier 600 and flow path deflecting means may be further provided.

FIGS. 39 and 40 are views for describing deflection of a flow path of a towel maintenance device according to an eighth embodiment.

As illustrated, the hot air supplier 600 including an air blower 610 and a heater 620 may be disposed in the base body of the towel maintenance device.

An outlet portion of the hot air supplier 600 may be wrapped by a branch path 672. The branch path 672 may be provided with a deflecting vane 660 therein. Additionally, the branch path 672 may be provided with a plurality of outlets. In the above embodiment, the branch path is provided with outlets that are divided in the up-down direction. However, in this embodiment, the branch path may be provided with side outlets.

The hot air supplier 600 may supply hot air to the outside of the towel maintenance device to dry the space (or floor) in a bathroom, or supply hot air to the inside (lateral surface) of the towel maintenance device.

An outlet in a direction of the hot air supplier 600 for drying the space in the bathroom is referred to as a main outlet, and an outlet in the other direction is referred to as an auxiliary outlet, hereunder.

FIG. 39 shows a second air blowing path on which hot air is discharged through the main outlet facing a floor at the front of the towel maintenance device, and FIG. 40 shows a first air blowing path on which hot air is discharged through the lateral auxiliary outlet facing the inside of the towel maintenance device.

Deflection of the air blowing direction (flow path) may be adjusted based on a position of the deflecting vane 660. The deflecting vane 660 may connect to an actuator such as a step motor, and may lie horizontally as illustrated in FIG. 9 or stand vertically as illustrated in FIG. 40.

A branch path may be provided with a main outlet and an auxiliary outlet. The auxiliary outlet may be branched from the main outlet. When the deflecting vane is disposed at a point after the point where the auxiliary outlet is branched, the main outlet may be blocked by standing the deflecting vane 660, and the air may be discharged through the auxiliary outlet.

When the deflecting vane 660 lies horizontally as illustrated in FIG. 39, heated air may pass through the deflecting vane 660 and may be discharged forward and downward.

When the deflecting vane 660 stands vertically as illustrated in FIG. 40, hot air may be blocked by the deflecting vane 660, and may move laterally.

Since a deflection direction of the flow path in the seventh embodiment of FIGS. 37 and 38 may differ from a deflection direction of the flow path in the eighth embodiment of FIGS. 39 and 40, the branch paths 670, 672 may use different components. However, the deflecting vane 660 disposed in the branch path may use common components.

The embodiments are described above with reference to a number of illustrative embodiments thereof. However, the embodiments are provided only as examples, and numerous other modifications and embodiments can be devised by one skilled in the art, based on the above embodiments. Thus, the scope of the right should be defined by the appended claims.

The invention claimed is:

1. A towel maintenance device, comprising:

a heat transfer plate allowing a textile product to be held and installed vertically;

a sliding body onto which the heat transfer plate is mounted and which is provided with an inlet connected to a first staying space in the heat transfer plate;

a cover body providing a second staying space allowing heated air discharged from the first staying space to stay around the heat transfer plate and a textile product held on the heat transfer plate;

a base body which is disposed under the cover body and to which the sliding body is coupled in a way that the sliding body is put into and withdrawn from the base body;

an air blower disposed in the base body and configured to supply air to the first staying space;

a heater configured to heat air supplied through the air blower; and a communicating hole formed on the heat transfer plate and providing a route on which heated air supplied to the first staying space is discharged.

2. The towel maintenance device of claim 1, wherein the cover body and the base body are built into bathroom furniture.

3. The towel maintenance device of claim 1, further comprising:

a supply path disposed in the base body and configured to guide a route of air supplied to the air blower; and an inlet disposed in the sliding body and communicating with the supply path in a state in which the sliding body is stored in the cover body.

4. The towel maintenance device of claim 1, wherein the towel maintenance device further comprises an exhaust port disposed in the sliding body and providing a route on which air in the second staying space is discharged outside.

5. The towel maintenance device of claim 1, wherein the communicating hole is disposed at a front end or a rear end of the heat transfer plate in an up-down direction.

6. The towel maintenance device of claim 5, wherein the communicating hole is slit open in a "[" shape and is concave inward.

7. The towel maintenance device of claim 1, wherein the heat transfer plate further comprises a micro hole formed on a surface of the heat transfer plate, on which a textile product is held.

8. A towel maintenance device, comprising:

a heat transfer plate allowing a textile product to be held and installed vertically;

a sliding body onto which the heat transfer plate is mounted and which is provided with an inlet connected to a first staying space in the heat transfer plate;

a cover body providing a second staying space allowing heated air discharged from the first staying space to stay around the heat transfer plate and a textile product held on the heat transfer plate;

a base body which is disposed under the cover body and to which the sliding body is coupled in a way that the sliding body is put into and withdrawn from the base body;

an air blower disposed in the base body and configured to supply air to the first staying space;

a heater configured to heat air supplied through the air blower;

a communicating hole formed on the heat transfer plate and providing a route on which heated air supplied to the first staying space is discharged;

a supply path provided in the base body and configured to guide a route of air supplied to the air blower;

an inlet disposed in the sliding body and communicating with the supply path in a state in which the sliding body is stored in the cover body;

a temperature sensor configured to measure a temperature of the heat transfer plate;

a stopping device configured to operate to selectively stop the sliding body from being withdrawn; and a controller configured to control the stopping device such that the stopping device stops the sliding body from being withdrawn when a temperature of the heat transfer plate measured by the temperature sensor is a predetermined safety temperature or greater.

9. The towel maintenance device of claim 8, wherein the stopping device is disposed to allow the sliding body to stop at a position where the sliding body is withdrawn by a predetermined distance, and the sliding body is provided with a cool air inlet allowing the supply path and the first staying space to communicate with each other at a position where the sliding body is stopped by the stopping device.

10. The towel maintenance device of claim 9, wherein the inlet and the cool air inlet are provided with an air damper that is opened and closed by pressure of air supplied through the supply path.

11. The towel maintenance device of claim 8, wherein the sliding body is provided with an inner plate connected to an inner end of the heat transfer plate, and the stopping device is disposed to interfere with a route of movement of the inner plate.

12. The towel maintenance device of claim 8, wherein the sliding body or the cover body are provided with a discharge path providing a route on which air in the second staying space is discharged outward.

13. The towel maintenance device of claim 12, wherein the discharge path is disposed below the second staying space.

* * * * *